US008988293B2

(12) United States Patent
Lim

(10) Patent No.: US 8,988,293 B2
(45) Date of Patent: Mar. 24, 2015

(54) MULTIBAND ANTENNA ASSEMBLIES INCLUDING HELICAL AND LINEAR RADIATING ELEMENTS

(71) Applicant: Laird Technologies, Inc., Earth City, MO (US)

(72) Inventor: Kean Meng Lim, Kedah (MY)

(73) Assignee: Laird Technologies, Inc., Earth City, MO (US)

( * ) Notice: Subject to any disclaimer, the term of this patent is extended or adjusted under 35 U.S.C. 154(b) by 0 days.

(21) Appl. No.: 14/137,096

(22) Filed: Dec. 20, 2013

(65) Prior Publication Data

US 2014/0111397 A1 Apr. 24, 2014

Related U.S. Application Data

(63) Continuation of application No. PCT/MY2012/000078, filed on Apr. 12, 2012.

(51) Int. Cl.

| | |
|---|---|
| ***H01Q 1/24*** | (2006.01) |
| ***H01Q 1/36*** | (2006.01) |
| ***H01Q 5/00*** | (2006.01) |
| ***H01Q 9/32*** | (2006.01) |

(52) U.S. Cl.

CPC ..... *H01Q 5/001* (2013.01); *H01Q 1/362* (2013.01); *H01Q 5/0034* (2013.01); *H01Q 5/0051* (2013.01); *H01Q 5/0058* (2013.01); *H01Q 9/32* (2013.01); *H01Q 5/0093* (2013.01)

USPC ..... 343/702; 343/895; 343/826

(58) Field of Classification Search

CPC ..... H01Q 1/36; H01Q 5/001; H01Q 5/0093; H01Q 1/362; H01Q 9/32; H01Q 5/0051; H01Q 5/0058; H01Q 5/0034

USPC ..... 343/895, 702, 749, 826, 827

See application file for complete search history.

(56) References Cited

U.S. PATENT DOCUMENTS

| | | | | |
|---|---|---|---|---|
| 3,523,251 | A * | 8/1970 | Halstead | 455/282 |
| 4,229,743 | A | 10/1980 | Vo et al. | |
| 5,592,183 | A * | 1/1997 | Henf | 343/749 |
| 5,835,064 | A | 11/1998 | Gomez et al. | |
| 5,995,050 | A | 11/1999 | Moller et al. | |
| 6,334,048 | B1 * | 12/2001 | Edvardsson et al. | 455/575.7 |
| 7,817,103 | B2 * | 10/2010 | Kersten et al. | 343/895 |
| 7,969,379 | B2 | 6/2011 | Knudsen et al. | |
| 8,743,009 | B2 * | 6/2014 | Packer | 343/822 |
| 2004/0189535 | A1 | 9/2004 | Kim | |
| 2005/0243012 | A1 | 11/2005 | Ryou et al. | |

(Continued)

FOREIGN PATENT DOCUMENTS

| | | |
|---|---|---|
| KR | 1020050074380 | 7/2005 |
| WO | WO 98/49747 | 11/1998 |

(Continued)

OTHER PUBLICATIONS

Motorola Solutions Overview; http://www.motorolasolutions.com/US-EN/Business+Product+and+Services/Accessories/ . . . Dec. 20, 2013 1 page.

(Continued)

*Primary Examiner* — Michael C Wimer

(74) *Attorney, Agent, or Firm* — Harness, Dickey & Pierce, PLC

(57) ABSTRACT

Disclosed are exemplary embodiments of multiband antenna assemblies, which generally include helical and linear radiating elements. In an exemplary embodiment, a multiband antenna assembly may generally include at least one helical radiator having a longitudinal axis. At least one linear radiator is aligned with and/or disposed at least partially along the longitudinal axis of the at least one helical radiator. The antenna assembly is resonant in at least three frequency bands.

17 Claims, 43 Drawing Sheets

(56) References Cited

U.S. PATENT DOCUMENTS

| | | | |
|---|---|---|---|
| 2006/0250319 | A1 | 11/2006 | Ooi et al. |
| 2007/0120747 | A1 | 5/2007 | Candal et al. |
| 2009/0219220 | A1 | 9/2009 | Kersten et al. |

FOREIGN PATENT DOCUMENTS

| | | |
|---|---|---|
| WO | WO 2013/028050 | 2/2013 |
| WO | WO 2013/028052 | 2/2013 |

OTHER PUBLICATIONS

International Search Report and Written Opinion issued for PCT/MY2012/000078 filed Apr. 12, 2012 (Published as WO 2013/028052) which is a parent application to the instant application; dated Dec. 6, 2012; 9 pages.

International Search Report issued for PCT/MY2011/000194 filed Aug. 24, 2011; (Published as WO 2013/028050); which is a parent application to the instant application; 3 pages.

* cited by examiner

PERFORMANCE SUMMARY DATA VHF 380/UHF GPS

| FREQUENCY (MHz) | 3D | | AZIMUTH | | ELEVATION 0 | | ELEVATION 90 | | EFFICIENCY | |
|---|---|---|---|---|---|---|---|---|---|---|
| | EFFICIENCY | MAX GAIN | MAX GAIN | AVERAGE GAIN | MAX GAIN | AVERAGE GAIN | MAX GAIN | AVERAGE GAIN | HORIZONTAL | OPEN SKY |
| 400 | 71% | 0.82 | 0.50 | 0.27 | 0.45 | -4.73 | 0.82 | -5.06 | 49% | |
| 415 | 80% | 1.42 | 1.03 | 0.76 | 0.91 | -3.95 | 1.42 | -4.35 | 53% | |
| 430 | 77% | 1.06 | 1.03 | 0.86 | 0.87 | -3.94 | 1.06 | -4.46 | 52% | |
| 450 | 80% | 1.44 | 1.24 | 1.04 | 1.15 | -4.32 | 1.42 | -4.93 | 51% | |
| 470 | 76% | 1.00 | 0.92 | 0.78 | 0.80 | -4.61 | 1.00 | -5.31 | 51% | |
| 512 | 58% | 0.64 | 0.62 | -0.09 | -0.09 | -5.55 | 0.63 | -5.91 | 45% | |
| 527 | 64% | 1.07 | 1.07 | 0.37 | 0.49 | -5.35 | 1.06 | -5.88 | 47% | |
| 1570 | 64% | 2.10 | 0.29 | -1.72 | 1.53 | -2.21 | 1.87 | -4.33 | | 30% |
| 1575 | 64% | 2.10 | 0.17 | -1.89 | 1.55 | -2.03 | 1.86 | -4.31 | | 31% |
| 1580 | 64% | 2.25 | 0.12 | -2.15 | 1.76 | -1.97 | 1.69 | -4.35 | | 31% |

| FREQUENCY (MHz) | VHF AZIMUTH | |
|---|---|---|
| | MAX GAIN | AVG GAIN |
| 136 | -9.67 | -12.08 |
| 147 | -6.55 | -8.89 |
| 155 | -5.53 | -7.72 |
| 163 | -5.42 | -7.26 |
| 174 | -6.41 | -7.80 |

FIG. 11

@155 MHz (HAND HELD)

@400 MHz (FREE SPACE)

@450 MHz (FREE SPACE)

@512 MHz (FREE SPACE)

PERFORMANCE SUMMARY DATA

| BAND | FREQUENCY (MHz) | 3D | | AZIMUTH | | ELEVATION 0 | | ELEVATION 90 | | EFF | EFF |
|---|---|---|---|---|---|---|---|---|---|---|---|
| | | EFFICIENCY | MAX GAIN | MAX GAIN | AVERAGE GAIN | MAX GAIN | AVERAGE GAIN | MAX GAIN | AVERAGE GAIN | HORIZONTAL | OPEN SKY |
| UHF | 400 | 57% | -0.10 | -0.47 | -0.68 | -0.44 | -5.63 | -0.11 | -5.94 | 44% | |
| | 430 | 78% | 1.23 | 1.16 | 1.05 | 1.16 | -4.01 | 1.16 | -4.57 | 53% | |
| | 470 | 76% | 1.03 | 0.95 | 0.78 | 0.97 | -4.64 | 0.87 | -5.22 | 52% | |
| | 512 | 61% | 0.89 | 0.81 | 0.20 | 0.38 | -5.84 | 0.88 | -5.86 | 46% | |
| | 520 | 60% | 1.00 | 0.97 | 0.19 | 0.39 | -5.87 | 0.98 | -6.00 | 46% | |
| 7-800 | 764 | 76% | 3.31 | 2.42 | -0.63 | 2.70 | -4.74 | 3.29 | -5.64 | 42% | |
| | 806 | 70% | 2.78 | 2.22 | -0.44 | 1.89 | -4.56 | 2.76 | -4.61 | 43% | |
| | 830 | 69% | 2.52 | 2.29 | 0.19 | 1.13 | -4.47 | 2.52 | -4.65 | 46% | |
| | 870 | 66% | 2.83 | 2.58 | 1.24 | 1.49 | -4.54 | 2.83 | -5.85 | 49% | |
| GPS | 1575 | 67% | 2.10 | -1.47 | -5.04 | 1.68 | -1.11 | 1.64 | -4.29 | | 36% |

AVERAGE EFFICIENCY
66% (UHF BAND)
70% (7-800 MHz BAND)
67% (GPS BAND)

AVERAGE NEAR HORIZONTAL EFFICIENCY
48% (UHF BAND)
45% (7-800 MHz BAND)
36% (GPS BAND)

OPEN SKY EFFICIENCY

FIG. 27

@ 1575 MHz (FREE SPACE)

@ 1575 MHz (FREE SPACE)

| FREQUENCY (MHz) | HAND HELD | |
|---|---|---|
| | AVG GAIN (dB) | MAX GAIN (dB) |
| 136 | -11.76 | -8.27 |
| 147 | -11.08 | -7.43 |
| 155 | -9.35 | -5.56 |
| 163 | -8.62 | -4.73 |
| 174 | -9.29 | -5.37 |

FREE SPACE

| | 3D | | AZIMUTH | | ELEVATION 0° | | ELEVATION 90° | | PARTIAL EFFICIENCY | |
|---|---|---|---|---|---|---|---|---|---|---|
| FREQUENCY (MHz) | EFFICIENCY | MAX GAIN | MAX GAIN | AVERAGE GAIN | MAX GAIN | AVERAGE GAIN | MAX GAIN | AVERAGE GAIN | NH ± 30° | ZENITH ± 80° |
| 400 | 60% | 0.20 | -0.13 | -0.47 | -0.29 | -3.44 | 0.20 | -3.42 | 44% | |
| 430 | 73% | 0.82 | 0.78 | 0.60 | 0.67 | -2.64 | 0.78 | -2.62 | 50% | |
| 470 | 69% | 0.37 | 0.36 | 0.17 | 0.28 | -2.84 | 0.28 | -2.91 | 49% | |
| 512 | 49% | -0.07 | -0.09 | -0.65 | -0.43 | -4.42 | -0.08 | -4.41 | 41% | |
| 520 | 48% | 0.04 | 0.04 | -0.74 | -0.52 | -4.58 | 0.04 | -4.47 | 41% | |
| 764 | 69% | 3.05 | 0.83 | -1.79 | 2.74 | -2.19 | 2.92 | -2.57 | 39% | |
| 806 | 66% | 2.71 | 0.79 | -2.28 | 2.44 | -2.44 | 2.60 | -2.66 | 36% | |
| 830 | 57% | 2.27 | -0.16 | -3.55 | 1.68 | -3.05 | 2.16 | -3.22 | 34% | |
| 870 | 33% | 0.12 | -1.76 | -4.15 | -0.57 | -5.77 | -0.11 | -5.72 | 30% | |
| 1575 | 57% | 1.79 | -0.29 | -2.44 | 0.06 | -1.50 | 1.77 | -3.60 | | 29% |

AVERAGE EFFICIENCY 60% (UHF BAND)
56% (7/800MHz BAND)
57% (GPS BAND)

PARTIAL EFFICIENCY 45% (UHF BAND)
35% (7/800MHz BAND)
29% (GPS BAND)

HAND HELD

| | 3D | | AZIMUTH | | ELEVATION 0° | | ELEVATION 90° | | PARTIAL EFFICIENCY | |
|---|---|---|---|---|---|---|---|---|---|---|
| FREQUENCY (MHz) | EFFICIENCY | MAX GAIN | MAX GAIN | AVERAGE GAIN | MAX GAIN | AVERAGE GAIN | MAX GAIN | AVERAGE GAIN | NH ± 30° | ZENITH ± 80° |
| 400 | 35% | 1.52 | 0.55 | -3.09 | 0.10 | -5.61 | -0.89 | -5.62 | 31% | |
| 430 | 41% | 2.37 | 0.87 | -2.29 | 0.51 | -5.41 | 0.15 | -4.52 | 35% | |
| 470 | 36% | 0.93 | -0.79 | -2.93 | -0.44 | -5.96 | -0.63 | -4.79 | 32% | |
| 512 | 29% | 0.26 | 0.18 | -3.72 | -1.46 | -6.85 | -0.62 | -5.49 | 28% | |
| 520 | 29% | 0.37 | 0.32 | -3.84 | -1.46 | -6.97 | -0.47 | -5.51 | 28% | |
| 764 | 39% | 3.06 | 0.84 | -3.60 | 0.69 | -5.46 | 2.11 | -4.45 | 30% | |
| 806 | 42% | 2.98 | 0.87 | -3.41 | 0.73 | -5.02 | 2.18 | -4.12 | 31% | |
| 830 | 40% | 2.76 | 0.27 | -3.73 | 0.55 | -5.17 | 2.04 | -4.34 | 30% | |
| 870 | 29% | 1.63 | -1.22 | -4.41 | -1.14 | -6.48 | 1.11 | -6.05 | 27% | |
| 1575 | 44% | 2.54 | -0.44 | -3.75 | -0.37 | -4.22 | 1.38 | -3.44 | | 26% |

AVERAGE EFFICIENCY 34% (UHF BAND)
37% (7/800MHz BAND)
44% (GPS BAND)

PARTIAL EFFICIENCY 31% (UHF BAND)
30% (7/800MHz BAND)
26% (GPS BAND)

FIG. 39

VHF BAND@155MHz (HAND HELD)

---- FREESPACE —— HANDHELD

UHF BAND @ 470MHz

---- FREESPACE —— HANDHELD 7-800MHz BAND @ 806MHz

---- FREESPACE —— HANDHELD

GPS BAND @ 1575MHz

PERFORMANCE SUMMARY DATA AZIMUTH PLANE-VHF BAND

| FREQUENCY (MHz) | HAND HELD | |
|---|---|---|
| | MAX GAIN | AVG. GAIN |
| 136 | -4.70 | -9.64 |
| 147 | -5.32 | -9.86 |
| 155 | -4.01 | -8.53 |
| 163 | -2.94 | -7.62 |
| 174 | -4.11 | -8.25 |

PERFORMANCE SUMMARY DATA VHF/UHF/7-800/GPS

| | 3D | | AZIMUTH | | ELEVATION 0° | | ELEVATION 90° | | EFFICIENCY | |
|---|---|---|---|---|---|---|---|---|---|---|
| FREQUENCY (MHz) | EFFICIENCY | MAX GAIN | MAX GAIN | AVERAGE GAIN | MAX GAIN | AVERAGE GAIN | MAX GAIN | AVERAGE GAIN | NEAR HORIZONTAL | OPEN SKY |
| 400 | 47% | -0.99 | -1.16 | -1.47 | -1.31 | -5.44 | -0.99 | -4.47 | 40% | |
| 430 | 71% | 0.78 | 0.73 | 0.59 | 0.61 | -3.06 | 0.72 | -2.71 | 51% | |
| 470 | 71% | 0.80 | 0.54 | 0.31 | 0.36 | -3.14 | 0.46 | -2.78 | 50% | |
| 512 | 54% | 0.25 | 0.20 | -0.32 | -0.14 | -4.62 | 0.24 | -3.92 | 43% | |
| 520 | 53% | 0.21 | 0.21 | -0.41 | -0.26 | -4.71 | 0.20 | -4.01 | 43% | |
| 764 | 58% | 2.03 | 1.09 | -1.23 | 1.50 | -3.42 | 2.01 | -3.35 | 37% | |
| 806 | 56% | 1.94 | 1.28 | -1.17 | 1.06 | -3.99 | 1.92 | -3.52 | 36% | |
| 830 | 47% | 1.19 | 1.14 | -0.75 | -0.03 | -4.83 | 1.19 | -4.49 | 37% | |
| 870 | 54% | 1.74 | -0.11 | -3.59 | 1.30 | -3.49 | 1.62 | -3.30 | 39% | |
| 1575 | 70% | 3.26 | -1.25 | -3.39 | 2.84 | -1.34 | 2.69 | -2.31 | | 37% |

AVERAGE EFFICIENCY 59% (UHF BAND)
54% (7800 BAND)
70% (GPS BAND)

NEAR HORIZONTAL EFF. 45% (UHF BAND)
35% (7800 BAND)

OPEN SKY EFF. 37% (GPS BAND)

FIG. 53

MULTIBAND ANTENNA ASSEMBLIES INCLUDING HELICAL AND LINEAR RADIATING ELEMENTS

CROSS-REFERENCE TO RELATED APPLICATIONS

This application is a continuation of PCT International Application No. PCT/MY2012/000078 filed Apr. 12, 2012, which, in turn, claims the benefit and priority of International Application No. PCT/MY2011/000194 filed Aug. 24, 2011. The entire disclosures of the above applications are incorporated herein by reference.

FIELD

The present disclosure generally relates to multiband antenna assemblies including helical and linear radiating elements.

BACKGROUND

This section provides background information related to the present disclosure which is not necessarily prior art.

The users of portable wireless devices are putting increasing demands to provide more functionality in smaller and smaller portable wireless devices without degrading reception or connectivity. Thus, although the space available in a wireless device for an antenna continually decreases, the performance needs of the antenna continually increase. Moreover, many wireless devices today require the ability to operate over multiple frequency ranges that frequently require the use of multiple antennas to cover the functionality of the device, exasperating the problem.

SUMMARY

This section provides a general summary of the disclosure, and is not a comprehensive disclosure of its full scope or all of its features.

According to various aspects, exemplary embodiments are disclosed of antenna assemblies that include helical and linear radiating elements. For example, an exemplary embodiment of a multiband antenna assembly may generally include at least one helical radiator having a longitudinal axis. At least one linear radiator is aligned with and/or disposed at least partially along the longitudinal axis of the at least one helical radiator. The antenna assembly is resonant in at least three frequency bands.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
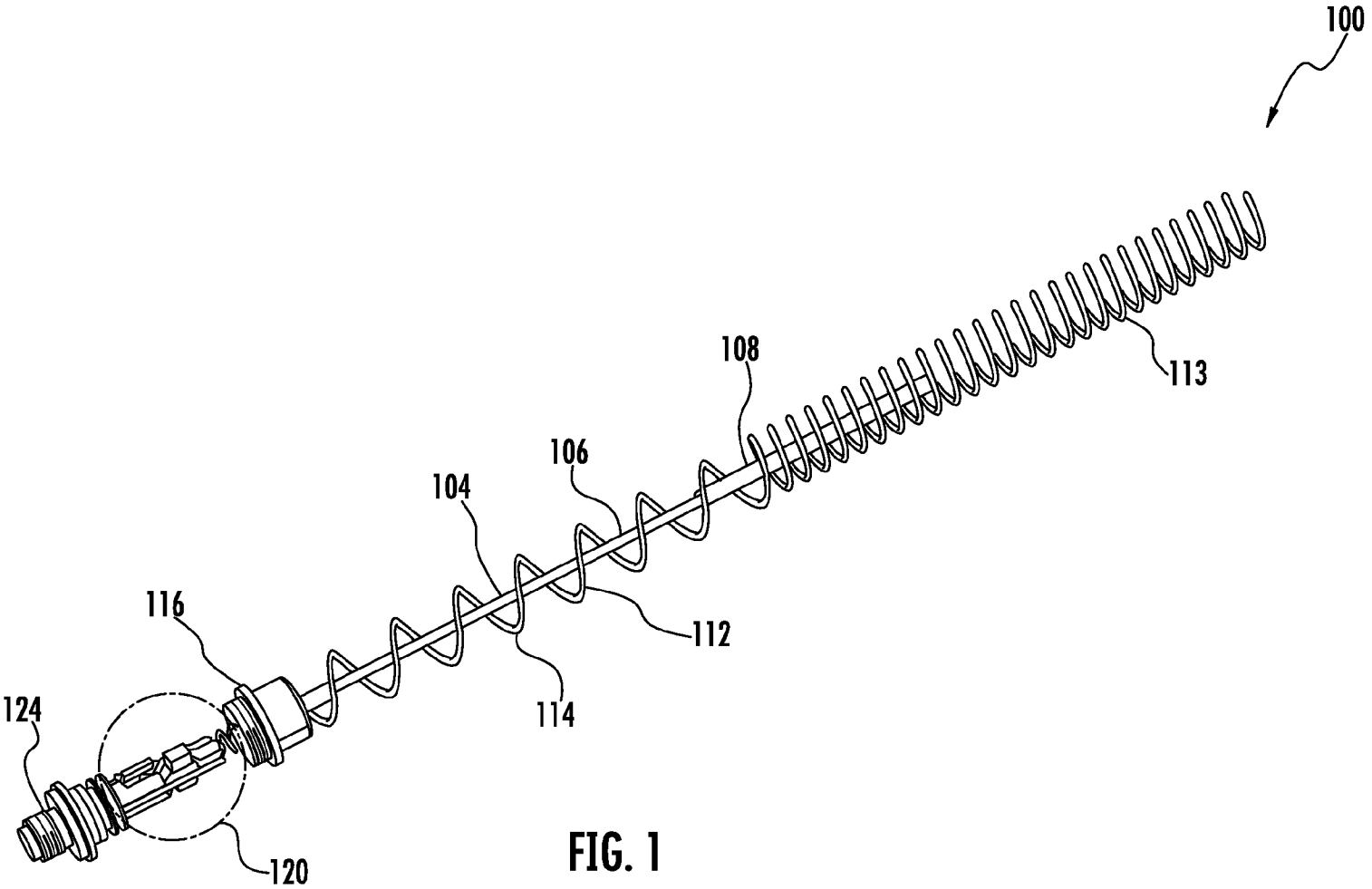
FIG. 1 is a perspective view of an exemplary embodiment of a multiband antenna assembly including helical and top loaded linear radiating elements and a matching network.
Figure 3A:
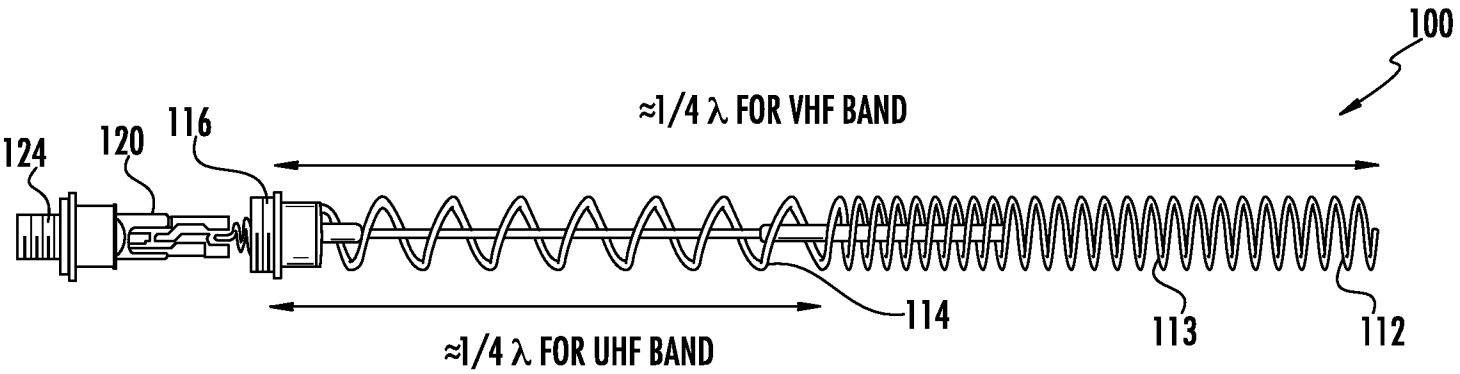
FIG. 3A illustrates the antenna assembly shown in FIG. 1, and also illustrating the A/4 electrical length of the dual pitch helical radiator for the VHF band and the A/4 electrical length of the wider pitch, lower portion of the helical radiator for the UHF band, where these electrical lengths and frequencies are provided for purposes of illustration only according to exemplary embodiments.
Figure 3B:
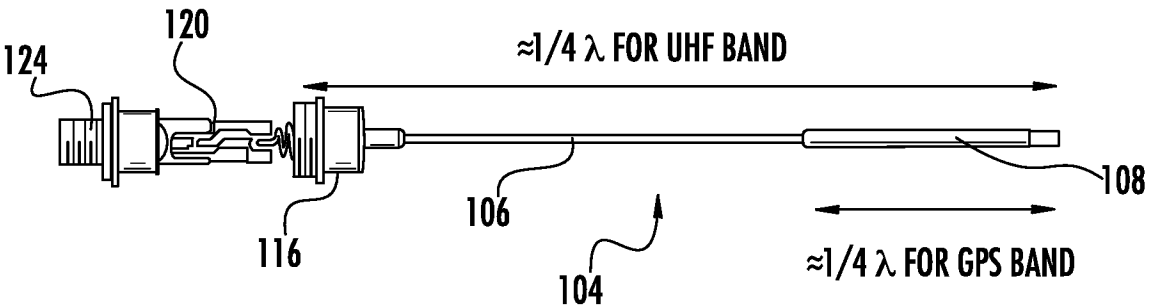
Figure 4:
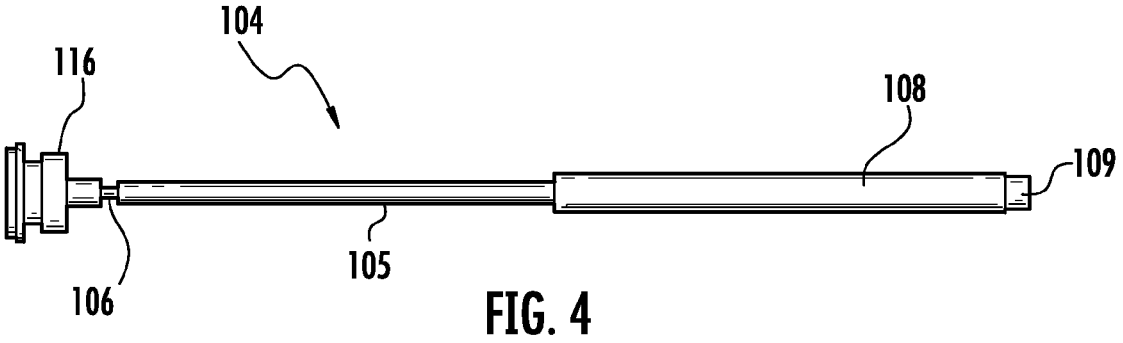
Figure 5:
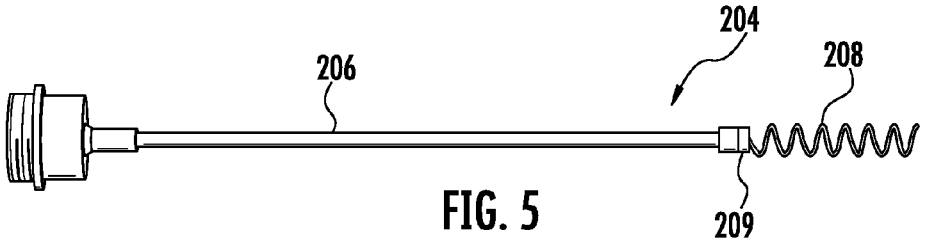
Figure 6:
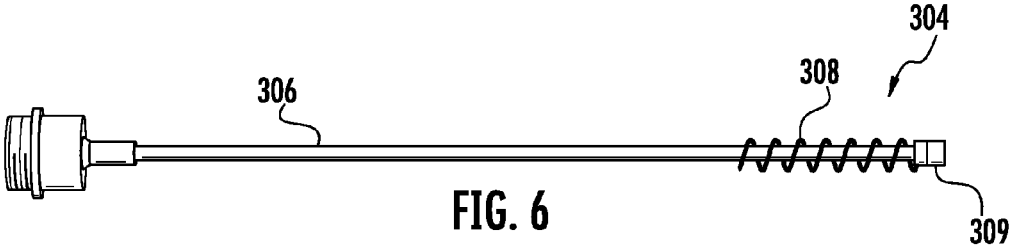
Figure 7:
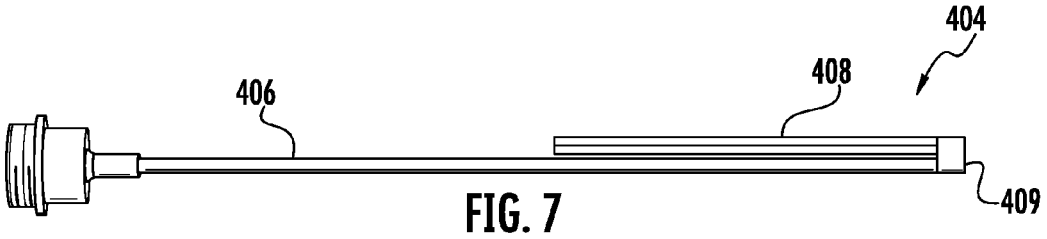
Figure 8A:
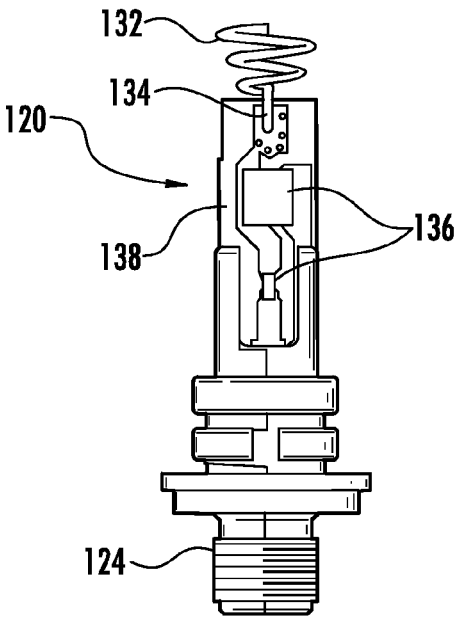
Figure 8B:
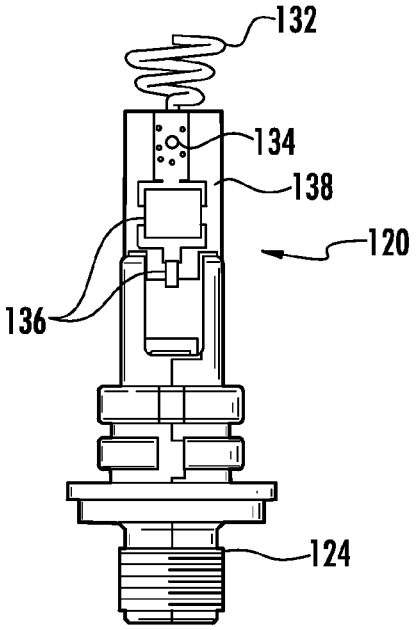
Figure 9:
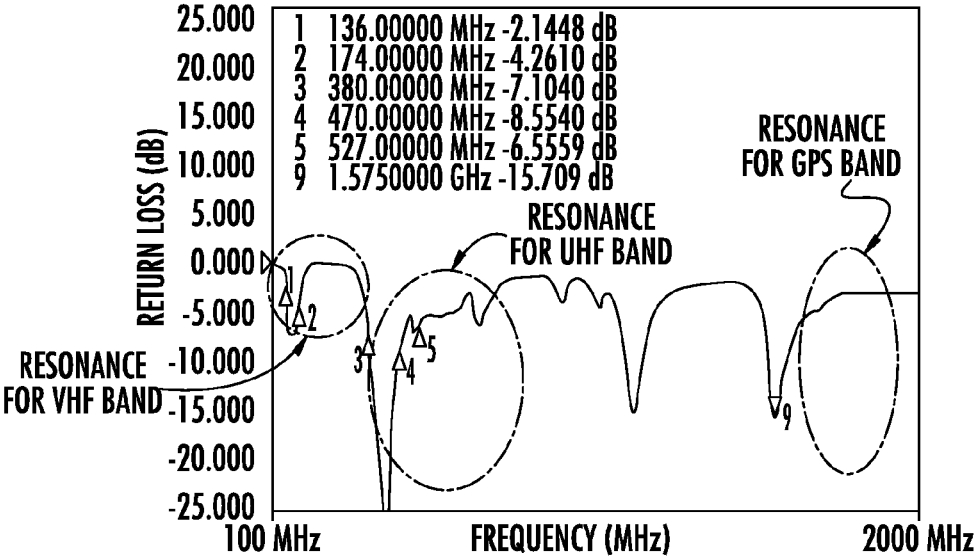
Figure 10:
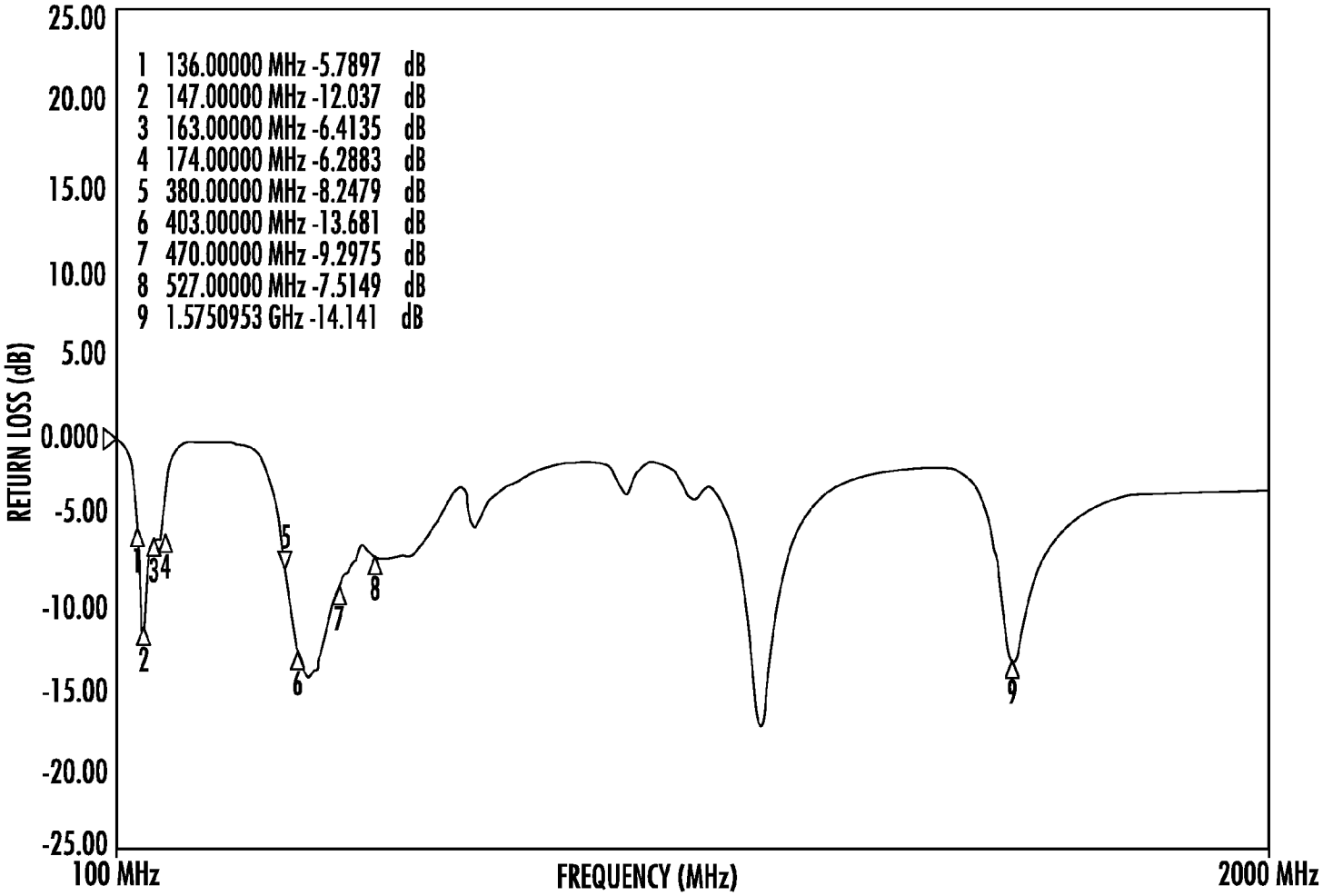
Figure 16:
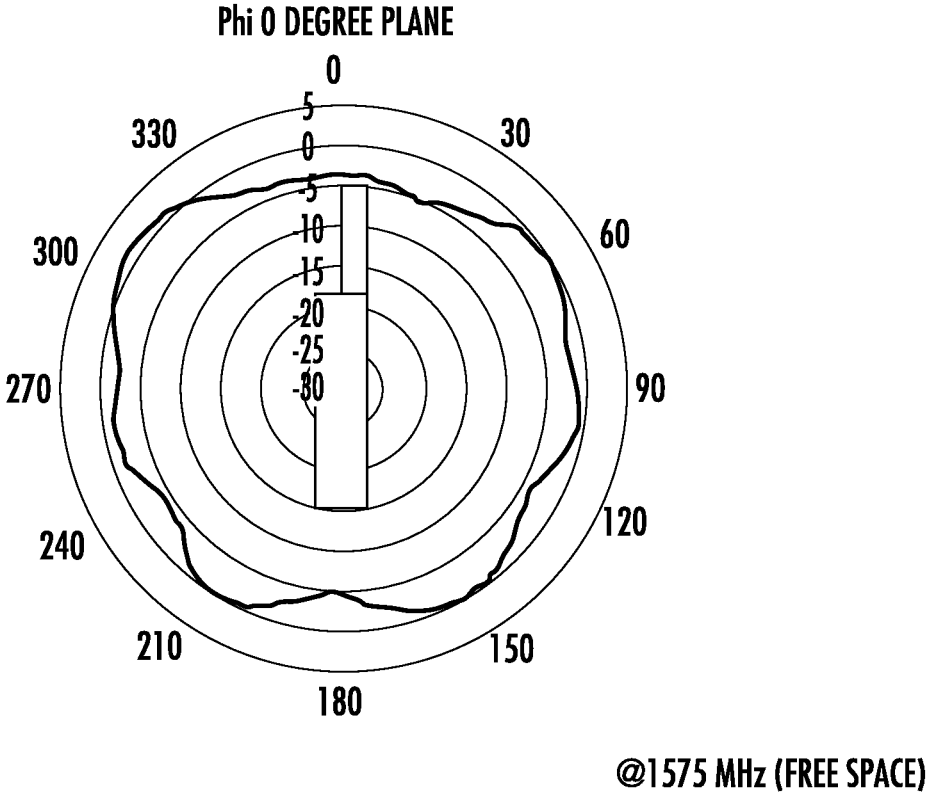
Figure 17:
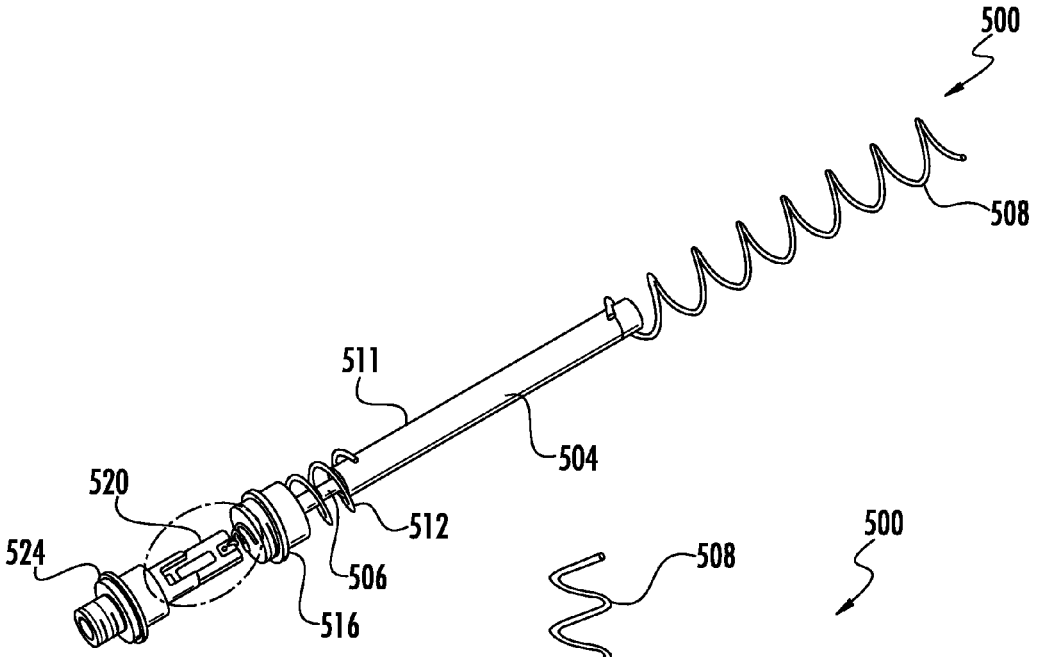
Figure 18:
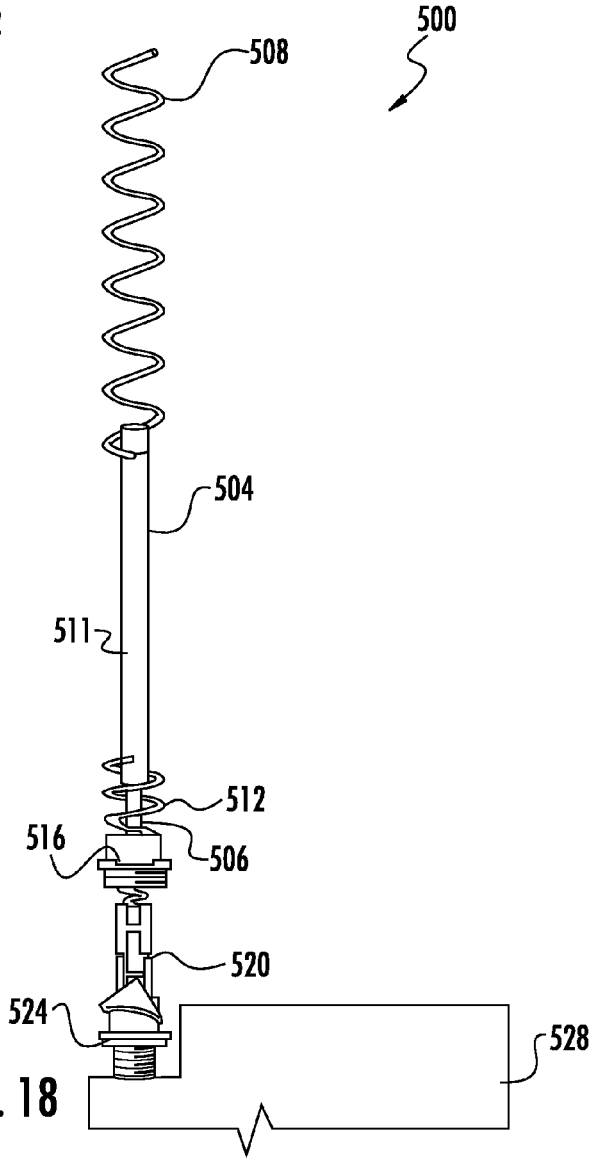
Figure 19:
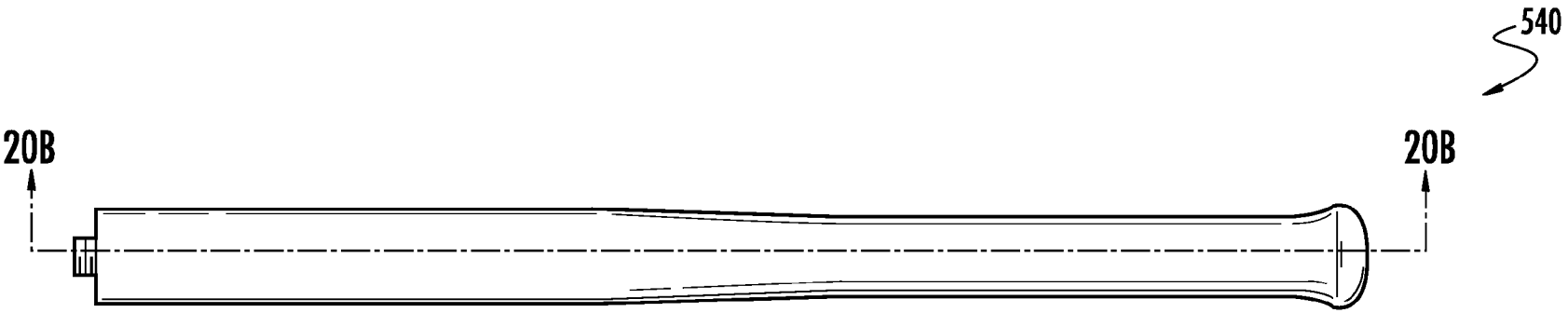
Figure 20A:
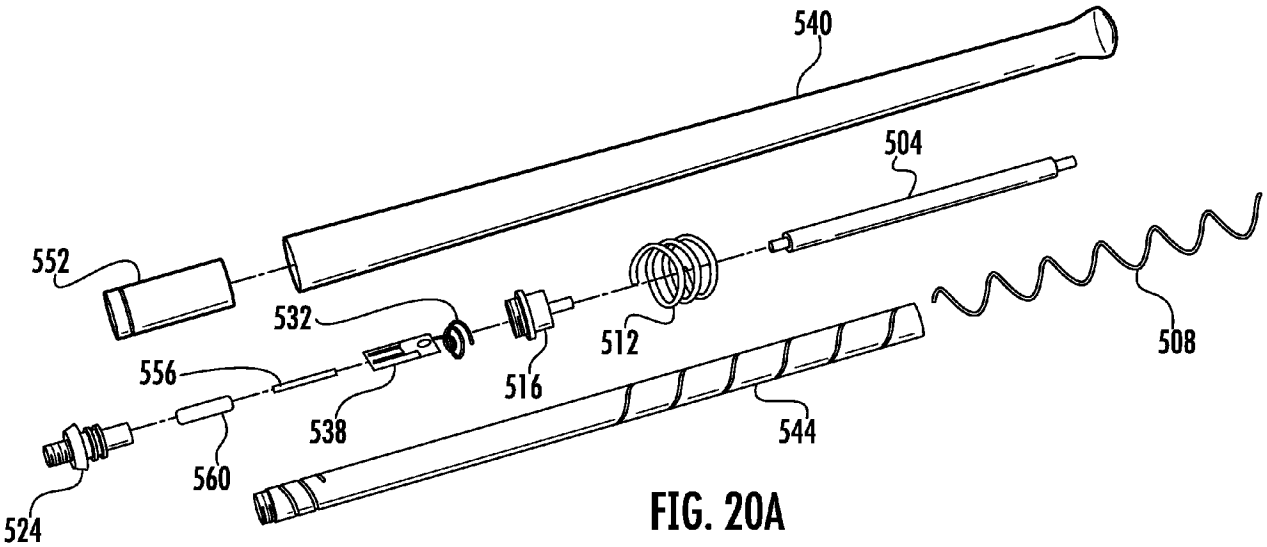
Figure 20B:
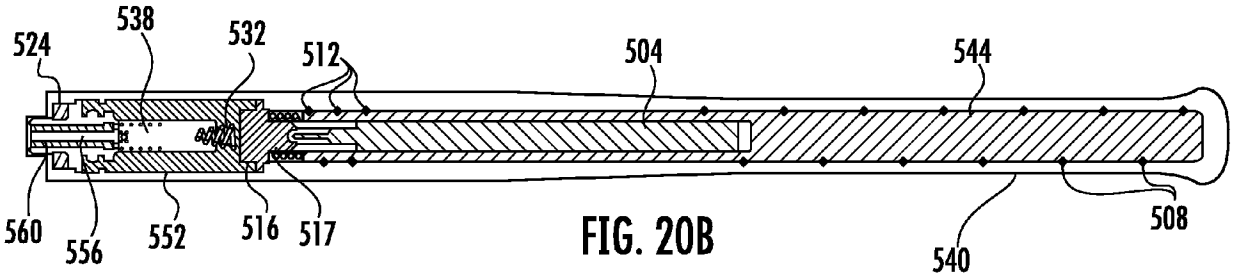
Figure 21A:
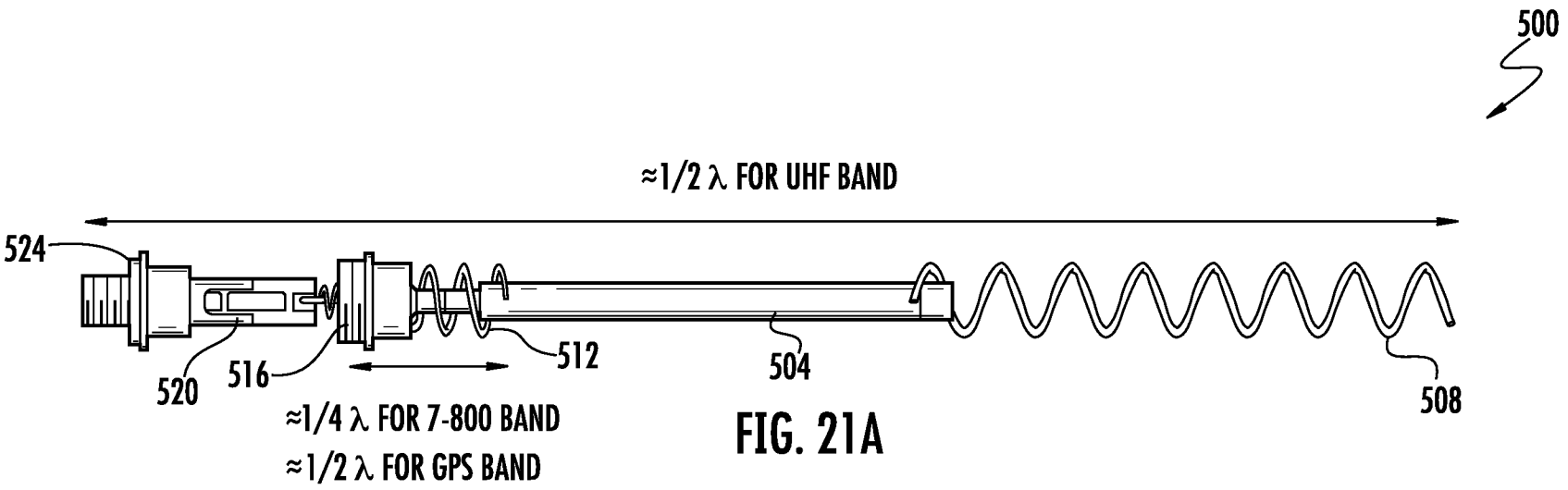
Figure 21B:
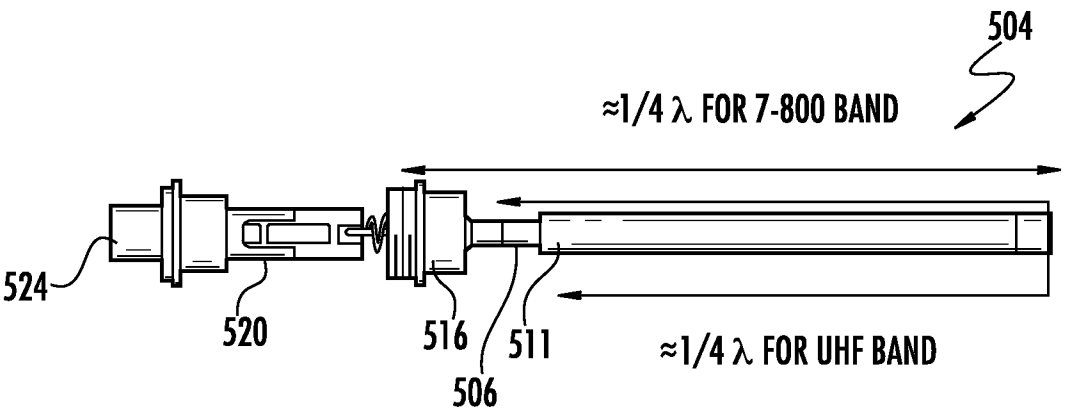
Figure 22:
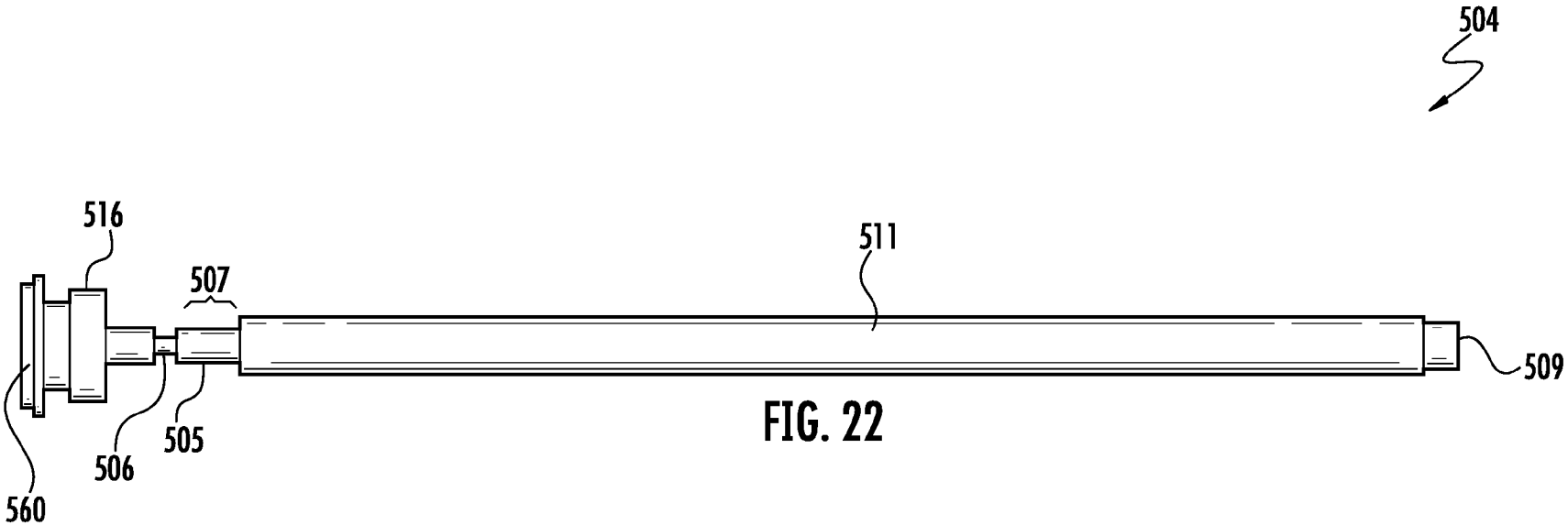
Figure 23A:
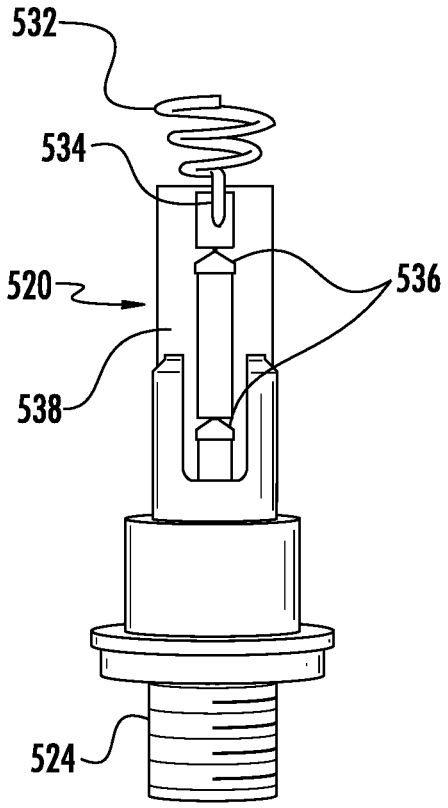
Figure 23B:
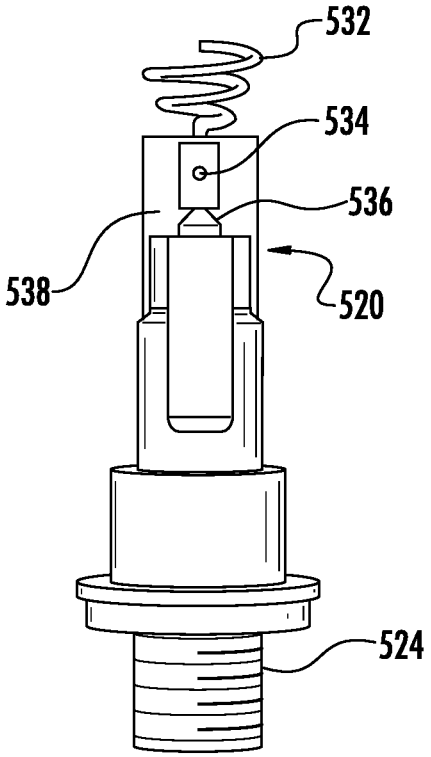
Figure 24:
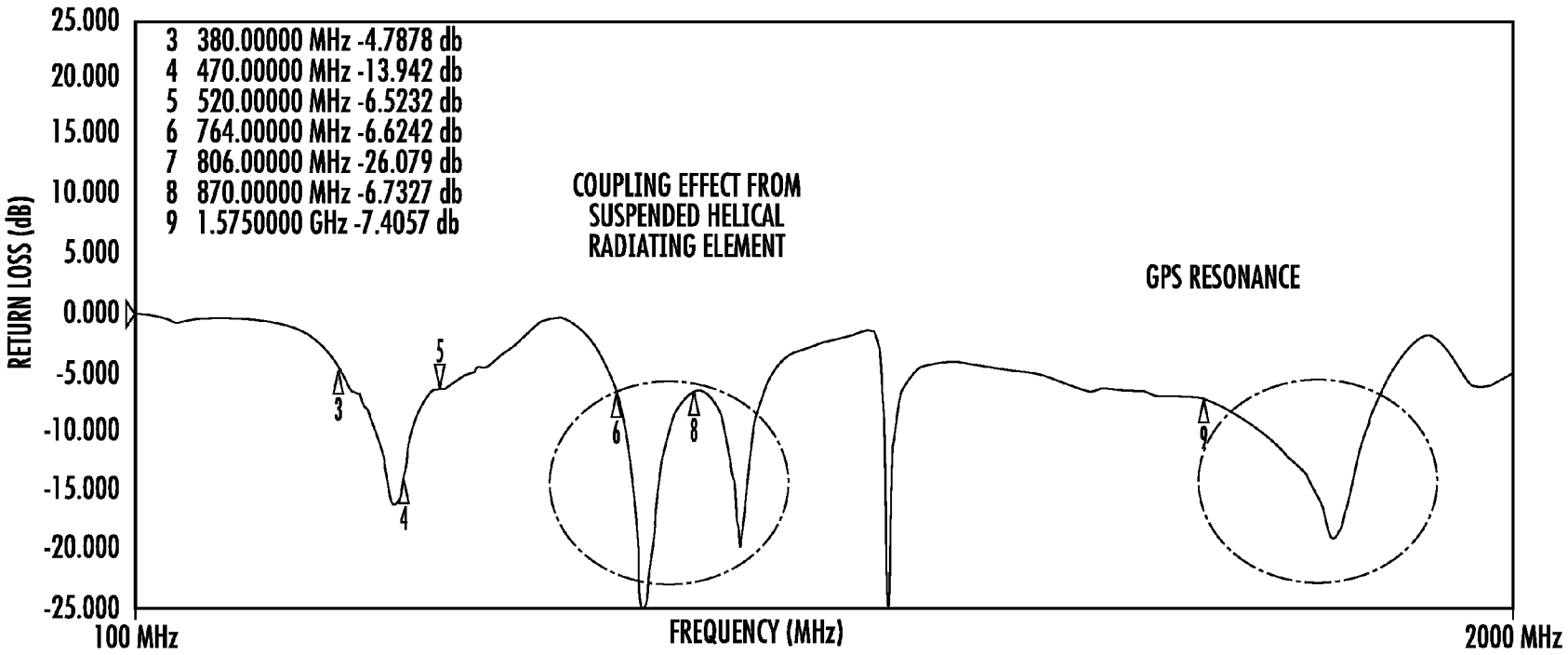
Figure 25:
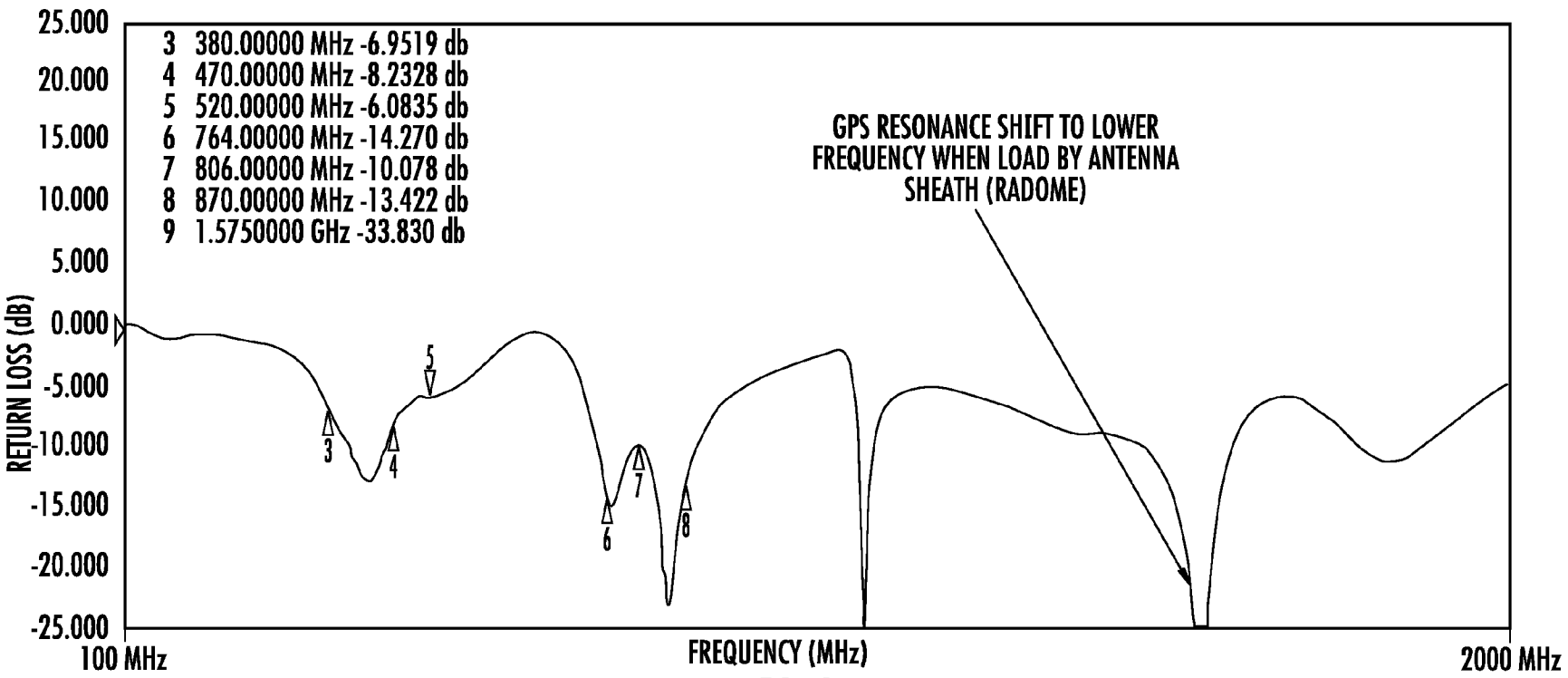
Figure 26:
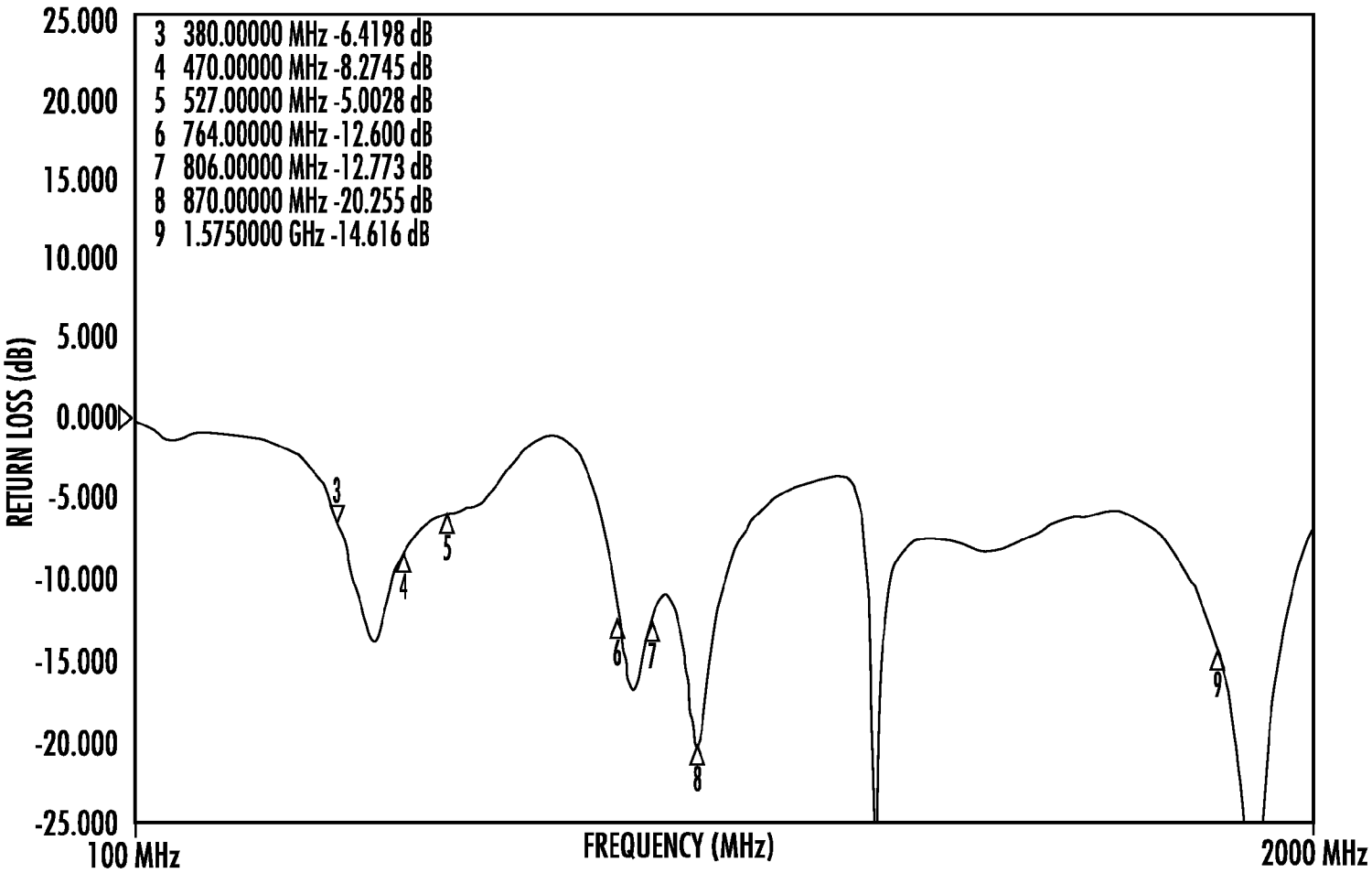
Figure 34:
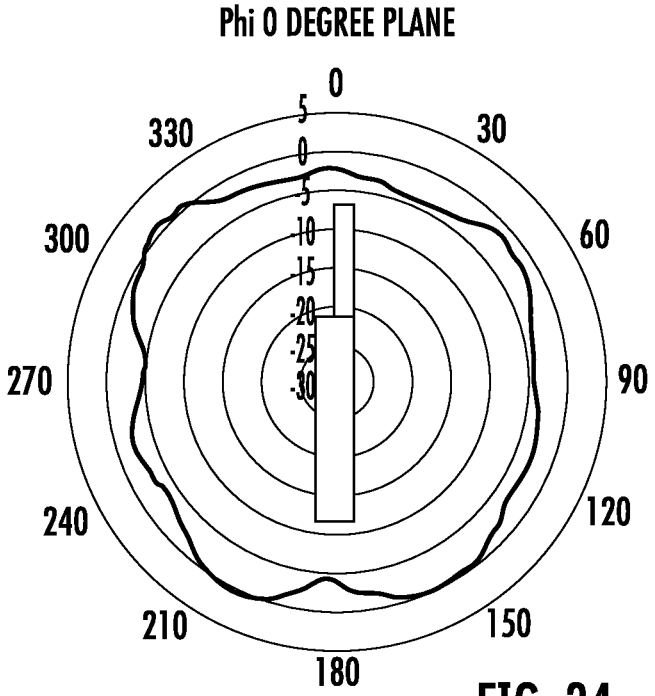
Figure 35:
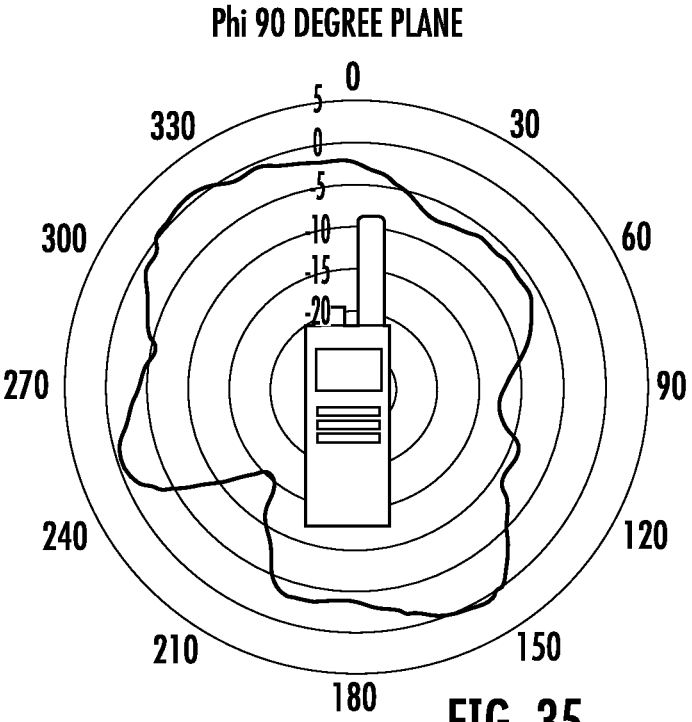
Figure 36A:
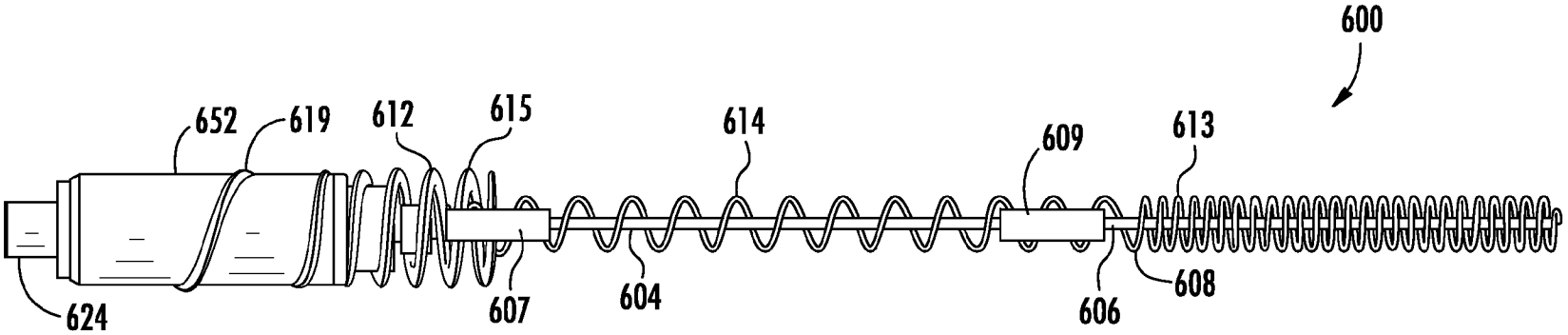
Figure 36B:
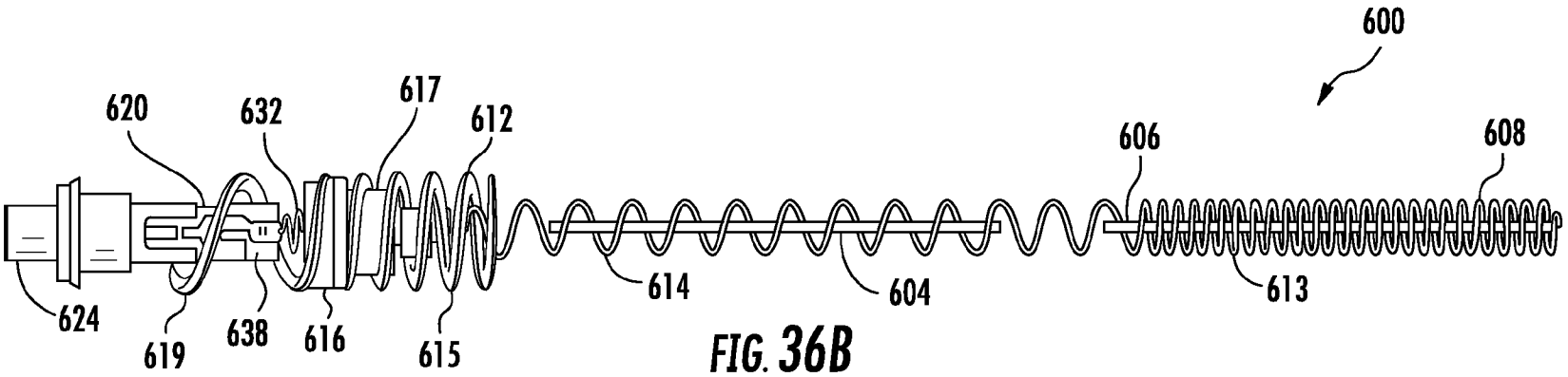
Figure 37A:
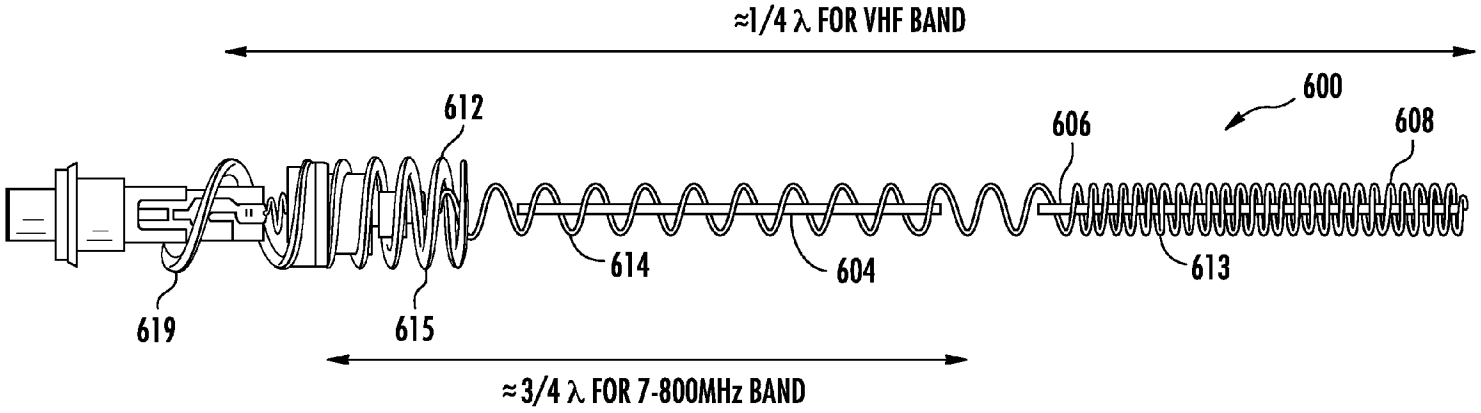
Figure 37B:
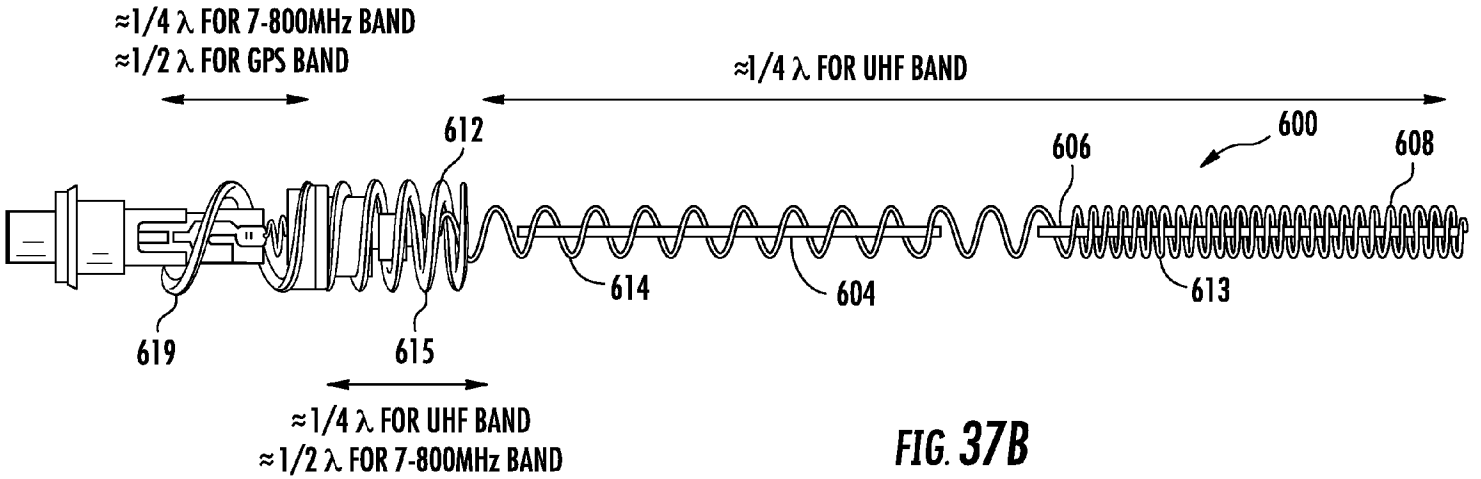
Figure 38:
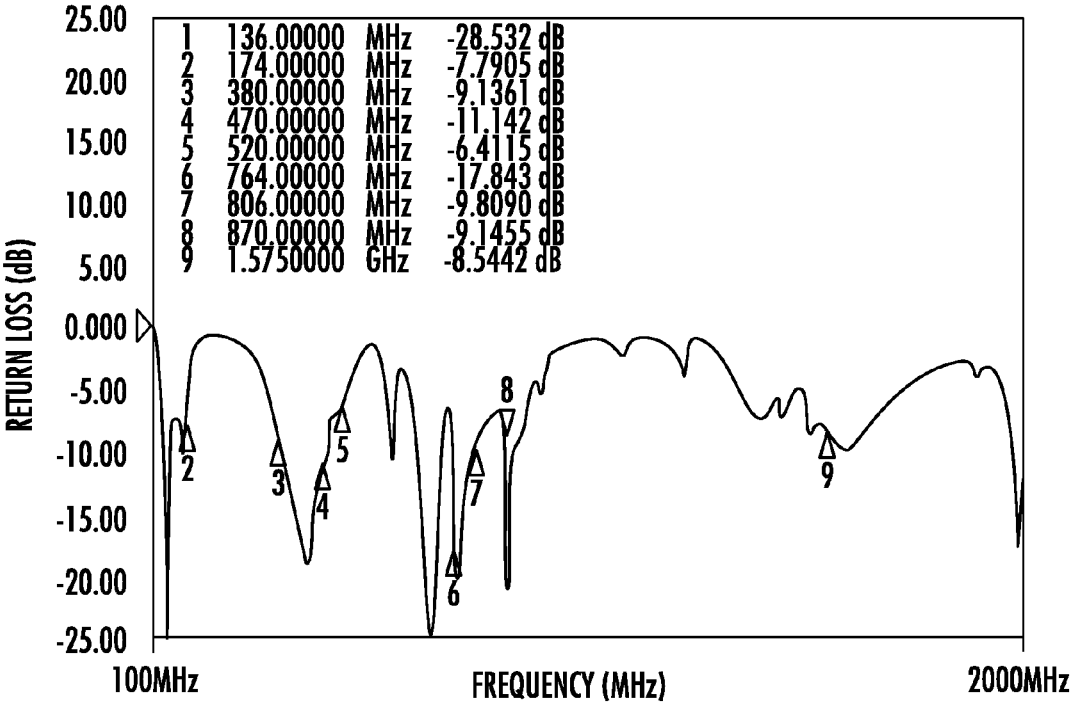
Figure 40:
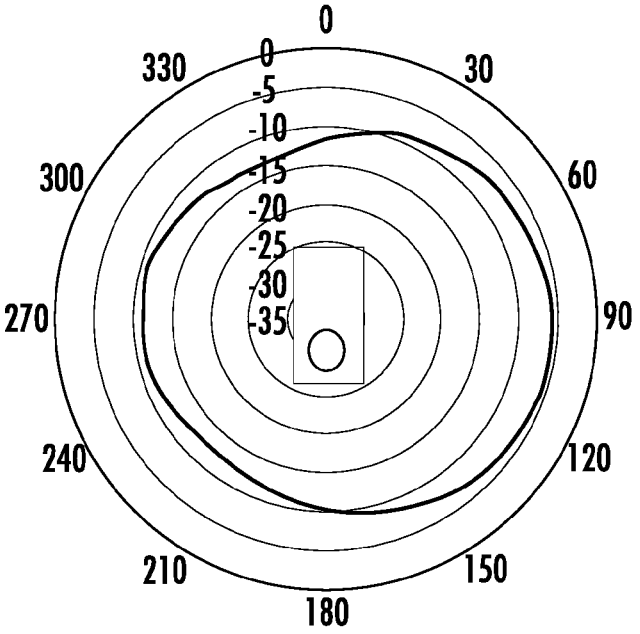
Figure 41:
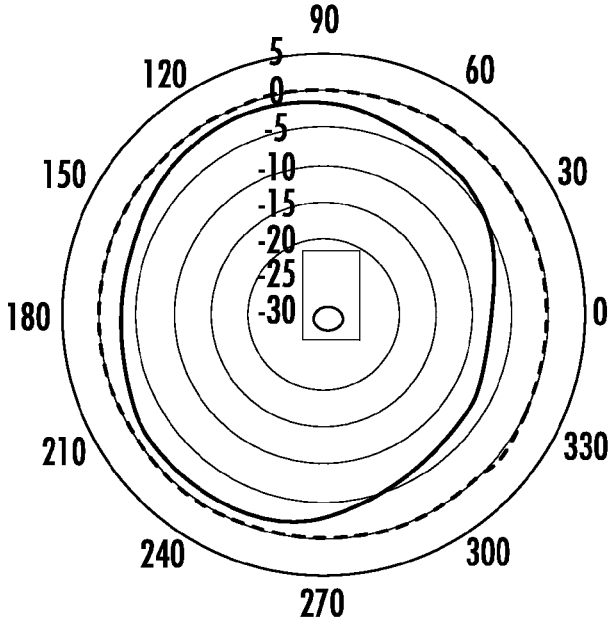
Figure 42:
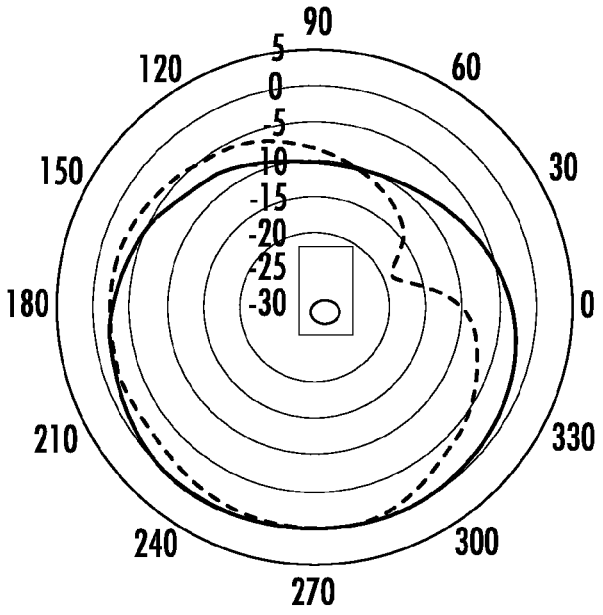
Figure 43:
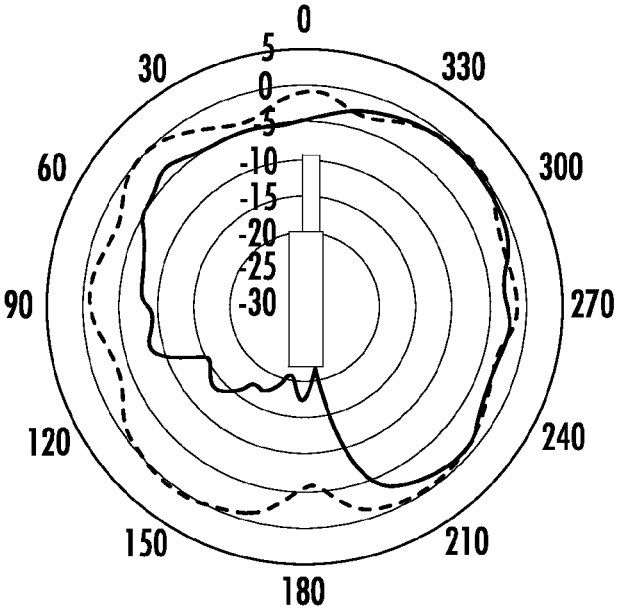
Figure 44:
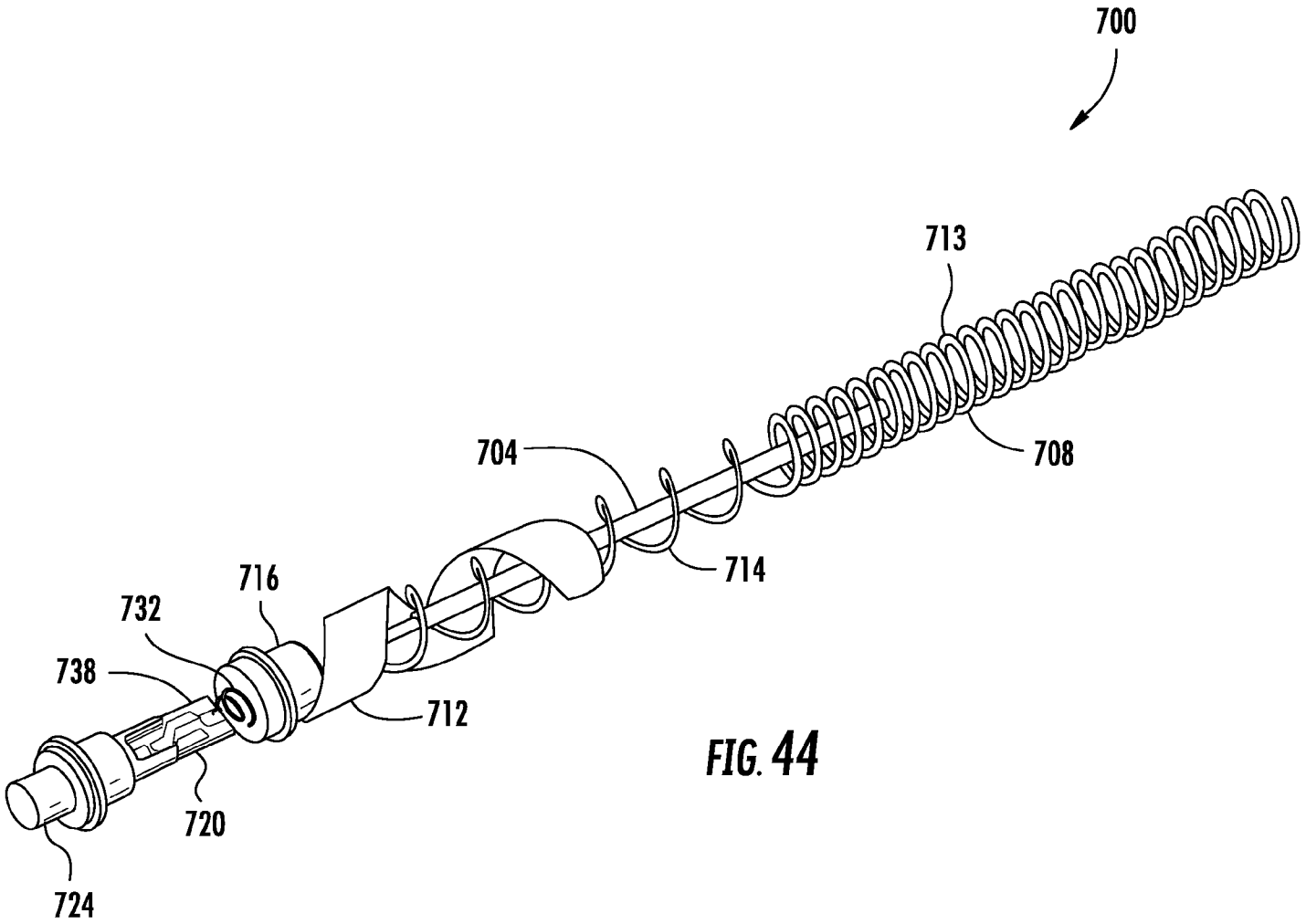
Figure 45:
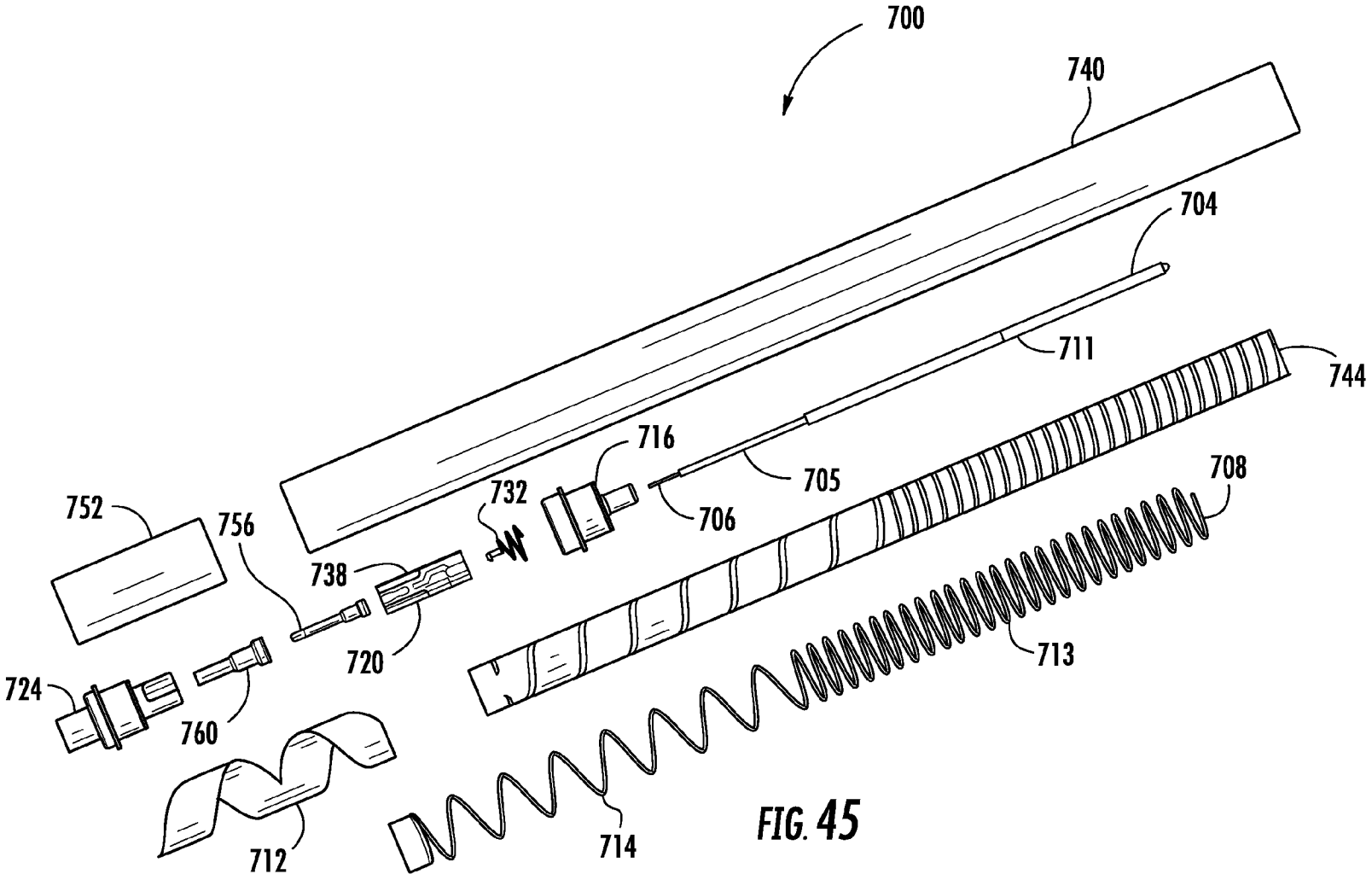
Figure 46A:
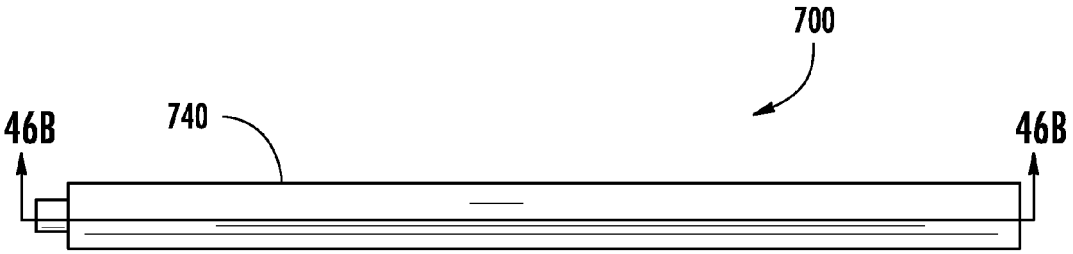
Figure 46B:
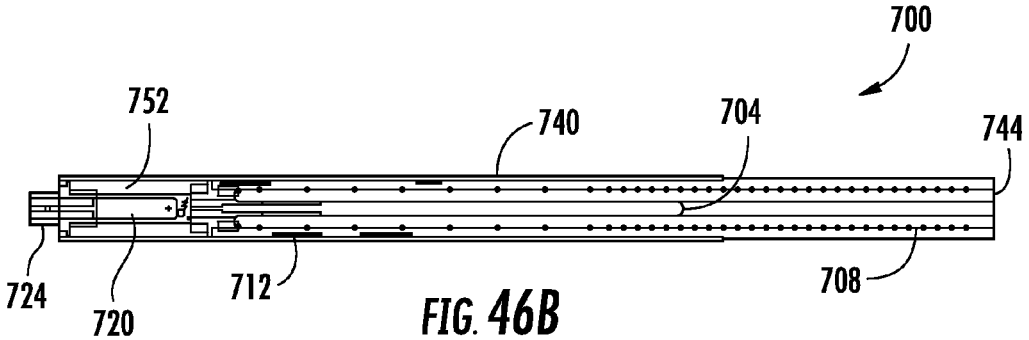
Figure 48:
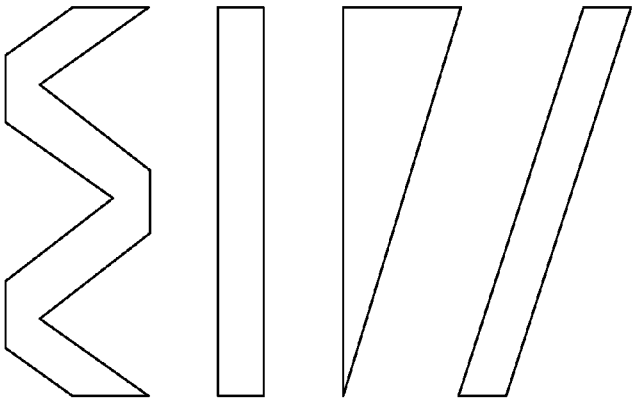
Figure 47A:
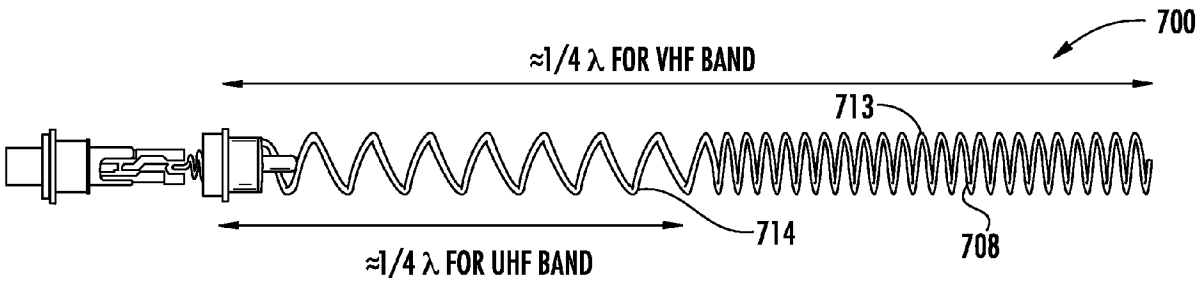
Figure 47B:
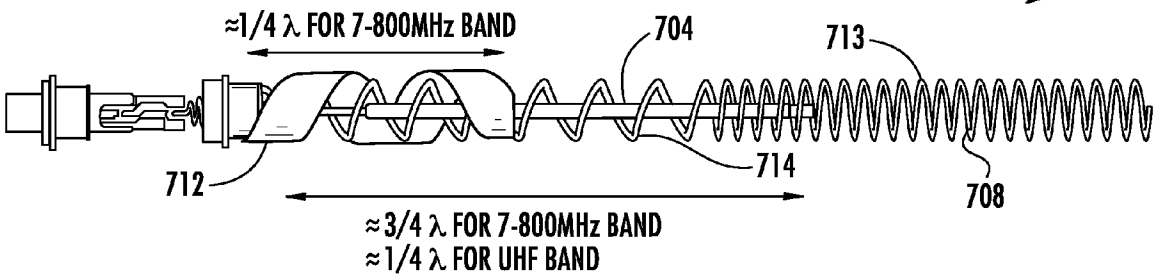
Figure 47C:
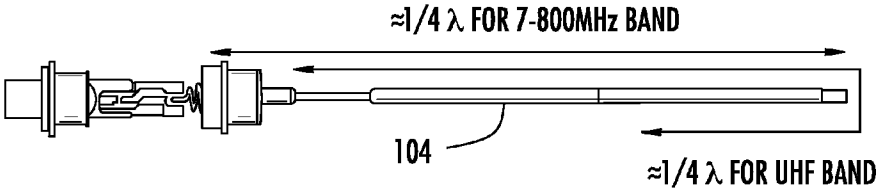
Figure 49:
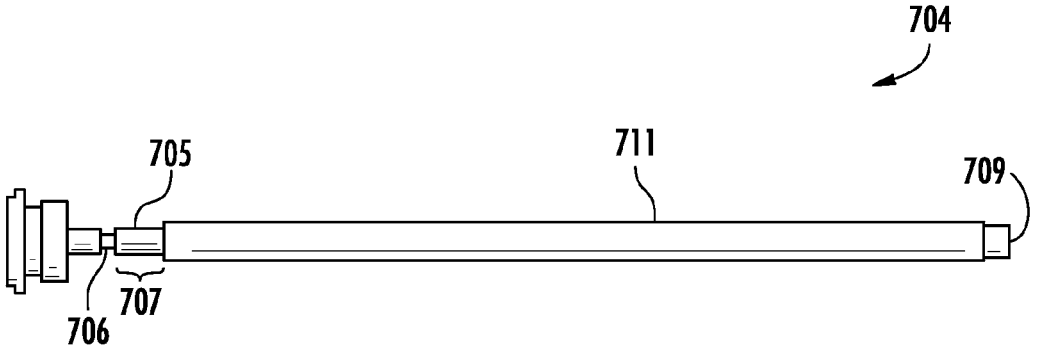
Figure 50:
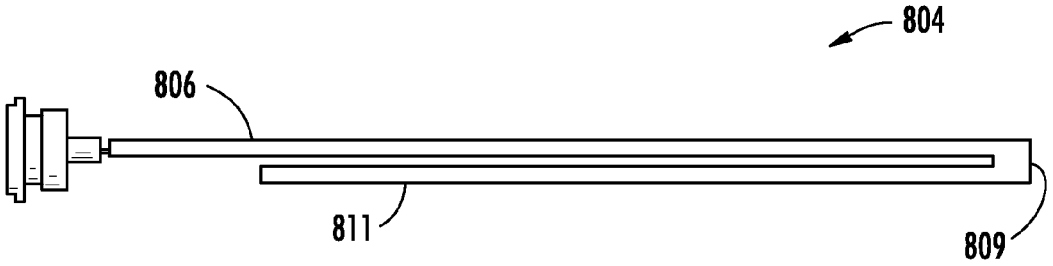
Figure 51:
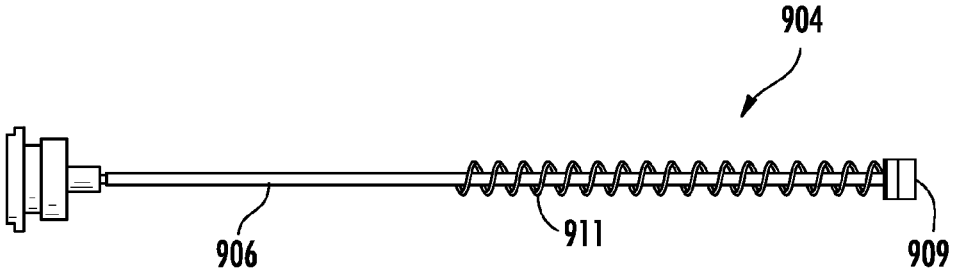
Figure 52:
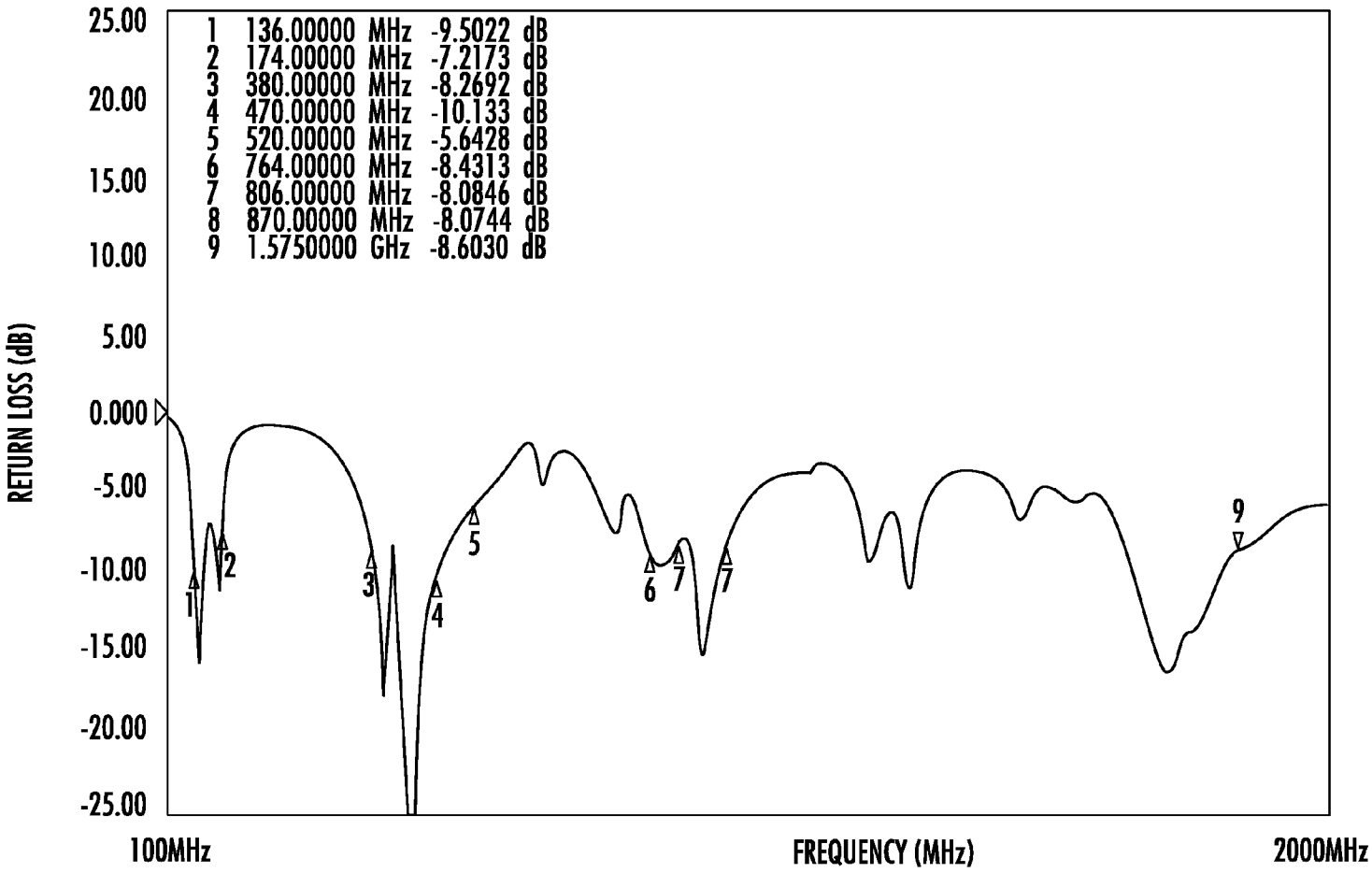
Figure 59:
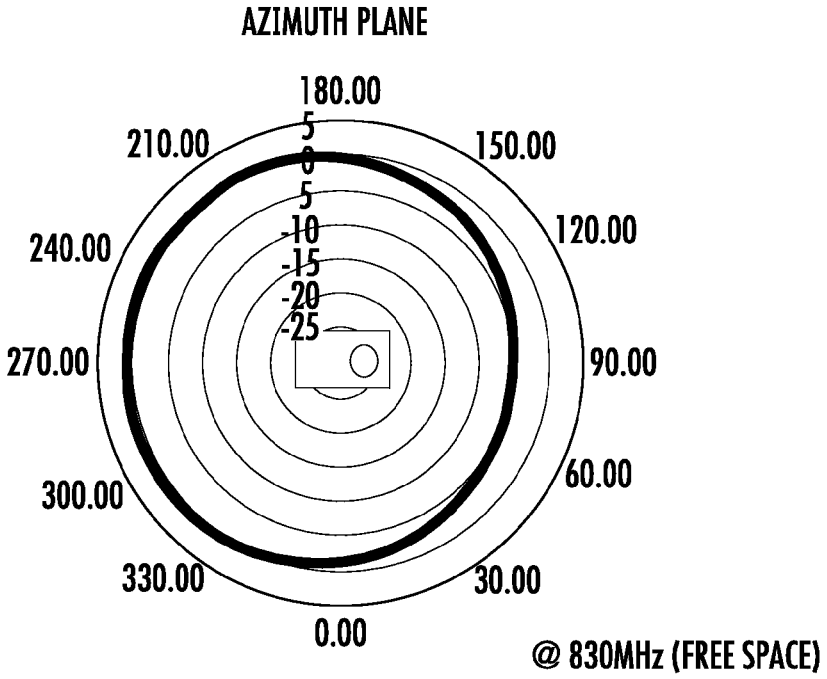
Figure 60:
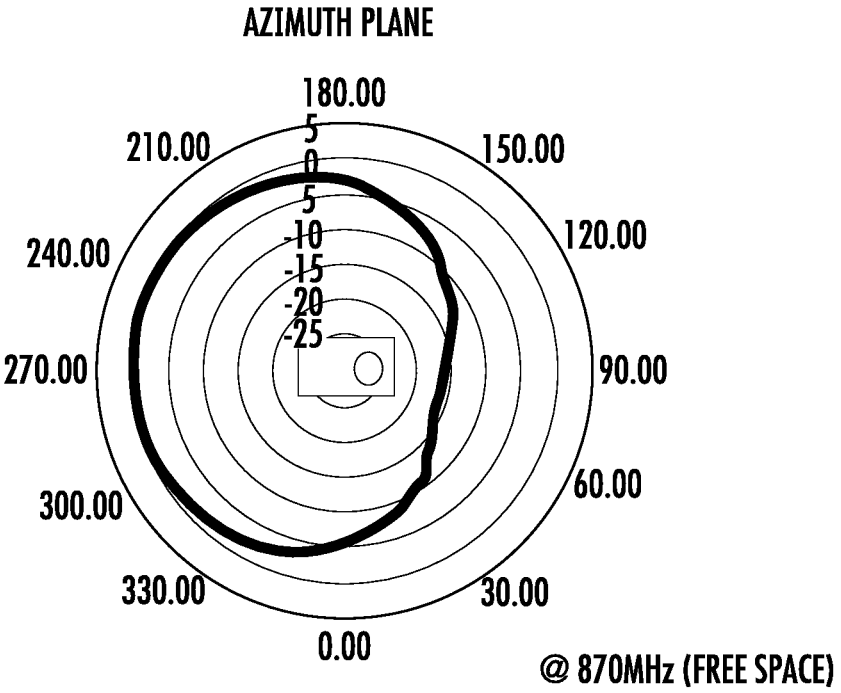
Figure 61:
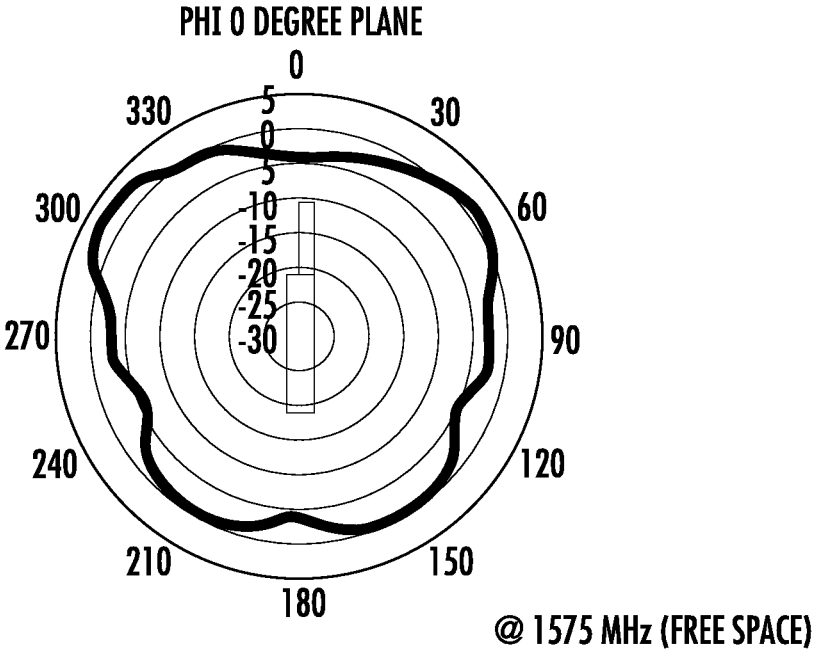
Figure 62:
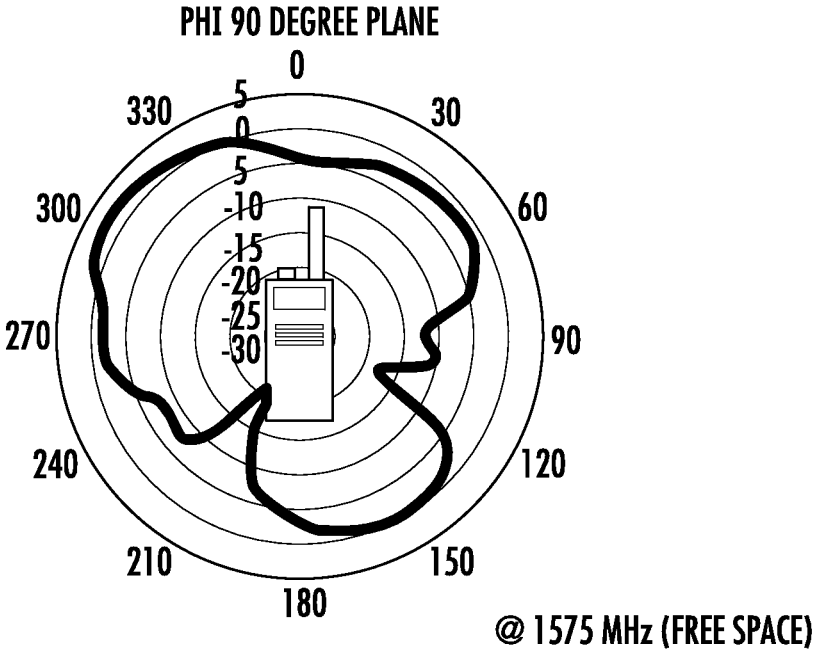

FIG. 3B illustrates the antenna assembly shown in FIG. 1, where the helical radiator is not shown to better illustrate the λ/4 electrical length of the linear radiator's inner, center conductor for the UHF band and the λ/4 electrical length of the linear radiator's top loaded conductor for the GPS band, where these electrical lengths and frequencies are provided for purposes of illustration only according to exemplary embodiments;

FIG. 4 illustrates an example of a linear radiator that may be used in the antenna assembly shown in FIG. 1, where the helical radiator is not shown to better illustrate the linear radiator's inner, center electrically conducting member and top loaded conductor, which are configured as radiating elements for respective low band operation and high band operation according to this example embodiment;

FIGS. 5 through 7 illustrate further examples of a linear radiator that may be used in the antenna assembly shown in FIG. 1, where the helical radiator is not shown to better illustrate the linear radiator's inner, center electrically conducting member and top loaded conductor according to alternative example embodiments;

FIGS. 8A and 8B illustrate an example matching network topology of a printed circuit board assembly with lumped components of the antenna assembly shown in FIG. 1 according to an exemplary embodiment;

FIG. 9 is an exemplary line graph illustrating return loss in decibels (dB) versus frequency in megahertz (MHz) measured for the antenna assembly shown in FIG. 1 and illustrating the antenna's resonance for the VHF, UHF, and GPS bands when the antenna assembly was measured in free space condition;

FIG. 10 is another exemplary line graph illustrating return loss in decibels versus frequency in megahertz (MHz) measured for the antenna assembly shown in FIG. 1 in a hand held position;

FIG. 11 is a table with performance summary data of measured efficiency and gain performance of the antenna assembly shown in FIG. 1 for the VHF band (in a hand held position) and for the UHF and GPS bands (in free space);

FIGS. 12 through 15 illustrate radiation patterns (azimuth plane) measured for the antenna assembly shown in FIG. 1 in a hand held position at a frequency of 155 MHz and in free space at frequencies of 400 MHz, 450 MHz, 512 MHz, and 1574 MHz, respectively;

FIG. 16 illustrates a radiation pattern (phi zero degree plane) measured for the antenna assembly shown in FIG. 1 in free space at a frequency of 1575 MHz;

FIG. 17 is a perspective view of another exemplary embodiment of a multiband antenna assembly including helical and top loaded linear radiating elements and a matching network, where the linear radiating element is between a bottom helical radiating element and a top suspended helical radiating element;

FIG. 18 is a perspective view illustrating the exemplary manner by which the antenna assembly shown in FIG. 17 may be externally mounted to a wireless device housing according to an exemplary embodiment;

FIG. 19 illustrates an example sheath for the antenna assembly shown in FIG. 1 and/or FIG. 17 according to an exemplary embodiment;

FIG. 20A is an exploded perspective view illustrating components of the antenna assembly shown in FIG. 17 and sheath shown in FIG. 19 according to an exemplary embodiment;

FIG. 20B is a cross sectional view taken along the line 20B-20B in FIG. 19 and illustrating the exemplary manner by which the components shown in FIG. 20A may be assembled;

FIG. 21A illustrates the antenna assembly shown in FIG. 17, and also illustrating the λ/2 electrical length of the antenna assembly for the UHF band and the λ/4 and λ/2 electrical length of the bottom helical radiating element for the 7-800 MHz frequencies band and GPS band, where these electrical lengths and frequencies are provided for purposes of illustration only according to exemplary embodiments;

FIG. 21B illustrates the antenna assembly shown in FIG. 17, where the helical radiators are not shown to better illustrate the λ/4 electrical length of the linear radiator's inner, center conductor for the 7-800 MHz frequency band and the λ/4 combined electrical length of the linear radiator's center conductor and top loaded conductor for the UHF band, where these electrical lengths and frequencies are provided for purposes of illustration only according to exemplary embodiments;

FIG. 22 illustrates an example of a linear radiator that may be used in the antenna assembly shown in FIG. 17, where the helical radiator is not shown to better illustrate the linear radiator's inner, center electrically conducting member and top loaded conductor;

FIGS. 23A and 23B illustrate an example matching network topology of a printed circuit board assembly with lumped components of the antenna assembly shown in FIG. 17 according to an exemplary embodiment;

FIG. 24 is an exemplary line graph illustrating return loss in decibels (dB) versus frequency in megahertz (MHz) measured for the antenna assembly shown in FIG. 17 and illustrating the coupling effect from the top suspended helical radiating element and the antenna's resonance for the GPS band;

FIG. 25 is an exemplary line graph illustrating return loss in decibels (dB) versus frequency in megahertz (MHz) measured for the antenna assembly shown in FIG. 17 when covered by the sheath shown in FIG. 19 and illustrating the GPS resonance shift to lower frequency due to load by sheath;

FIG. 26 is another exemplary line graph illustrating return loss in decibels (dB) versus frequency in megahertz (MHz) measured for the antenna assembly shown in FIG. 17 in a hand held position;

FIG. 27 is a table with performance summary data of measured efficiency and gain performance of the antenna assembly shown in FIG. 17 (in free space) for the UHF, 7-800, and GPS bands;

FIGS. 28 through 33 illustrate radiation patterns (azimuth plane) measured for the antenna assembly shown in FIG. 17 in free space at frequencies of 400 MHz, 470 MHz, 520 MHz, 764 MHz, 830 MHz, and 870 MHz, respectively;

FIGS. 34 and 35 illustrate respective radiation patterns (phi zero degree plane and phi ninety degree plane) measured for the antenna assembly shown in FIG. 17 in free space at a frequency of 1575 MHz;

FIG. 36A illustrates a multiband antenna assembly including upper and lower suspended linear radiating elements and helical radiating elements according to another exemplary embodiment;

FIG. 36B illustrates the antenna assembly shown in FIG. 36A with the spacers and pre-mold removed to show additional features;

FIG. 37A illustrates the antenna assembly shown in FIG. 36B, and also illustrating the λ/4 total electrical length of the upper helical radiator and the adaptor for the VHF band and the 3λ/4 combined electrical length of the lower linear radiator and the narrower pitch coils of the lower helical radiator for the 7-800 MHz band, where these electrical lengths and frequencies are provided for purposes of illustration only according to exemplary embodiments;

FIG. 37B illustrates the antenna assembly shown in FIG. 36B, and also illustrating the λ/4 electrical length of the upper helical radiator for the UHF band, the λ/4 and λ/2 electrical length of the narrow pitch coils of the lower helical radiating element for the UHF band and the 7-800 MHz band, and the λ/4 and λ/2 electrical length of the wider pitch coils of the lower helical radiating element for the 7-800 MHz band and the GPS band, where these electrical lengths and frequencies are provided for purposes of illustration only according to exemplary embodiments;

FIG. 38 is an exemplary line graph illustrating measure return loss in decibels (dB) at hand held position versus frequency in megahertz (MHz) for the antenna assembly shown in FIG. 36A;

FIG. 39 are tables with measured efficiency and gain in decibels (dB) for the antenna assembly shown in FIG. 36A for the VHF band (azimuth plane—hand held position) and for the UHF, 7-800, and GPS bands (in free space and hand held position);

FIGS. 40 through 42 illustrate radiation patterns (azimuth plane) measured for the antenna assembly shown in FIG. 36A in a hand held position at a VHF frequency of 155 MHz and in a hand held position and in free space at a UHF frequency of 470 MHz and at a 7-800 MHz band frequency of 806 MHz, respectively;

FIG. 43 illustrates a radiation pattern (phi zero degree plane) measured for the antenna assembly shown in FIG. 36A in free space and hand held position at a GPS frequency of 1575 MHz;

FIG. 44 is a perspective view of a multiband antenna assembly including a helical radiating element, a top loaded linear radiating element, and a bottom suspended helical radiating element according to another exemplary embodiment;

FIG. 45 is an exploded perspective view illustrating components of the antenna assembly shown in FIG. 44 and a sheath according to an exemplary embodiment;

FIG. 46A illustrates the antenna assembly shown in FIG. 45 after the components have been assembled;

FIG. 46B is a cross sectional view taken along the line 46B-46B in FIG. 46A;

FIG. 47A illustrates the antenna assembly shown in FIG. 44, where the bottom suspended helical radiator and the top loaded linear radiator are not shown to better illustrate the 3λ/4 electrical length of the helical radiator for the VHF band and the λ/4 electrical length of the wider pitch coils of the helical radiator for the UHF band, where these electrical lengths and frequencies are provided for purposes of illustration only according to exemplary embodiments;

FIG. 47B illustrates the antenna assembly shown in FIG. 44, and also illustrating the λ/4 electrical length of the bottom suspended helical radiator for the 7-800 MHz band, the λ/4 combined electrical length of the bottom suspended helical radiator and linear radiator's inner, center conductor for the UHF band, and the 3λ/4 combined electrical length of the bottom suspended helical radiator and linear radiator's top loaded conductor for the 7-800 MHz band, where these electrical lengths and frequencies are provided for purposes of illustration only according to exemplary embodiments;

FIG. 47C illustrates the antenna assembly shown in FIG. 44, where the helical radiators are not shown to better illustrate the λ/4 electrical length of the linear radiator's inner, center conductor for the 7-800 MHz band and the λ/4 combined electrical length of the linear radiator's center conductor and top loaded conductor for the UHF band, where these electrical lengths and frequencies are provided for purposes of illustration only according to exemplary embodiments;

FIG. 48 illustrates examples of flat pattern profiles for suspended helical radiators before being wrapped or coiled and which may be used in the antenna assembly shown in FIG. 44 according to exemplary embodiments;

FIGS. 49 through 51 illustrate examples of a linear radiator that may be used in the antenna assembly shown in FIG. 44 according to exemplary embodiments;

FIG. 52 is an exemplary line graph illustrating measured return loss in decibels (dB) at hand held position versus frequency in megahertz (MHz) for the antenna assembly shown in FIG. 44;

FIG. 53 are tables with measured efficiency and gain in decibels (dB) for the antenna assembly shown in FIG. 44 for the VHF band (azimuth plane—hand held position) and for the UHF, 7-800, and GPS bands (in free space);

FIGS. 54 through 60 illustrate radiation patterns (azimuth plane) measured for the antenna assembly shown in FIG. 44 in a hand held position at a VHF frequency of 155 MHz and in free space at UHF frequencies of 400 MHz, 470 MHz and 520 MHz and at 7-800 MHz band frequencies of 764 MHz, 830 MHz, and 870 MHz, respectively; and FIGS. 61 and 62 illustrate radiation patterns (phi zero degree plane and phi ninety degree plane) measured for the antenna assembly shown in FIG. 44 in free space at a GPS frequency of 1575 MHz.

DETAILED DESCRIPTION

Example embodiments will now be described more fully with reference to the accompanying drawings.

The inventor hereof has recognized that there is a demand for portable two way radios having interoperability capability, which leads to multiband and multimode two way radios. But with such multiband and multimode radios, the inventor hereof has recognized that it is a great challenge to provide a suitable antenna with various band capabilities. For example, the inventor hereof has recognized that conventional helical antennas tend to have narrow bandwidths, especially for Very High Frequency (VHF) band (e.g., 136 MHz to 174 MHz) and/or Ultra High Frequency (UHF) band (e.g., 380 MHz to 527 MHz). The inventor has also recognized that the complexity of some existing multiband antennas only perform well at a limited portion of the entire UHF band. The inventor has further recognized that some existing multiband antennas also have poor manufacturability due to the complexity of integration of multiple radiating elements and having to also meet mechanical structural integrity requirements.

Accordingly, the inventor has disclosed herein multiband antenna assemblies that do not suffer from very narrow bandwidths especially in the UHF and VHF bands. Exemplary embodiments disclosed herein may be configured with the ability to achieve multiband application with an antenna assembly or unit having a suitably compact size in terms of diameter and length. An exemplary embodiment of an antenna assembly disclosed herein is configured to achieve multiband operation for frequencies associated with VHF (e.g., 136 MHz to 174 MHz), UHF (e.g., 380 MHz to 527 MHz), and GPS (e.g., 1575 MHz). Another exemplary embodiment of an antenna assembly disclosed herein is configured to achieve multiband operation for frequencies associated with UHF (e.g., 380 MHz to 527 MHz), 7-800 MHz frequency band (e.g., 764 MHz to 870 MHz) and GPS (e.g., 1575 MHz). In additional exemplary embodiments disclosed herein, an antenna assembly is configured to achieve multiband operation for frequencies associated with VHF, UHF, 7-800, and GPS bands. In such exemplary embodiments, the multiband operation may be achieved even though the antenna assembly has a relatively limited diameter and length (e.g., length less than 23 centimeters, etc.) and relatively thin profile. These frequency bands are examples only as other exemplary embodiments of an antenna assembly may be configured to be resonant at other frequencies and/or frequency bands, such as one or more of a VHF frequency bandwidth from 163 MHz to 174 MHz, a UHF frequency bandwidth from 403 MHz to 470 MHz, and GPS frequency of 1575 MHz.

As disclosed herein, exemplary embodiments of the multiband antenna assemblies may be configured so as to provide GPS radiation patterns that tilt up and have open sky efficiency better than 25%, to provide radiation patterns in the 7-800 MHz frequency band that tilt up and have near horizontal efficiency better than 30%; and/or also be associated with good manufacturability.

Accordingly, the inventor hereof has disclosed herein various exemplary embodiments of antenna assemblies that include helical and linear radiating elements. For example, a multiband antenna assembly may generally include one or more helical radiators and one or more linear radiators. The one or more linear radiators may be aligned with and/or disposed at least partially along a longitudinal axis (e.g., a longitudinal centerline or centrally located axis, axis along the length, etc.) of at least one of the one or more helical radiators. The antenna assembly may be resonant in at least three frequency bands.

With reference now to the figures, FIG. 1 illustrates an exemplary embodiment of a multiband antenna assembly 100 embodying one or more aspects of the present disclosure. This exemplary embodiment has a design generally based on a monopole concept with multiple radiating elements.

As shown in FIG. 1, the antenna assembly 100 generally includes linear and helical radiators or radiating elements 104 and 112 coupled to a matching network 120 via an adapter 116 and contact spring 132. As disclosed herein, the linear radiator 104 in this example is a top loaded conducting wire located generally inside the helical radiator 112, such that the linear radiator 104 extends along or is aligned generally with the central longitudinal axis of the helix of the helical radiators 112. The antenna assembly 100 terminates with a connector 124 (e.g., 50 Ohm connector, etc.) for connecting the antenna assembly 100 to a device (e.g., device housing 128 in FIG. 2, etc.), whereby the antenna assembly 100 depends to a ground plane of the device to excite.

As disclosed herein, this exemplary antenna assembly 100 is configured to be operable or to cover multiple frequency ranges or bands, including the VHF frequency band from about 136 MHz to about 174 MHz, the UHF frequency band from about 380 MHz to about 527 MHz, and the GPS frequency of about 1575 MHz. This particular antenna assembly 100 is configured so as to have an electrical length of one quarter wavelength (λ/4) for the VHF, UHF, and GPS bands as shown in FIGS. 3A and 3B. The outer helical radiating element 112 corresponds to VHF and UHF bands. The total electrical length of the helical radiating element 112 is approximately equivalent to one quarter wavelength (λ/4) of the VHF band. The matching network 120 is operable to help broaden the bandwidth of the VHF band for resonance from 136 MHz to 174 MHz.

With continued reference to FIG. 1, the helical radiator 112 in this exemplary embodiment is a dual pitch helical coil radiator or spring having narrower and wider pitch coils 113, 114, respectively, along the respective bottom and top portions of the helical radiator 112. In operation, the lower coils 114 having the wider pitch are more responsive and resonant at the UHF band and are approximately equivalent to one quarter wavelength (λ/4) for the UHF band frequencies as shown in FIG. 3A. The upper coils 113 having the narrower or closer pitch are operable for introducing another resonance at the VHF band. A third harmonic of the UHF band is also resonant at the GPS band. Accordingly, multiple resonant frequencies may be introduced by the dual pitch helical radiator 112 without a whip or linear radiating element.

A wide range of electrically conducting materials, preferably highly conductive materials, may be used for the helical radiator 112. By way of example, the helical radiator 112 may be formed from copper wire, spring wire, copper/tin/nickel plating wire, enameled wire, among other materials that may be configured to have the helical/spring configuration shown in FIG. 1. In addition, the coils of the helical radiator 112 are configured (e.g., dual pitch, spacing, size, shape, etc.) in this example for specific frequency bands. Alternative embodiments may be configured for use with additional and/or different frequencies such as by varying the windings of the helical radiator coils. For example, other embodiments may include one or more helical radiators having coils with a constant pitch or with more than two different pitches and/or with a tapering pitch such that the coil has an upper or lower section wider than the other section.

As shown in FIG. 4, the linear radiator 104 includes electrically conductive wire 106 (broadly, a first conductor) and a top loaded element 108 (broadly, a second conductor) at or along the end portion of the electrically conductive wire 106. The electrically conducting wire 106 and top loaded element 108 are positioned relative to the helical radiating element 112 such that they extend through at least some of the coils of the helical radiating element 112 along a central longitudinal axis of the helix of the helical radiating element 112 as shown in FIG. 1. The coils of the outer helical radiating element 112 coil or wind counterclockwise generally about the length of the inner linear radiating element 104, which is thus located generally inside the helical radiator 112.

By way of example, the first conductor 106 of the linear radiator 104 may be formed from the electrically conducting wire at the center core of a coaxial cable as shown in FIG. 4. The top loaded element or second conductor 108 of the linear radiator 104 may comprise the braid soldered at the end of the coaxial cable. Accordingly, the braid of the coaxial cable may work as the second conductor 108, while the center core of the coaxial cable works as the first conductor 106. The coaxial cable's dielectric insulator 105 between the core and braid will operate to prevent direct contact therebetween. The first and second conductors 106, 108 are configured as radiating elements for respective low band operation (e.g., UHF band, etc.) and high band operation (e.g., GPS band, etc.) according to this example embodiment.

The first and second conductors 106, 108 are galvanically coupled or connected to each other at the top or end 109 of the linear radiator 104. This electrical connection between the first and second conductors 106, 108 allows the antenna assembly 100 to be operable simultaneously at the UHF and GPS bands in this example. As shown in FIG. 3B, the first conductor 106 has an electrical length of about one quarter wavelength (λ/4) for the UHF band, while the second conductor 108 has an electrical length of about one quarter wavelength (λ/4) for the GPS frequency of 1575 MHz.

In operation, coupling (e.g., parasitic coupling in this example, etc.) between the linear radiator 104 (top loaded conducting wire in this example) and the lower coils 114 of the helical radiating element 112 allows the antenna assembly 100 to maintain the bandwidth for the UHF band with antenna resonance from 380 MHz to 527 MHz as can be seen in FIG. 10. The linear radiator 104 and the additional closer pitch coils 113 at the top of the helical radiator 112 allow the antenna assembly 100 to operate at VHF, UHF and GPS at the same time. Overall, the outer helical radiating element 112 is more dominant when the antenna assembly 100 is operating at VHF band frequencies. But when the antenna assembly 100 is operating within the UHF and GPS bands, the H-field or E-field of the top loaded conducting wire 104 will couple to the outer helical radiating element 112 to radiate.

Also, with the combination of the top loaded linear and helical radiating elements 104, 112, the antenna assembly 100 is excited in omnidirectional radiation patterns for the VHF and UHF bands as shown in FIGS. 12 through 15. In operation, the antenna assembly is able to achieve total efficiency and near horizon efficiency of more than 58% and 45% respectively for the UHF band as shown in FIG. 11. The top loaded electrically conducting wire also tilts up the GPS radiation pattern (FIGS. 11 and 16) such that the antenna assembly 100 achieves more than 30% of open sky efficiency for the GPS frequency band in this example embodiment.

Alternative embodiments may include linear radiators having first and second conductors configured differently, including conductors formed from different materials other than coaxial cables and/or soldered braids at the end of the coaxial cables. Other exemplary embodiments may include a flexible electrically conducting wire or cable as the first conductor with a metal tube as the second conductor, which is crimped or soldered to the end of the wire or cable. In these example embodiments, an insulator jacket may be disposed or sandwiched between the metal tube and electrically conductive wire or cable. Examples of electrically conductive wires or cables that may be used include a speedometer cable, nickel titanium (NiTi) wire, among other suitable cables, wires, rods, and/or elongate generally straight conducting members.

In addition, other electrically conductive materials and/or configurations may be used for the first and/or second conductors of the linear radiator. For example, the second conductor may be formed from a spring or single wire instead of a soldered coaxial cable braid or metal tube. To this end, FIGS. 5 through 7 illustrate further examples of linear radiators 204, 304, 404, respectively, that may be used with the antenna assembly 100 with similar results in antenna performance.

As shown in FIG. 5, the linear radiator 204 includes a first conductor 206 and a second conductor 208 connected to each other at the top or end 209 of the first conductor 206. In this example, the second conductor 208 is a spring or helical conductor suspended from the end 209 of the first conductor 206, such that the spring 208 extends outwardly away from the first conductor 206.

The linear radiator 304 shown in FIG. 6 also includes a first conductor 306 and a second conductor 308 connected to each other at the top or end 309 of the first conductor 306. But in this example, the second conductor 308 is a spring or helical conductor that extends in the opposite direction than did the spring 208 in FIG. 5. As shown in FIG. 6, the spring 308 extends back along the first conductor 306 such that the coils of the spring 308 coil or wind generally about the length of the first conductor 306.

FIG. 7 illustrates another example of a linear radiator 404, which includes a first conductor 406 and a second conductor 408 connected to each other at the top or end 409 of the first conductor 406. But in this example, the second conductor 408 is a single straight portion of electrically conductive wire that extends parallel to and back along the first conductor 406.

Figure 2:
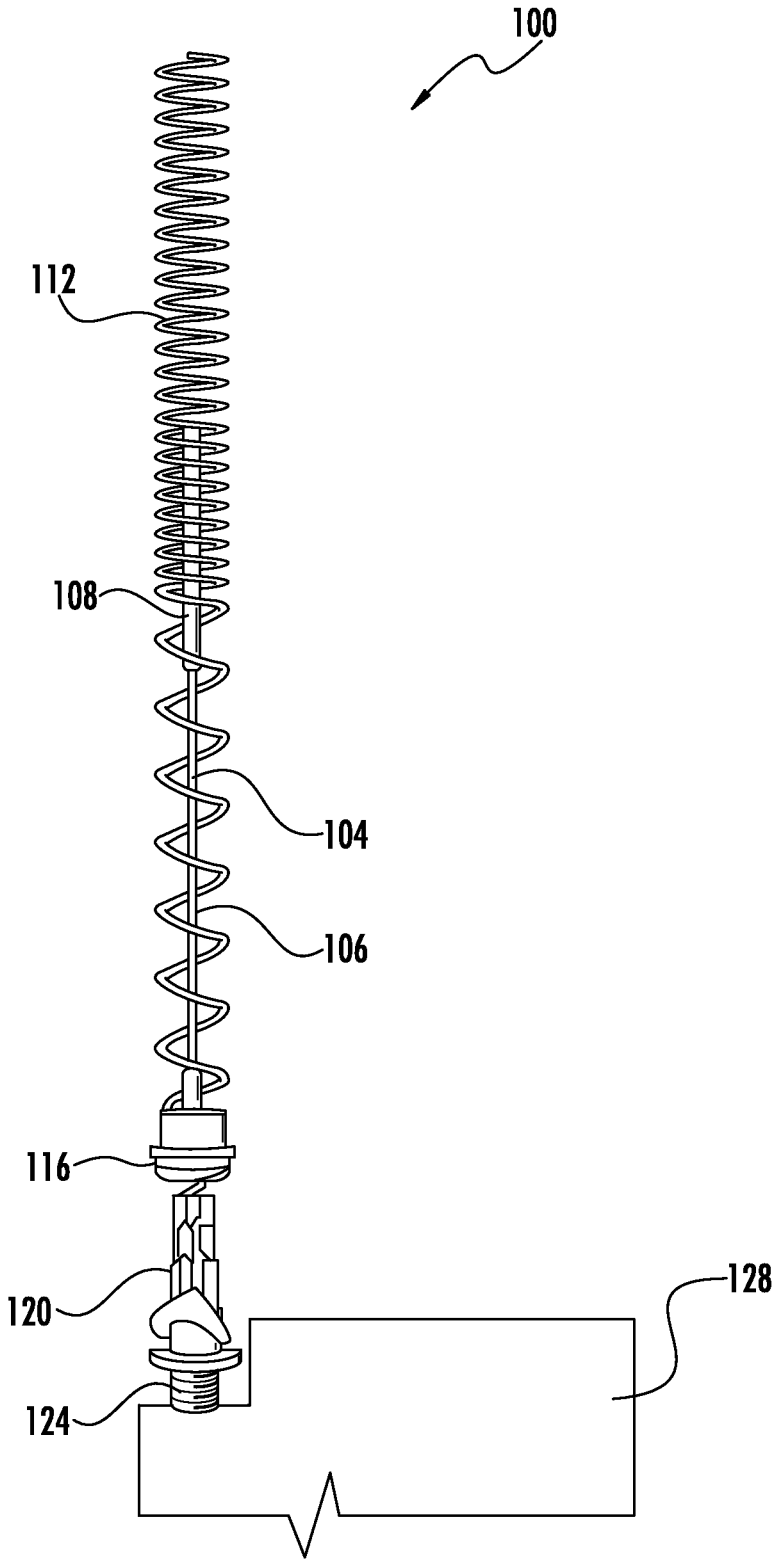
FIG. 2 is a perspective view illustrating the exemplary manner by which the antenna assembly shown in FIG. 1 may be externally mounted to a wireless device housing according to an exemplary embodiment.

FIGS. 8A and 8B illustrate an example matching network topology of a printed circuit board assembly that may be used in the antenna assembly 100. In this example, the matching network 120 comprises lumped components 136 residing on front and back oppositely facing surfaces of the printed circuit board 138. As shown in FIGS. 1 and 2, the matching network 120 is part of the antenna assembly 100 rather than the device to which the antenna assembly 100 will be connected. Accordingly, the antenna assembly 100 does not have to rely upon a matching network that is part of or internal to the device as the antenna assembly 100 instead includes its own (e.g., embedded, etc.) matching network 120.

The matching network 120 may comprise one or more shunt or series capacitors and/or one or more shunt or series inductors depending on the matching network topology. Additionally, or alternatively, the circuit board 138 may also include other capacitors, inductors, resistors, or the like, as well as conductive traces. In operation, the matching network 120 helps to pull the antenna resonance to lower frequency (ies) compared to the structure capability to the low band. This means that the helical coil structure by itself may not have sufficient electrical length to achieve the full bandwidth of the low band. The impedance matching of the matching network 120 helps the antenna assembly to be tuned to lower frequency(ies). In this particular illustrated example, the matching network 120 is operable to help broaden the bandwidth of the VHF band for resonance from 136 MHz to 174 MHz.

Moreover, the printed circuit board 138 and lumped components 136 thereon that provide the impedance matching of the matching network 120 may be configured such that they will be contained within or under a sheath or radome (e.g., sheath 540 shown in FIGS. 19, 20A and 20B, etc.) of the antenna assembly 100. As shown in FIG. 2, the matching network 120 will be external to the device housing 128 when the antenna assembly 100 is coupled thereto.

In this particular example, the connector 124 of the antenna assembly 100 is a 50 ohm connector and is illustrated as a threaded connection. Alternative connectors may be used in other embodiments including a snap fit connection, etc. As shown in FIG. 2, the antenna assembly 100 may be threadedly connected to the device housing 128 such that the bulk of the antenna assembly or unit 100 is external to the device housing 128. That is, the radiating elements 104, 112 and circuit board 138 having the matching network 120 of the antenna assembly 100 are able to be entirely contained within or under the sheath (e.g., sheath 540 shown in FIG. 19, etc.) and remain external to the wireless device housing 128. Thus, the antenna assembly 100 is able to provide multiband operation in the VHF, UHF, and GPS frequency bands without having to significantly increase the overall size or volume of the wireless device housing 128. By way of example only, the sheath may have a length of about 180 millimeters and a diameter of about 14.5 millimeters along the portion disposed over the connector 124.

The radiating elements 104, 112 may be mechanically and electrically coupled to the circuit board 138 by the adapter 116 and contact spring 132. The contact spring 132 may include a hook portion 134 (e.g., J-shaped or L-shaped hook portion, etc.) that extends through a hole in the circuit board 138 as shown in FIGS. 8A and 8B. The circuit board 138 and radiating elements 104, 112 of the antenna assembly 100 may be coupled in a similar manner as that described below for the antenna assembly 500, although this is not required.

FIGS. 9 through 16 provide analysis results measured for a prototype of the antenna assembly 100 shown in FIG. 1. These analysis results shown in FIGS. 9 through 16 are provided only for purposes of illustration and not for purposes of limitation.

More specifically, FIGS. 9 and 10 are exemplary line graphs illustrating return loss in decibels versus frequency measured for the antenna assembly 100. In FIG. 9, the antenna's resonance for the VHF, UHF, and GPS bands can be seen when the antenna assembly 100 was measured in free space condition. The data shown in FIG. 10 was measured when the antenna assembly 100 was in the hand held position. Generally, FIGS. 9 and 10 show that the antenna assembly 100 is operable with relatively good/acceptable return loss and bandwidths for the VHF, UHF, and GPS bands.

FIG. 11 is a table with performance summary data of measured efficiency and gain performance of the antenna assembly 100 for the VHF band (in a hand held position) and for the UHF and GPS bands (in free space). Generally, this performance summary data shows that the antenna assembly 100 has relatively good gain/efficiency for the VHF, UHF, and GPS bands, including good open sky efficiency of more than 30% for the GPS band.

Figure 12:
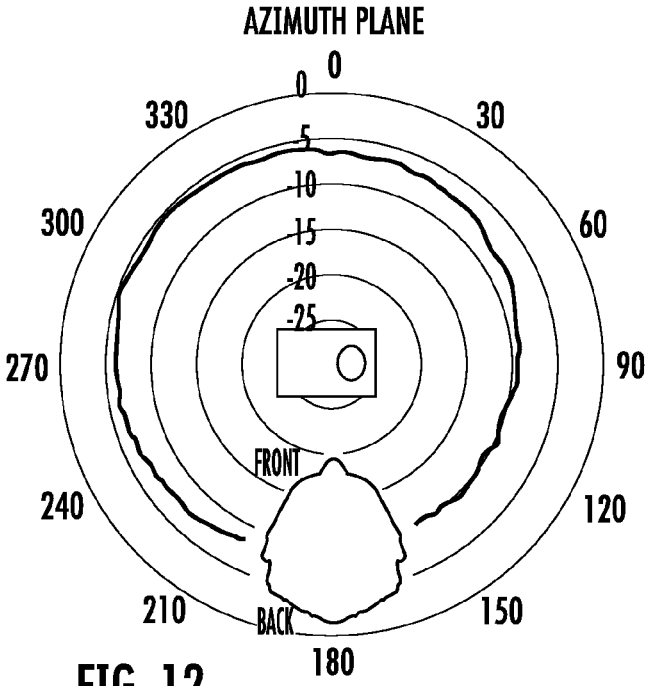
Figure 13:
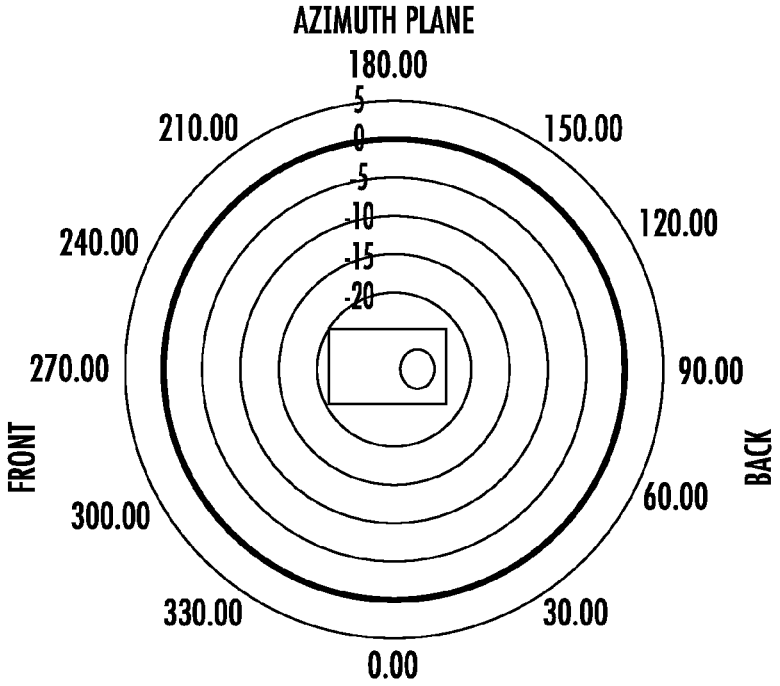
Figure 14:
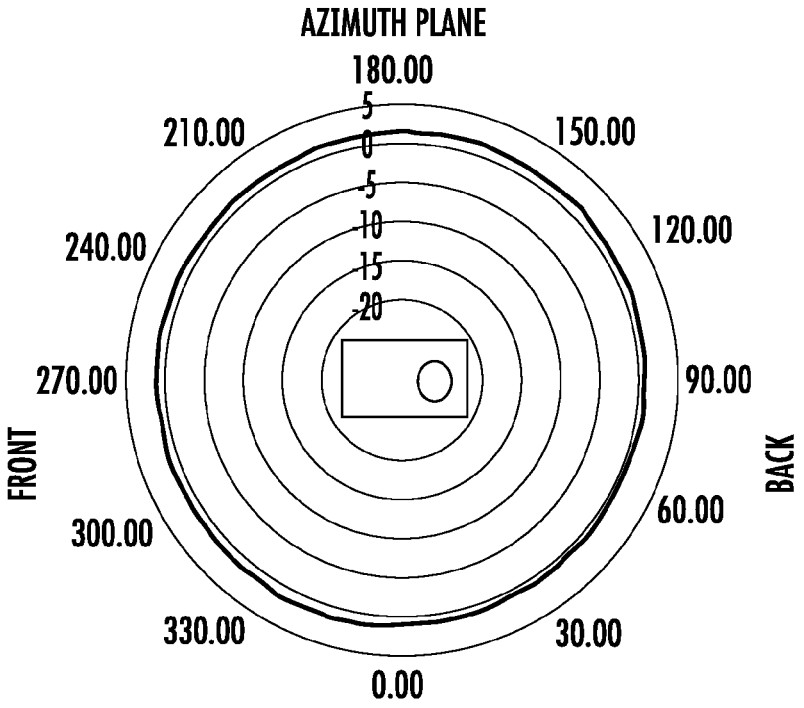
Figure 15:
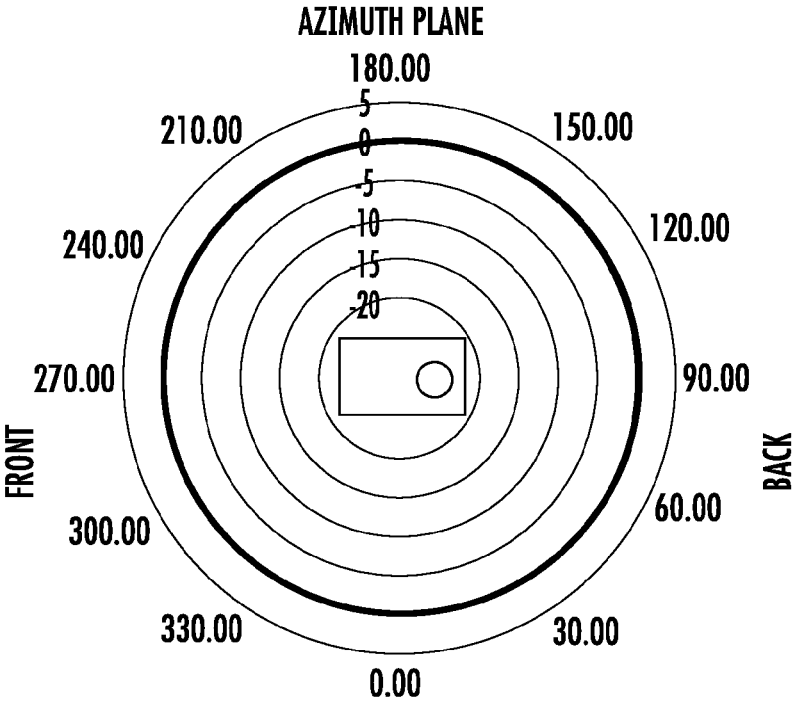

FIGS. 12 through 16 illustrate radiation patterns measured for the antenna assembly 100. The image at the center of each graph represents a device (e.g., two way radio, etc.) having the antenna assembly 100 mounted on top thereof. More specifically, FIG. 12 illustrates radiation patterns (azimuth plane) measured for the antenna assembly 100 in a hand held position at a VHF frequency of 155 MHz where the image below the device represents the head of the person holding the device. The VHF band is measured in a hand held position where the device is held in the user's hands with the distance from the head about two inches to represent a real world application. FIGS. 13 through 15 illustrate radiation patterns (azimuth plane) measured for the antenna assembly 100 in free space at UHF frequencies of 400 MHz, 450 MHz, and 512 MHz, respectively. FIG. 16 illustrates a radiation pattern (phi zero degree plane) measured for the antenna assembly 100 in free space at a GPS frequency of 1575 MHz.

Generally, FIGS. 12 through 16 show the radiation patterns for the antenna assembly at these various frequencies within the VHF, UHF, and GPS bands and the good efficiency of the antenna assembly 100. The antenna assembly 100 has relatively broad bandwidths for the VHF, UHF, and GPS bands and allows multiple operating bands for wireless communications devices.

FIG. 17 illustrates another exemplary embodiment of an antenna assembly 500 embodying one or more aspects of the present disclosure. This exemplary embodiment has a design generally based on a monopole concept with multiple radiating elements.

As shown in FIG. 17, the antenna assembly 500 generally includes linear and helical radiators or radiating elements 504, 508, and 512 coupled to a matching network 520 via an adapter 516 and contact spring 532. In this example, the linear radiator 504 is a top loaded conducting wire located generally between and inside two spaced-apart helical radiators 508, 512. The helical radiators 508, 512 are at or along opposite end portions of the linear radiator 504. The linear radiator 504 extends along and/or is aligned generally with the central longitudinal axes of the helixes of the helical radiators 508, 512. The top suspended helical radiator 508 may be coupled (e.g., via the coil form 544 (FIGS. 20A and 20B), etc.) such that the top suspended helical radiator 508 does not make direct galvanic contact with the linear radiator 504. In operation, the top suspended helical radiator 508 parasitically couples to the linear radiator 504. The antenna assembly 500 terminates with a connector 524 (e.g., 50 Ohm connector, etc.) for connecting the antenna assembly 500 to a device (e.g., device housing 528 in FIG. 18, etc.), whereby the antenna assembly 500 depends to a ground plane of the device to excite.

As disclosed herein, this exemplary antenna assembly 500 is configured to be operable or to cover multiple frequency ranges or bands, including the UHF frequency band from about 380 MHz to about 527 MHz, the 7-800 MHz frequency band from about 764 MHz to about 870 MHz, and the GPS frequency of 1575 MHz. This particular antenna assembly 500 is configured to have the electrical lengths shown in FIGS. 21A and 21B.

As shown in FIG. 22, the linear radiator 504 includes electrically conductive wire 506 (broadly, a first conductor) and a top loaded element 511 (broadly, a second conductor) at the end of the electrically conductive wire 506. By way of example, the first conductor 506 of the linear radiator 504 may be formed from the electrically conducting wire at the center core of a coaxial cable. The top loaded element or second conductor 511 of the linear radiator 504 may comprise the braid soldered at the end of the coaxial cable. Accordingly, the braid of the coaxial cable may work as the second conductor 511, while the center core of the coaxial cable works as the first conductor 506. The coaxial cable's dielectric insulator 505 between the core and braid will operate to prevent direct contact therebetween.

In this example, the first conductor 506 is the center conductor of a conducting wire formed as a radiating element for the 7-800 MHz frequency band. The first and second conductors 506, 511 are galvanically coupled or connected (e.g., soldered, etc.) to each other at the top or end 509 of the linear radiator 504 as shown in FIG. 22. This configuration of the first and second conductors 506, 511 introduces a capacitance coupling to the antenna assembly 500 and creates another resonance for the antenna assembly 500 at the UHF band. The two conductor elements 506 and 511 also couple to each other such that the antenna assembly 500 is capable of simultaneously operating at the UHF and 7-800 MHz frequency bands at the same time.

As shown in FIG. 21B, the electrical length of the first conductor 506 is about one quarter wavelength ($\lambda/4$) for the 7-800 MHz band. The electrical length is about one quarter wavelength ($\lambda/4$) for the UHF band when the first and second conductors 506, 511 are connected. In operation, the first conductor 506 introduces a single band resonance frequency for the 7-800 MHz frequency band, while the combination of the first and second conductors 506, 511 and matching network 520 introduce dual frequency resonance for the UHF and 7-800 MHz frequency bands. A loading gap 507 (FIG. 22) between the first and second conductors 506, 511 changes the frequency ratio for the UHF and 7-800 MHz frequency bands and/or helps fine tune the frequency ratio between the UHF and 7-800 MHz frequency bands.

Alternative embodiments may include linear radiators having first and second conductors configured differently, including conductors formed from different materials other than coaxial cables and/or soldered braids at the end of the coaxial cables. Other exemplary embodiments may include a flexible electrically conducting wire or cable as the first conductor with a metal tube as the second conductor, which is crimped or soldered to the end of the wire or cable. In these example embodiments, an insulator jacket may be disposed or sandwiched between the metal tube and electrically conductive wire or cable. Examples of electrically conductive wires or cables that may be used include a speedometer cable, nickel titanium (NiTi) wire, among other suitable cables or wires.

With continued reference to FIG. 17, the coils of the top suspended helical radiating element 508 have a constant pitch such that the same distance is between the turns in the helical radiator 508. Likewise, the coils of the bottom helical radiating element 512 include coils having a constant pitch, which, however, is less than the coils' pitch of the top suspended helical radiating element.

A wide range of electrically conducting materials, preferably highly conductive materials, may be used for the helical radiators 508, 512. By way of example, the helical radiators 508, 512 may be formed from copper wire, spring wire, copper/tin/nickel plating wire, enameled wire, among other suitable materials that may be configured to have a helical/spring configuration shown in FIG. 17. In addition, the coils of the helical radiators 508, 512 are configured (e.g., dual pitch, spacing, size, shape, etc.) in this example for specific frequency bands. Alternative embodiments may be configured for use with additional and/or different frequencies such as by varying the windings of the helical radiator coils. For example, other embodiments may include one or more helical radiators having coils with a non-constant pitch, etc.

In operation, the bottom helical radiating element 512 is responsive and resonant at the 7-800 MHz frequency band. As shown in FIG. 21A, the electrical length of the bottom helical radiating element 512 is approximately equivalent to one quarter wavelength ($\lambda/4$) for 7-800 MHz band frequencies. The bottom helical radiating element 512 also introduces a second harmonic frequency for the GPS band. And, the electrical length of the bottom helical radiating element 512 is approximately equivalent to one half wavelength ($\lambda/2$) for GPS band frequencies.

In operation, the bottom helical radiating element 512 couples parasitically to the gap 507 of the top loaded conducting wire 504. This coupling shifts the resonance of 7-800 MHz to a lower frequency while the UHF band resonance is maintained, such that the UHF and GPS bands resonate at the same time. The bottom helical radiating element 512 helps to fine tune the 7-800 MHz band.

In regard to the top suspended helical radiator 508, parasitic coupling between the top loaded conducting wire 504 and the top suspended helical radiator 508 will shift the UHF band bandwidth so as to be resonant from 380 MHz to 527 MHz. But the top loaded conducting wire 504 is dominant when the antenna assembly 500 is operating within the UHF frequency bandwidth. The coupling between the top suspended helical radiator 508 and top loaded conducting wire 504 also increases the UHF electrical length such that electrical length of the entire antenna is approximately equivalent to one half wavelength ($\lambda/2$) for the UHF frequencies as shown in FIG. 21A.

The coupling also improves 7-800 MHz bandwidths. For example, in this example embodiment, parasitic coupling of the top loaded conducting wire 504 and top suspended parasitic helical radiating element 508 broadens the bandwidth of the 7-800 MHz by introducing proximity resonance to the dominant resonance near 800 MHz as shown in FIG. 24.

Figure 31:
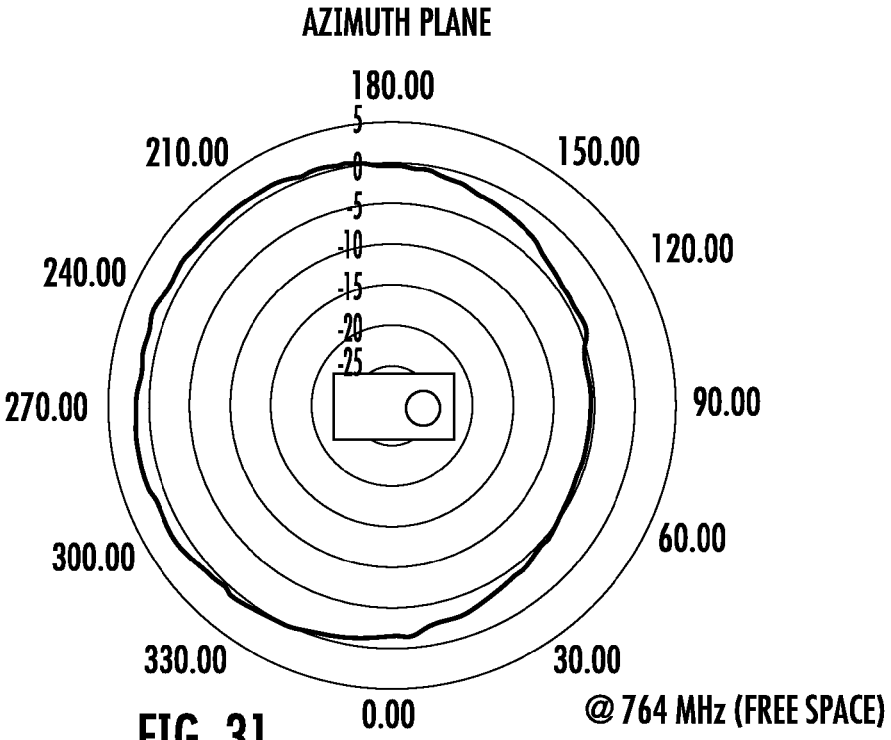
Figure 32:
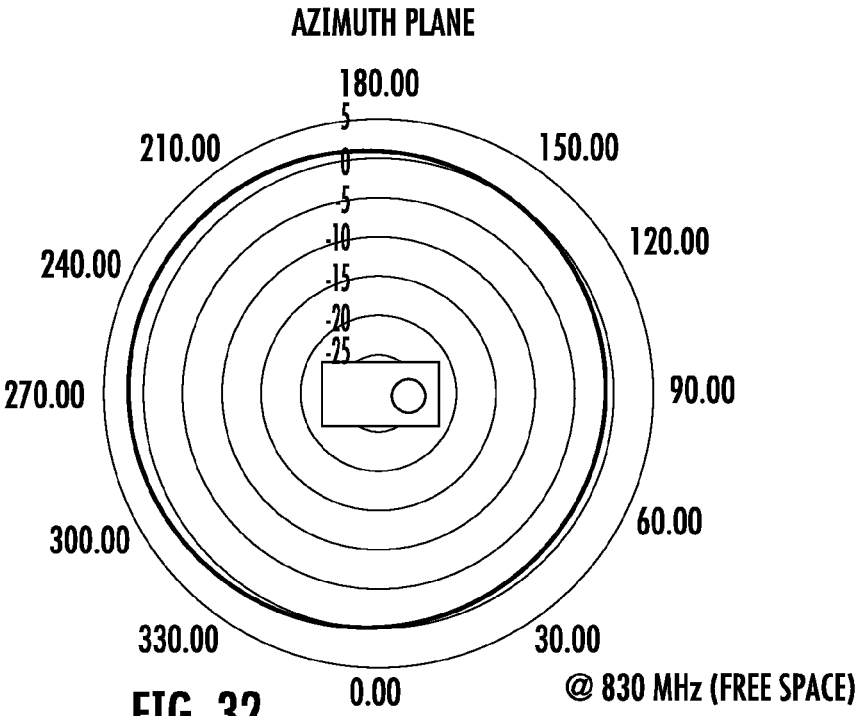
Figure 33:
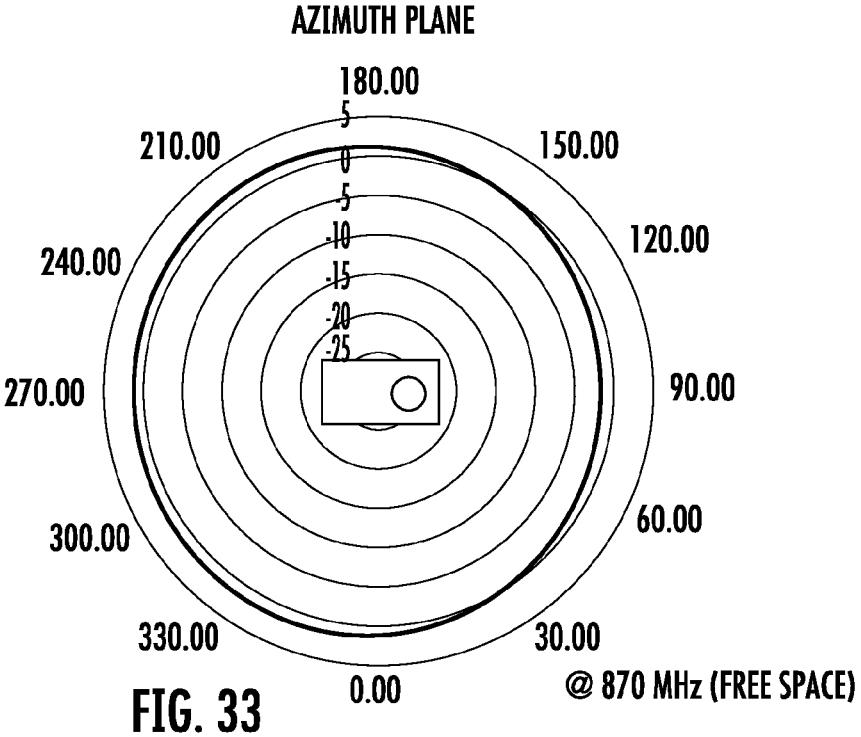

The additional top suspended helical coil 508 helps to tilt up the 7-800 MHz frequency band and GPS band radiation patterns as shown in FIGS. 31-33 (7-800 MHz frequency band) and FIGS. 34-35 (GPS band), respectively. This improved the near horizon efficiency to at least 45% for the 7-800 MHz frequency band as shown in FIG. 27. In addition, the coupling of the top loaded conductor 504 and top suspended helical radiating element 508 also helps to tilt up the GPS radiation pattern (FIGS. 34 and 35) to achieve more than 35% of open sky efficiency (FIG. 27) for the GPS band in this example embodiment.

Figure 28:
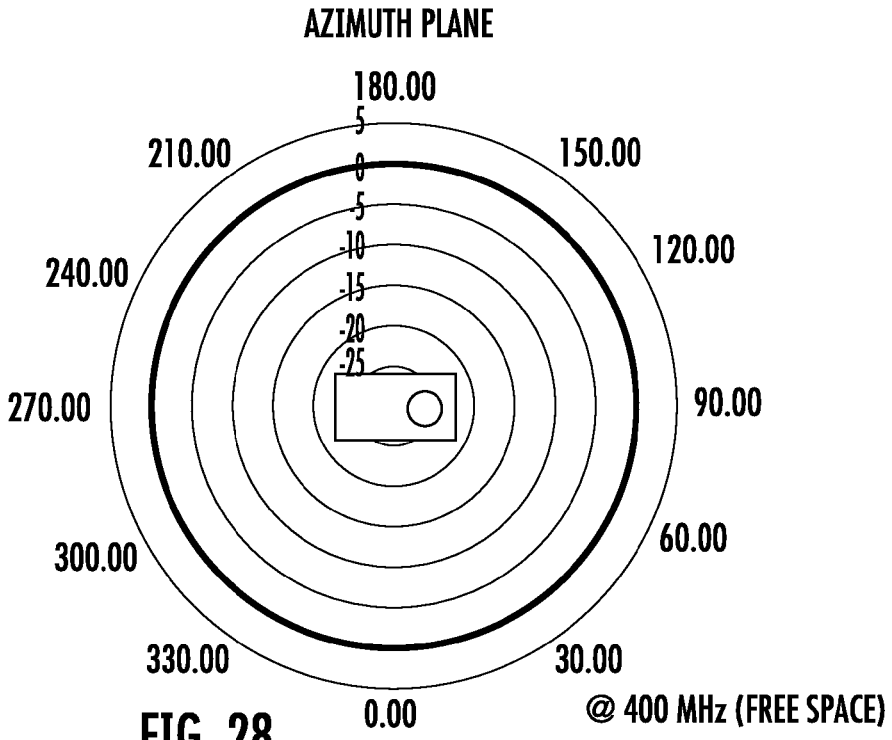
Figure 29:
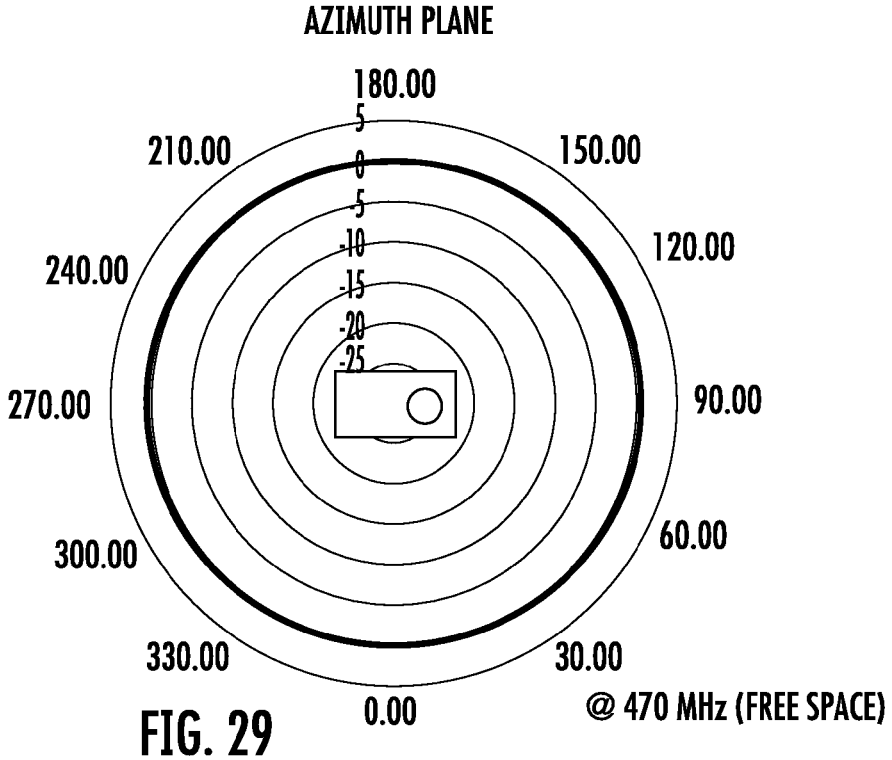
Figure 30:
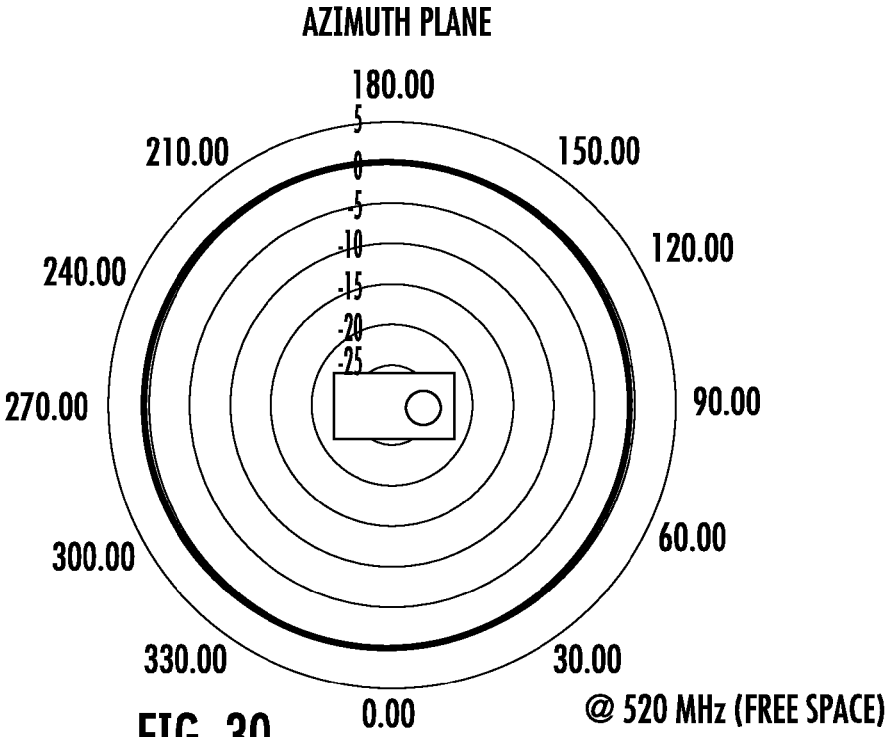

Multiple wavelengths are thus introduced by the bottom helical radiating element 512, top suspended helical radiating element 508, and the top loaded conducting wire 504, including the UHF, 7-800 MHz, and GPS bands. Also, with the combination of the bottom helical radiating element 512, top suspended helical radiating element 508, and the top loaded conducting wire 504, the antenna assembly 500 radiates in omnidirectional radiation patterns for the UHF and 7-800 MHz frequency bands as shown in FIGS. 28-30 (UHF band) and FIGS. 31-33 (7-800 MHz frequency band), respectively. Overall the average total efficiency and near horizon efficiency for the UHF and 7-800 MHz frequency band is more than 55% and 40% respectively (see FIG. 27).

FIGS. 23A and 23B illustrate an example matching network topology of a printed circuit board assembly that may be used in the antenna assembly 500. In this example, the matching network 520 comprises lumped components 536 residing on front and back oppositely facing surfaces of the printed circuit board 538. As shown in FIGS. 17 and 18, the matching network 520 is part of the antenna assembly 500 rather than the device to which the antenna assembly 500 will be connected. Accordingly, the antenna assembly 500 does not have to rely upon a matching network that is part of or internal to the device as the antenna assembly 500 instead includes its own (e.g., embedded, etc.) matching network 520. Placing circuit board 538 and matching network 520 in the antenna assembly 500 allows more volume in the wireless device for other components, such as for increased circuitry to further enhance performance of the wireless device.

The matching network 520 may comprise one or more shunt or series capacitors and/or one or more shunt or series inductors depending on the matching network topology. For example, the circuit board 538 may comprise, for example, a two-element L shaped network of a capacitor and shunt inductor. Additionally, or alternatively, the circuit board 538 may also include other capacitors, inductors, resistors, or the like, as well as conductive traces. In operation, the matching network 520 helps to improve impedance matching for the 7-800 MHz frequency and GPS bands. For example, the matching network 520 may provide broadband impedance matching by generally providing a 50 ohm load across the operating frequencies of interest.

Moreover, the printed circuit board 538 and lumped components 536 thereon that provide the impedance matching of the matching network 520 may be configured such that they will be contained within or under a sheath or radome 540 as shown in FIG. 20B. As shown in FIG. 18, the matching network 520 will be external to the device housing 528 when the antenna assembly 500 is coupled thereto.

In this particular example, the connector 524 of the antenna assembly 500 is a 50 ohm connector and is illustrated as a threaded connection. Alternative connectors may be used in other embodiments including a snap fit connection, etc. As shown in FIG. 18, the antenna assembly 500 may be threadedly connected to the device housing 528 such that the bulk of the antenna assembly or unit 500 is external to the device housing 528. That is, the radiating elements 504, 508, 512 and circuit board 538 having the matching network 520 of the antenna assembly 500 are able to be entirely contained within or under the sheath 540 (FIG. 20B) and remain external to the wireless device housing 528. Thus, the antenna assembly 500 is able to provide multiband operation in the UHF, 7-800, and GPS frequency bands without having to significantly increase the overall size or volume of the wireless device housing 528.

By way of example only, the sheath 540 may have a length of about 180 millimeters and a diameter of about 14.5 millimeters along the portion disposed over the connector 524. The numerical dimensions in this paragraph (as are all dimensions herein) are provided for illustrative purposes only, as the sheath and antenna components may be sized differently than disclosed herein depending on the particular frequencies desired or intended end use of the antenna assembly.

The sheath 540 may be overmolded or constructed via other suitable processes. For space considerations, the sheath 540 generally conforms to the outermost shape of the coils of the helical radiators 508, 512.

FIGS. 20A and 20B illustrate an exemplary manner by which the antenna assembly 500 and its various components may be assembled together. As shown in FIG. 20A and 20B, the radiating elements 504, 508, 512, connector 524, and circuit board 538 may be coupled and assembled under the sheath 540 using the adapter 516, spring contact or contact spring 532, coil form 544 (e.g., insert molded coil form, etc.), sleeve 552 (e.g., tubular premold, etc.), contact 556 (e.g., contact pin, etc.), and insulator 560.

As shown in FIG. 20B, the helical radiators 508, 512 may be wound or disposed around the coil form 544 such that the coils of the helical radiators 508, 512 are positioned in grooves along the outer or exterior surface shown in FIG. 20A. The coils of the bottom helical radiator 512 are also wound or disposed around a portion 517 of the adapter 516. The coil form 544 is disposed over the top loaded conducting wire 504 as shown in FIG. 20B. In this assembled state, the top suspended helical radiator 508 does not make direct galvanic contact with the top loaded conducting wire 504.

The contact spring 532 includes a hook portion 534 (e.g., J-shaped or L-shaped hook portion, etc.) that extends through an opening or hole in the circuit board 538 as shown in FIGS. 23A and 23B. The hook portion may terminate in a protrusion to provide additional resistance to pull through force tending to cause hook portion to pull out of the hole in the circuit board 538. The hook portion is sized to fit in and through the hole in the circuit board 538 to provide a mechanical connection between the circuit board and the adapter 516. For example, the coils of the spring contact 532 may be wrapped or wound about a portion of the adapter 516.

Electrical connection may be made by various means to connect conductive traces on the circuit board 538 with the spring contact 532, such as by soldering, a press fit connection, a stamped metal connection, etc. In this example embodiment, the contact spring 532 is shown as a separate component, but in other embodiments the contact spring 532 may comprise an integral piece or extension of the bottom helical radiating element 512.

With continued reference to FIGS. 20A and 20B, the insulator 560 electrically insulates the contact 556 (e.g., contact pin, etc.) from the connector 524. The contact 556 is connected to the circuit board 538, which is coupled to the adapter 516 within the tubular sleeve 552.

Radio frequency power from a wireless device (e.g., two-way radio, etc.) may be provided to the antenna assembly 500 by the contact 556 through the circuit board 538 when the antenna assembly 500 is threaded connected to the device housing 528 (as shown in FIG. 18). The connector or contact 556 is coupled to the circuit board 538, such as by a soldered connection, a press fit connection, a snap fit connection, a crimp connection, etc. The circuit board 538 is coupled to the adapter 516 via the contact spring 532. Accordingly, the contact 506 provides radio frequency power to the top loaded linear radiator 504 through circuit board 538, spring contact 532, and adapter 516.

With continued reference to FIGS. 20A and 20B, the sleeve 552 fits over the circuit board 538 and extends from connector 524 to the adapter 516 as shown in FIG. 20B. In this example, the sleeve 552 may be coupled to the adapter 516 via a threaded connection via the threaded protruding portion of the adapter 516 and a threaded interior portion of the sleeve 552. But this threading arrangement may be reversed and/or replaced by other means (e.g., friction fit, etc.)

In this exemplary embodiment, the use of the adapter 516 and sleeve 552 helps to reduce the impact to the circuit board 538 when the antenna assembly 500 is dropped as the adapter 516 helps loads/force to the sleeve 552. In this exemplary way, the circuit board 538 can be protected from damage that might otherwise occur when the antenna assembly 500 is dropped.

In alternative embodiments, an antenna assembly may include a sheath 540, antenna coil form 544, and sleeve 552 made from a wide range of insulators/plastic materials for supporting the whole antenna structure. For example, an antenna assembly may be configured so as to be within a sheath where the interior of the antenna assembly is filled with air. In such example embodiment, the antenna's helical and linear radiators may be separated by a dielectric tubular member (e.g., straw, etc.) to prevent or at least inhibit direct electrical or galvanic contact between the helical and linear radiators. In such example, the antenna assembly may include at least one linear radiator aligned with or disposed at least partially along a longitudinal axis of at least one helical radiator. A dielectric tubular member may be disposed over the at least linear radiator. The at least one helical radiator may be external to the dielectric tubular member such that the dielectric tubular member prevents or at least inhibits direct electrical contact between the helical and linear radiators. A sheath may be disposed of the helical and linear radiators and dielectric tubular member. An interior of the sheath may be filled with air or other dielectric material. In alternative embodiments, an antenna assembly may not include any sheath.

FIGS. 24 through 35 provide analysis results measured for a prototype of the antenna assembly 500 shown in FIG. 17. These analysis results shown in FIGS. 24 through 35 are provided only for purposes of illustration and not for purposes of limitation.

More specifically, FIGS. 24 through 26 are exemplary line graphs illustrating return loss in decibels (dB) versus frequency in megahertz (MHz) measured for the antenna assembly 500. In FIG. 24, the coupling effect from the top suspended helical radiating element 508 and the antenna's resonance for the GPS band can be seen. The data shown in FIG. 25 was measured when the antenna assembly 500 was covered by the sheath 540 shown in FIG. 19 and illustrates the GPS resonance shift to lower frequency due to load by sheath 540. The data shown in FIG. 26 was measured when the antenna assembly 500 was in the hand held position. Generally, FIGS. 24 through 26 shows that the antenna assembly 500 is operable with relatively good/acceptable return loss and bandwidths for the UHF, 7-800, and GPS bands.

FIG. 27 is a table with performance summary data of measured efficiency and gain performance of the antenna assembly 500 shown in FIG. 17 (in free space) for the UHF, 7-800, and GPS bands. Generally, this performance summary data shows that the antenna assembly 500 has relatively good gain/efficiency for the UHF, 7-800, and GPS bands, including good open sky efficiency of 36% for the GPS band.

FIGS. 28 through 35 illustrate radiation patterns measured for the antenna assembly 500. The image at the center of each graph represents a device (e.g., two way radio, etc.) having the antenna assembly 500 mounted on top thereof. More specifically, FIGS. 28, 29, and 30 illustrate radiation patterns (azimuth plane) measured for the antenna assembly 500 in free space at UHF frequencies of 400 MHz, 470 MHz, and 520 MHz, respectively. FIGS. 31, 32, and 33 illustrate radiation patterns (azimuth plane) measured for the antenna assembly 500 in free space at frequencies of 764 MHz, 830 MHz, and 870 MHz, respectively, which are within the 7-800 MHz frequency band. FIGS. 34 and 35 illustrate radiation patterns (phi zero degree plane and phi ninety degree plane, respectively) measured for the antenna assembly 500 in free space at the GPS frequency of 1575 MHz. Generally, FIGS. 28 through 35 show the radiation patterns for the antenna assembly 500 at these various frequencies within the UHF, 7-800, and GPS bands and the good efficiency of the antenna assembly 500. Accordingly, the antenna assembly 500 has relatively broad bandwidths for the UHF, 7-800, and GPS bands and allows multiple operating bands for wireless communications devices.

FIGS. 36A and 36B illustrate another exemplary embodiment of an antenna assembly 600 embodying one or more aspects of the present disclosure. This exemplary embodiment has a design generally based on a monopole concept with multiple radiating elements.

As shown by FIGS. 36A and 36B, the antenna assembly 600 generally includes linear and helical radiators or radiating elements 604, 606, 608, and 612 coupled to a matching network 620 via an adapter 616 and contact spring 632. In this example, the linear radiators 604, 606 are located or suspended generally inside the helical radiators 608, 612. The linear radiators 604, 606 extend along and/or are aligned generally with the central longitudinal axes of the helixes of the helical radiators 608, 612.

FIG. 36A illustrates first and second spacers or insulators 607, 609 for mechanically coupling (e.g., affixes, attaches, etc.) the first and second linear radiators 604, 606 to the adapter 616 and each other. The first spacer 607 mechanically couples the first linear radiator 604 to the adapter 616. The second spacer 609 mechanically couples end portions of the first and second linear radiators 604, 606 together. In addition, the spacers 607, 609 are configured to prevent the first and second linear radiators 604, 606 from making direct galvanic contact with each other and from making direct galvanic contact with the helical radiators 608, 612. The use of the first and second linear radiators 604, 606 and spacers 607, 609 may allow the antenna assembly 600 to use a relatively small diameter helical radiator 608, which, in turn, may allow the antenna assembly 600 to be more flexible with a relatively thin profile.

The linear radiators 604, 606 may be disposed within a coil form similar to what is disclosed for other exemplary embodiments, such as coil form 744 (FIG. 45). The helical radiators 608, 612 may be disposed about the exterior of the coil form such that the linear radiators 604, 606 do not make direct galvanic contact with the helical radiators 608, 612. In operation, the helical radiators 608, 612 parasitically couple to the linear radiators 604, 606. The antenna assembly 600 terminates with a connector 624 (e.g., 50 Ohm connector, etc.) for connecting the antenna assembly 600 to a device similar to the manner in which the connector 524 connects to the device housing 528 in FIG. 18. When connected to a device, the antenna assembly 600 may depend to a ground plane of the device to excite.

As disclosed herein, this exemplary antenna assembly 600 is configured to be operable or to cover multiple frequency ranges or bands, including the VHF frequency band from about 136 MHz to about 174 MHz, the UHF frequency band from about 380 MHz to about 527 MHz, the 7-800 MHz frequency band from about 764 MHz to about 870 MHz, and the GPS frequency of 1575 MHz. The matching network 620 is operable to help broaden the bandwidth of the VHF band for resonance from 136 MHz to 174 MHz. Accordingly, the antenna assembly 600 is configured for at least quad band operation in this example.

With continued reference to FIGS. 36A and 36B, the helical radiators 608, 612 are dual pitch helical coil radiators or springs having narrower and wider pitch coils along their respective lower and upper portions. The helical radiator 608 has narrower and wider pitch coils 613, 614, respectively, along its respective upper and lower portions. The helical radiator 612 has narrower and wider pitch coils 615, 619, respectively, along its respective upper and lower portions.

The dual pitch helical radiating element 608 corresponds to the VHF band. The narrower or closer pitch of the upper coils 613 of the helical radiator 608 helps to increase the gain at lower frequency(ies), such as at 136 MHz. As shown in FIG. 37A, the total electrical length of the upper helical radiator 608 and the adaptor 616 is about one quarter wavelength (λ/4) for the VHF band.

Adding the dual pitch helical radiating element 612 at the bottom of the antenna assembly 600 allows the antenna assembly 600 to operate at UHF, 7-800 MHz, and GPS bands. The dual pitch helical radiator 612 is wound or disposed around a portion 617 of the adapter 616, and makes metal contact to the adaptor 616, such as, for example, by means of soldering. The narrow or close pitch coils 615 of the helical radiator 612 correspond to the UHF and 7-800 MHz bands. As shown in FIG. 37B, the electrical length of the narrow pitch helical radiator coils 615 is about one quarter wavelength (λ/4) for the UHF band and about one half wavelength (λ/2) for the 7-800 MHz band. The wide or loose pitch coils 619 of the bottom helical radiator 612 correspond to the 7-800 MHz and GPS bands. As also shown in FIG. 37B, the electrical length of the wide pitch helical radiator coils 619 is about one quarter wavelength (λ/4) for the 7-800 MHz band and about one half wavelength (λ/2) for the GPS band. Proper tuning at/of the close pitch coils 615 of the bottom helical radiating element 612 will help to broaden the bandwidth of the 7-800 MHz band with its second harmonic resonance at 7-800 MHz. The wide or loose pitch coils 619 of the bottom helical radiating element 612 creates another resonance at the GPS band with its second harmonic resonance frequency. The coils 615 and 619 of the bottom helical radiator 612 may be configured in various ways to obtain the same or similar results stated above. By way of example, the bottom helical radiating element 612 may comprise a helical spring in which the wire turning orientation of the coils 615 and 619 are both clockwise or both counterclockwise. Or, for example, the wire turning orientation of the coils 615 may be counterclockwise, while the wire turning orientation of the coil 619 may be clockwise. As a further example, the wire turning orientation of the coils 615 may be clockwise, while the wire turning orientation of the coil 619 may be counterclockwise.

In this example, the first linear radiator 604 (e.g., bottom suspended wire, etc.) is inside the helical radiating elements 608. The spacer/insulator 607 is between and separates the adaptor 616 and first linear radiator 604. With this configuration, the bottom helical radiating element 612 parasitically couples to the linear radiator 604. Indirectly, this coupling helps to shift the UHF and 7-800 MHz bands to lower frequencies and broadens the bandwidth for the 7-800 MHz band. The electrical length of the linear radiator 604 is about one quarters wavelength (λ/4) for the 7-800 MHz band. With the parasitic coupling, the combined electrical length of the linear radiator 604 and the narrow pitch coils 615 of the bottom helical radiating element 612 is about three quarter wavelength (3λ/4) for the 7-800 MHz frequency band as shown in FIG. 37A.

The second linear radiator 606 (e.g., top suspended wire, etc.) is above the first linear radiator 604 (e.g., bottom suspended wire, etc.). The spacer/insulator 609 is between and separates the first and second linear radiators 604, 606. This configuration indirectly creates a parasitic coupling between the first and second linear radiators 604, 606. Indirectly, this coupling increase the electrical length of the first or bottom linear radiator 604 to one quarter wavelength (λ/4) for the UHF band. The increased wavelength helps to improve the bandwidth of the UHF band of the antenna assembly (see FIG. 38).

With continued reference to FIGS. 36A and 36B, the helical radiator 608 in this exemplary embodiment is a dual pitch helical coil radiator or spring having narrower and wider pitch coils 613, 614, respectively, along the respective bottom and top portions of the helical radiator 612. In operation, the helical radiator 608 in this exemplary embodiment is more responsive at VHF band. Accordingly, multiple resonant frequencies are excited by the interaction of the dual pitch helical radiator 608 and parasitic linear radiators 604, 606. Indirectly, this coupling helps to maintain the resonant frequencies of UHF band. As shown in FIG. 37B, the overall electrical length of the helical radiator 608 is about one quarter wavelength (λ/4) for the UHF band.

Multiple wavelengths are introduced by the linear and helical radiators 604, 606, 608, and 612, including the VHF, UHF, 7-800 MHz, and GPS bands. Also, the coupling of these radiators 604, 606, 608, and 612 allows the antenna assembly 600 to have an omnidirectional radiation pattern across the VHF, UHF, and 7-800 MHz frequency bands as can be seen in FIGS. 40 through 42.

In exemplary embodiments, the linear radiators 604, 606 may comprise flexible electrically conducting wires or cables. Examples of electrically conductive wires or cables that may be used as the linear radiators 604, 608 include a speedometer cable, nickel titanium (NiTi) wire, among other suitable cables or wires. Other electrically conductive materials and/or configurations may also be used for the linear radiators 604, 608.

A wide range of electrically conducting materials, preferably highly conductive materials, may be used for the helical radiators 608, 612. By way of example, the helical radiators 608, 612 may be formed from copper wire, spring wire, copper/tin/nickel plating wire, enameled wire, among other materials that may be configured to have the helical/spring configuration shown in FIG. 36A. In addition, the coils of the helical radiators 608, 612 are configured (e.g., dual pitch, spacing, size, shape, etc.) in this example embodiment for the specific frequency bands disclosed herein. Alternative embodiments may be configured for use with additional and/or different frequencies such as by varying the windings of the helical radiator coils. For example, other embodiments may include one or more helical radiators having coils with a constant pitch or with more than two different pitches and/or with a tapering pitch such that the coil has an upper or lower section wider than the other section.

The matching network 620 of the antenna assembly 600 may be identical or substantially similar to the matching network 120 shown in FIGS. 8A and 8B and described above. Or, for example, the matching network 620 of the antenna assembly 600 may be identical or substantially similar to the matching network 520 shown in FIGS. 23A and 23B and described above. Alternative matching networks may also be used besides those shown in FIGS. 8A, 8B, 23A, and 23B.

In this exemplary embodiment, the matching network 620 comprises lumped components residing on front and back oppositely facing surfaces of a printed circuit board 638. As shown in FIG. 36B, the matching network 620 is part of the antenna assembly 600 rather than the device to which the antenna assembly 600 will be connected. Accordingly, the antenna assembly 600 does not have to rely upon a matching network that is part of or internal to the device as the antenna assembly 600 instead includes its own (e.g., embedded, etc.) matching network 620. Placing circuit board 638 and matching network 620 in the antenna assembly 600 and external to the device housing allows more volume in the wireless device for other components, such as for increased circuitry to further enhance performance of the wireless device.

The matching network 620 may comprise one or more shunt or series capacitors and/or one or more shunt or series inductors depending on the matching network topology. For example, the matching network circuit board may comprise, for example, a two-element L shaped network of a capacitor and shunt inductor. Additionally, or alternatively, the circuit board may also include other capacitors, inductors, resistors, or the like, as well as conductive traces. In operation, the matching network 620 may provide broadband impedance matching by generally providing a 50 ohm load across the operating frequencies of interest. The printed circuit board 638 and lumped components thereon that provide the impedance matching of the matching network 620 may be configured such that they will be contained within or under a sheath or radome such as the sheet 740 as shown in FIG. 46B.

In this particular example, the connector 624 of the antenna assembly 600 is a 50 ohm connector and is illustrated as a threaded connection. Alternative connectors may be used in other embodiments including a snap fit connection, etc. The antenna assembly 600 may be threadedly connected to a device housing such that the bulk of the antenna assembly or unit 600 is external to the device housing. That is, the radiating elements 604, 606, 608, 612 and circuit board 638 having the matching network 620 of the antenna assembly 600 are able to be entirely contained within or under the sheath and remain external to the wireless device housing. Thus, the antenna assembly 600 is able to provide multiband operation in the VHF, UHF, 7-800, and GPS frequency bands without having to significantly increase the overall size or volume of the wireless device housing.

FIGS. 36A and 36B illustrates an exemplary manner by which the antenna assembly 600 and its various components may be assembled together. By way of example only, the antenna assembly 600 may have some components similar or identical to the corresponding components of another antenna assembly, such as the sheath 740, coil form 744 (e.g., insert molded coil form, etc.), contact 756 (e.g., contact pin, etc.), and insulator 760 of antenna assembly 700.

As shown in FIGS. 36A and 36B, the helical radiator 612 is wound or disposed around the portion 617 of the adapter 616, and makes metal contact to the adaptor 616, such as, for example, by means of soldering. And also, the helical radiator 612 may be wound or disposed around the sleeve 652 (e.g., tubular premold, etc.). The lower wider pitch coils 619 of the helical radiator 612 are positioned in grooves along the exterior or outer surface of the sleeve 652 (e.g., tubular premold, etc.). The upper narrower pitch coils 615 of the helical radiator 612 are wound or disposed around the portion 617 of the adapter 616. In some exemplary embodiments, a coil form (e.g., coil form 744, etc.) may be disposed over the linear radiators 604, 606. In such embodiments, the coils 613, 614 of the helical radiator 608 may be positioned in grooves along the exterior or outer surface of the coil form. In the assembled state, the helical radiators 608, 612 do not make direct galvanic contact with the linear radiators 604, 606, which contact is prevented or inhibited by the spacers 607, 609 and coil form.

The contact spring 632 includes a hook portion (e.g., J-shaped or L-shaped hook portion, etc.) that extends through an opening or hole in the circuit board 638, see for example FIGS. 8A and 8B or FIGS. 23A and 23B. The hook portion may terminate in a protrusion to provide additional resistance to pull through force tending to cause hook portion to pull out of the hole in the circuit board 638. The hook portion is sized to fit in and through the hole in the circuit board 638 to provide a mechanical connection between the circuit board 638 and the adapter 616. For example, the coils of the spring contact 632 may be wrapped or wound about a portion of the adapter 616.

Electrical connection may be made by various means to connect conductive traces on the circuit board 638 with the spring contact 632, such as by soldering, a press fit connection, a stamped metal connection, etc. In this example embodiment, the contact spring 632 is shown as a separate component, but in other embodiments the contact spring 632 may comprise an integral piece or extension of the bottom helical radiating element 612.

An insulator may electrically insulates a contact (e.g., contact pin, etc.) from the connector 624. The contact may be connected to the circuit board 638, which is coupled to the adapter 616 within the tubular sleeve 652. Radio frequency power from a wireless device (e.g., two-way radio, etc.) may be provided to the antenna assembly 600 by the contact through the circuit board 638 when the antenna assembly 600 is threadedly connected to the device housing (see, e.g., FIG. 18). The connector or contact is coupled to the circuit board 638, such as by a soldered connection, a press fit connection, a snap fit connection, a crimp connection, etc. The circuit board 638 is coupled to the adapter 616 via the contact spring 632. Accordingly, the contact may thus provide radio frequency power to the linear radiator through circuit board 638, spring contact 632, and adapter 616.

With continued reference to FIGS. 36A and 36B, the sleeve 652 fits over the circuit board 638 and extends from connector 624 to the adapter 616. In this example, the sleeve 652 may be coupled to the adapter 616 via a threaded connection via the threaded protruding portion of the adapter 616 and a threaded interior portion of the sleeve 652. But this threading arrangement may be reversed and/or replaced by other means (e.g., friction fit, etc.)

In this exemplary embodiment, the use of the adapter 616 and sleeve 652 helps to reduce the impact to the circuit board 638 of the matching network 620 if the antenna assembly 600 is dropped, as the adapter 616 helps loads/force to the sleeve 652. In this exemplary way, the circuit board 638 can be protected from damage that might otherwise occur when the antenna assembly 600 is dropped.

In alternative embodiments, an antenna assembly may include a sheath, antenna coil form, and sleeve 652 made from a wide range of insulators/plastic materials for supporting the whole antenna structure. For example, an antenna assembly may be configured so as to be within a sheath where the interior of the antenna assembly is filled with air. In such example embodiment, the antenna's helical and linear radiators may be separated by a dielectric tubular member (e.g., straw, etc.) to prevent or at least inhibit direct electrical or galvanic contact between the helical and linear radiators. In such example, the antenna assembly may include at least one linear radiator aligned with or disposed at least partially along a longitudinal axis of at least one helical radiator. A dielectric tubular member may be disposed over the at least linear radiator. The at least one helical radiator may be external to the dielectric tubular member such that the dielectric tubular member prevents or at least inhibits direct electrical contact between the helical and linear radiators. A sheath may be disposed of the helical and linear radiators and dielectric tubular member. An interior of the sheath may be filled with air or other dielectric material. In alternative embodiments, an antenna assembly may not include any sheath.

FIGS. 38 through 43 provide analysis results measured for a prototype of the antenna assembly 600 shown in FIG. 36A. These analysis results shown in FIGS. 38 through 43 are provided only for purposes of illustration and not for purposes of limitation.

More specifically, FIG. 38 is an exemplary line graph illustrating return loss in decibels (dB) versus frequency in megahertz (MHz) measured for the antenna assembly 600 in a hand held position. Generally, FIG. 38 shows that the antenna assembly 600 is operable with relatively good/acceptable return loss and bandwidths for the VHF, UHF, 7-800, and GPS bands.

FIG. 39 includes tables with measured efficiency and gain in decibels (dB) for the antenna assembly 600 for the VHF band (azimuth plane—hand held position) and for the UHF, 7-800, and GPS bands (in free space and hand held position). Generally, this performance summary data shows that the antenna assembly 600 has relatively good gain/efficiency for the UHF, 7-800, and GPS bands.

FIGS. 40 through 43 illustrate radiation patterns measured for the antenna assembly 600. The image at the center of each graph represents a device (e.g., two way radio, etc.) having the antenna assembly 600 mounted on top thereof. More specifically, FIG. 40 illustrate radiation patterns (azimuth plane) measured for the antenna assembly 600 in a hand held position at a VHF frequency of 155 MHz. FIG. 41 illustrates a radiation patterns (azimuth plane) measured for the antenna assembly 600 in free space and handheld at a UHF frequency of 470 MHz. FIG. 42 illustrate a radiation pattern (azimuth plane) measured for the antenna assembly 600 in free space and hand held at a frequency of 806 MHz, which is within the 7-800 MHz frequency band. FIG. 43 illustrates a radiation patterns (phi zero degree plane) measured for the antenna assembly 600 in free space and hand held at the GPS frequency of 1575 MHz. Generally, FIGS. 40 through 43 show the radiation patterns for the antenna assembly 600 at these various frequencies within the VHF, UHF, 7-800, and GPS bands and the good efficiency of the antenna assembly 600. Accordingly, the antenna assembly 600 has relatively broad bandwidths for the VHF, UHF, 7-800, and GPS bands and allows multiple operating bands for wireless communications devices.

In this exemplary embodiment, the antenna assembly 600 may thus be configured to achieve multiband operation for frequencies associated with or falling within the VHF band from 136 MHz to 174 MHz, the entire UHF band from 380 MHz to 527 MHz, 7-800 MHz frequency band from 764 MHz to 870 MHz), and a GPS frequency of 1575 MHz. The antenna assembly 600 may be configured to achieve this multiband operation with a voltage standing wave ratio (VSWR) less than three, relatively good gain and efficiency for wireless applications while having a relatively thin profile.

FIG. 44 illustrates another exemplary embodiment of an antenna assembly 700 embodying one or more aspects of the present disclosure. This exemplary embodiment has a design generally based on a monopole concept with multiple radiating elements.

As shown in FIG. 44, the antenna assembly 700 generally includes linear and helical radiators or radiating elements 704, 708, and 712 coupled to a matching network 720 via an adapter 716 and contact spring 732. In this example, the linear radiator 704 is a top loaded conducting wire located generally inside the helical radiators 708, 712. The linear radiator 704 extends along and/or is aligned generally with the central longitudinal axes of the helixes of the helical radiators 708, 712. As shown in FIGS. 45 and 46B, the linear radiator 704 is disposed within a coil form 744. As shown in FIG. 46B, the helical radiator 712 is disposed about the exterior of the coil form 744 and within the antenna sheath or radome 740, such that the helical radiator 712 does not make direct contact with the linear radiator 704, helical radiator 708, and adaptor 716. In operation, the helical radiators 708, 712 parasitically couple to the linear radiator 704. The antenna assembly 700 terminates with a connector 724 (e.g., 50 Ohm connector, etc.) for connecting the antenna assembly 700 to a device similar to the manner in which the connector 524 connects to the device housing 528 in FIG. 18. When connected to a device, the antenna assembly 700 may depend to a ground plane of the device to excite.

As disclosed herein, this exemplary antenna assembly 700 is configured to be operable or to cover multiple frequency ranges or bands, including the VHF frequency band from about 136 MHz to about 174 MHz, the UHF frequency band from about 380 MHz to about 527 MHz, the 7-800 MHz frequency band from about 764 MHz to about 870 MHz, and the GPS frequency of 1575 MHz. Accordingly, the antenna assembly 700 is configured for at least quad band operation in this example.

As shown in FIGS. 45 and 49, the linear radiator 704 includes electrically conductive wire 706 (broadly, a first conductor) and a top loaded element 711 (broadly, a second conductor) at or towards the end of the electrically conductive wire 706. By way of example, the first conductor 706 of the linear radiator 704 may be formed from the electrically conducting wire at the center core of a coaxial cable. The top loaded element or second conductor 711 of the linear radiator 704 may comprise the braid soldered at the end of the coaxial cable 709. Accordingly, the braid of the coaxial cable may work as the second conductor 711, while the center core of the coaxial cable works as the first conductor 706. The coaxial cable's dielectric insulator 705 between the core and braid will operate to prevent direct contact therebetween.

In this example, the antenna design is based on a quarter-wave length for low band and high band. The linear radiator 704 corresponds to the UHF and 7-800 MHz frequency bands. As shown in FIG. 47C, the electrical length of the first conductor 706 of the linear radiator 704 is about one quarter wavelength ($\lambda/4$) for the 7-800 MHz band. With the parasitic coupling, the combined electrical length of the first conductor 706 and the second conductor 711 is about one quarter wavelength ($\lambda/4$) for the UHF band as also shown in FIG. 47C. The helical radiating element 708 (e.g., dual pitch spring coil, etc.) corresponds to the VHF and UHF bands. As shown in FIG. 47A, the electrical length of the helical radiator 708 is about one quarter wavelength ($\lambda/4$) for the VHF band, and the electrical length of the wider pitch coils 714 of the helical radiator 708 is about one quarter wavelength ($\lambda/4$) for the UHF band.

The bottom helical radiating element 712 (e.g., bottom suspended coil, etc.) corresponds to the 7-800 MHz band and is resonant from about 764 MHz to about 870 MHz when parasitically coupled to the linear radiator 704. In operation (see FIG. 52), the bottom helical radiating element 712 parasitically couples to the first conductor 706 (e.g., inner electrically conducting wire, etc.) of linear radiator 704 to maintain and/or broaden the bandwidth for the UHF band to be resonant from about 380 MHz to about 527 MHz (see FIG. 52). Indirectly, the parasitic coupling of the bottom helical radiating element 712 and the first conductor 706 has a combined electrical length of about one quarter wavelength (λ/4) for the UHF band as shown in FIG. 47B. Parasitic coupling of the bottom helical radiating element 712 and the second conductor 711 of the linear radiator 704 broadens the bandwidth of the 7-800 MHz band by introducing proximity resonance to the dominant resonance near 800 MHz. Accordingly, the parasitic coupling of the bottom helical radiating element 712 and the second conductor 711 has a combined electrical length of about three quarters wavelength (3λ/4) for the 7-800 MHz band as shown in FIG. 47B.

The matching network 720 is operable to help broaden the bandwidth of the VHF band for resonance from 136 MHz to 174 MHz. The matching network 740 also introduces resonance at a GPS frequency of about 1575 MHz when it loads with an adaptor on the top. Multiple wavelengths are introduced by the linear and helical radiators 704, 708, 712. In this exemplary embodiment, the matching network 720 couples with the bottom helical radiating element 712, helical radiator 708, and the linear radiator 704 to maintain the GPS frequency.

In this example, the first conductor 706 is the center conductor of a conducting wire formed as a radiating element for high band (7-800 MHz in this example). The first and second conductors 706, 711 are galvanically coupled or connected (e.g., soldered, etc.) to each other at the top or end 709 of the linear radiator 704 as shown in FIG. 49. This configuration of the first and second conductors 706, 711 introduces a capacitance coupling to the antenna assembly 700 and creates another resonance for high band for the antenna assembly 700 at the UHF frequency band. The two conductor elements 706 and 711 also couple to each other such that the antenna assembly 700 is capable of simultaneously operating at the UHF band and 7-800 MHz frequency band at the same time.

With reference to FIG. 47B, the electrical length of the first conductor 706 is about one quarter wavelength (λ/4) for the 7-800 MHz frequency band. The electrical length is about one quarter wavelength (λ/4) for the UHF band when the first and second conductors 706, 711 are connected. In operation, the first conductor 706 introduces a single band resonance frequency for the 7-800 MHz frequency band, while the combination of the first and second conductors 706, 711 and matching network 720 introduce dual frequency resonance for the UHF and 7-800 MHz frequency bands. A loading gap 707 (FIG. 49) between the first and second conductors 706, 711 changes the frequency ratio for the UHF band and 7-800 MHz frequency band and/or helps fine tune the frequency ratio between the UHF band and 7-800 MHz frequency band.

Alternative embodiments may include linear radiators having first and second conductors configured differently, including conductors formed from different materials other than coaxial cables and/or soldered braids at the end of the coaxial cables. Other exemplary embodiments may include a flexible electrically conducting wire or cable as the first conductor with a metal tube as the second conductor, which is crimped or soldered to the end of the wire or cable. In these example embodiments, an insulator jacket may be disposed or sandwiched between the metal tube and electrically conductive wire or cable. Examples of electrically conductive wires or cables that may be used include a speedometer cable, nickel titanium (NiTi) wire, among other suitable cables or wires.

In addition, other electrically conductive materials and/or configurations may be used for the first and/or second conductors of the linear radiator. For example, the second conductor may be formed from a spring or single wire instead of a soldered coaxial cable braid or metal tube. To this end, FIGS. 50 and 51 illustrate further examples of linear radiators 804 and 904, respectively, that may be used with the antenna assembly 700 with similar results in antenna performance.

As shown in FIG. 50, the linear radiator 804 includes a first conductor 806 and a second conductor 811 connected to each other at or towards the top or end 809 of the first conductor 806. In this example, the second conductor 811 is a single straight portion of electrically conductive wire that extends parallel to and back along the first conductor 806.

As shown in FIG. 51, the linear radiator 904 includes a first conductor 906 and a second conductor 911 connected to each other at or towards the top or end 909 of the first conductor 906. In this example, the second conductor 911 is a spring or helical conductor that extends back along the first conductor 906 such that the coils of the spring 911 coil or wind generally about the length of the first conductor 906.

With continued reference to FIGS. 44 and 45, the helical radiator 708 in this exemplary embodiment is a dual pitch helical coil radiator or spring having narrower and wider pitch coils 713, 714, respectively, along the respective bottom and top portions of the helical radiator 712. In operation, the lower coils 714 having the wider pitch are more responsive and resonant at the UHF band and are approximately equivalent to one quarter wavelength (λ/4) for the UHF band frequencies. The upper coils 713 having the narrower or closer pitch are operable for introducing another resonance at the VHF band.

A wide range of electrically conducting materials, preferably highly conductive materials, may be used for the helical radiators 708 and 712. By way of example, the helical radiators 708 and/or 712 may be formed from copper wire, spring wire, copper/tin/nickel plating wire, enameled wire, among other materials that may be configured to have the helical/spring configuration shown in FIG. 44. In addition, the coils of the helical radiators 708 and 712 are configured (e.g., dual pitch, spacing, size, shape, etc.) in this example for specific frequency bands. Alternative embodiments may be configured for use with additional and/or different frequencies such as by varying the windings of the helical radiator coils. For example, other embodiments may include one or more helical radiators having coils with a constant pitch or with more than two different pitches and/or with a tapering pitch such that the coil has an upper or lower section wider than the other section. In addition, FIG. 48 illustrates examples of flat pattern profiles that may be used for the helical radiating element 712 before it is wrapped or coiled.

In operation, the bottom helical radiating element 712 is responsive and resonant at the 7-800 MHz frequency band. The electrical length of the bottom helical radiating element 712 is approximately equivalent to one quarter wavelength (λ/4) for the 7-800 MHz band frequencies (FIG. 47B). The bottom helical radiating element 712 may also introduce a second harmonic frequency for the GPS band. And, the electrical length of the bottom helical radiating element 712 may be approximately equivalent to one half wavelength (λ/2) for GPS band frequencies. In operation, the bottom helical radiating element 712 couples parasitically to the gap 707 of the top loaded conducting wire 704. This coupling shifts the resonance of 7-800 MHz to a lower frequency while the UHF band resonance is maintained, such that the UHF and GPS bands resonate at the same time. The bottom helical radiating element 712 helps to fine tune the 7-800 MHz band. Also, coupling between the bottom helical radiator 712 and second linear radiator 711 of the top loaded conducting wire 704 also increases the UHF electrical length such that electrical length of the entire antenna is approximately equivalent to one quarter wavelength (λ/4) for the UHF frequencies.

Multiple wavelengths are introduced by the linear and helical radiators 704, 708, and 712, including the VHF, UHF, 7-800, and GPS bands. Also, the coupling of these radiators 704, 708, and 712 allows the antenna assembly 700 to have an omnidirectional radiation pattern across the VHF, UHF, and 7-800 MHz frequency bands as can be seen in FIGS. 54 through 60. Also, the linear radiator's first conductor 706 and second conductor 711 also helps to tilt up the GPS radiation pattern (FIGS. 61 and 62) such that the antenna assembly 700 achieves more than 35% of open sky efficiency (FIG. 53) for the GPS band in this example embodiment.

The matching network 720 of the antenna assembly 700 may be identical or substantially similar to the matching network 120 shown in FIGS. 8A and 8B and described above. Or, for example, the matching network 720 of the antenna assembly 700 may be identical or substantially similar to the matching network 520 shown in FIGS. 23A and 23B and described above. Alternative matching networks may also be used besides those shown in FIGS. 8A, 8B, 23A, and 23B.

In this exemplary embodiment, the matching network 720 comprises lumped components residing on front and back oppositely facing surfaces of a printed circuit board 738. As shown in FIGS. 44 and 46B, the matching network 720 and circuit board 738 are part of the antenna assembly 700 rather than the device to which the antenna assembly 700 will be connected. Accordingly, the antenna assembly 700 does not have to rely upon a matching network that is part of or internal to the device as the antenna assembly 700 instead includes its own (e.g., embedded, etc.) matching network 720. Placing circuit board 738 and matching network 720 in the antenna assembly 700 and external to the device housing allows more volume in the wireless device for other components, such as for increased circuitry to further enhance performance of the wireless device.

The matching network 720 may comprise one or more shunt or series capacitors and/or one or more shunt or series inductors depending on the matching network topology. For example, the matching network circuit board may comprise, for example, a two-element L shaped network of a capacitor and shunt inductor. Additionally, or alternatively, the circuit board may also include other capacitors, inductors, resistors, or the like, as well as conductive traces. In operation, the matching network 720 may provide broadband impedance matching by generally providing a 70 ohm load across the operating frequencies of interest. The printed circuit board 738 and lumped components thereon that provide the impedance matching of the matching network 720 may be configured such that they will be contained within or under a sheath or radome 740 as shown in FIGS. 46A and 46B.

In this particular example, the connector 724 of the antenna assembly 700 is a 50 ohm connector and is illustrated as a threaded connection. Alternative connectors may be used in other embodiments including a snap fit connection, etc. The antenna assembly 700 may be threadedly connected to a device housing such that the bulk of the antenna assembly or unit 700 is external to the device housing. That is, the radiating elements 704, 708, 712 and circuit board 738 having the matching network 720 of the antenna assembly 700 are able to be entirely contained within or under the sheath 740 (FIGS. 46A and 46B) and remain external to the wireless device housing. Thus, the antenna assembly 700 is able to provide multiband operation in the VHF, UHF, 7-800, and GPS frequency bands without having to significantly increase the overall size or volume of the wireless device housing.

By way of example only, the sheath 740 may have a length of about 200 millimeters and a diameter of about 14.5 millimeters along the portion disposed over the connector 724. The numerical dimensions in this paragraph (as are all dimensions herein) are provided for illustrative purposes only, as the sheath and antenna components may be sized differently than disclosed herein depending on the particular frequencies desired or intended end use of the antenna assembly.

The sheath 740 may be overmolded or constructed via other suitable processes. For space considerations, the sheath 740 generally conforms to the outermost shape of the coils of the helical radiators 708, 712.

FIGS. 45, 46A, and 46B illustrate an exemplary manner by which the antenna assembly 700 and its various components may be assembled together. As shown in FIG. 46B, the radiating elements 704, 708, 712, connector 724, and the circuit board 738 may be coupled and assembled under the sheath 740 using the adapter 716, spring contact or contact spring 732, coil form 744 (e.g., insert molded coil form, etc.), sleeve 752 (e.g., tubular premold, etc.), contact 756 (e.g., contact pin, etc.), and insulator 760.

The helical radiator 708, 712 may be wound or disposed around the coil form 744. The coils of the helical radiator 708 are positioned in grooves (FIG. 45) along the outer or exterior surface of the coil form 744 shown in FIG. 46B. The coils of the bottom helical radiator 712 are also wound or disposed around a portion of the adapter 716 without direct galvanic contact to the adapter 716. The coil form 744 is disposed over the top loaded conducting wire 704 as shown in FIG. 46B. In this assembled state, the helical radiators 708, 712 do not make direct galvanic contact with the top loaded conducting wire 704.

The contact spring 732 includes a hook portion (e.g., J-shaped or L-shaped hook portion, etc.) that extends through an opening or hole in the circuit board 738, see for example FIGS. 8A and 8B or FIGS. 23A and 23B. The hook portion may terminate in a protrusion to provide additional resistance to pull through force tending to cause hook portion to pull out of the hole in the circuit board 738. The hook portion is sized to fit in and through the hole in the circuit board 738 to provide a mechanical connection between the circuit board 738 and the adapter 716. For example, the coils of the spring contact or contact spring 732 may be wrapped or wound about a portion of the adapter 716.

Electrical connections may be made by various means to connect conductive traces on the circuit board 738 with the contact spring 732, such as by soldering, a press fit connection, a stamped metal connection, etc. In this example embodiment, the contact spring 732 is shown as a separate component, but in other embodiments the contact spring 732 may comprise an integral piece.

With continued reference to FIGS. 45 and 46B, the insulator 760 electrically insulates the contact 756 (e.g., contact pin, etc.) from the connector 724. The contact 756 is connected to the circuit board 738, which is coupled to the adapter 716 within the tubular sleeve 752.

Radio frequency power from a wireless device (e.g., two-way radio, etc.) may be provided to the antenna assembly 700 by the contact 756 through the circuit board 738 when the antenna assembly 700 is threadedly connected to the device housing (see, e.g., FIG. 18). The connector or contact 756 is coupled to the circuit board 738, such as by a soldered connection, a press fit connection, a snap fit connection, a crimp connection, etc. The circuit board 738 is coupled to the adapter 716 via the contact spring 732. Accordingly, the contact 756 provides radio frequency power to the radiators 704, 708 through the circuit board 738, contact spring 732, and adapter 716.

The sleeve 752 fits over the circuit board 738 and extends from connector 724 to the adapter 716 as shown in FIG. 46B. In this example, the sleeve 752 may be coupled to the adapter 716 via a threaded connection via the threaded protruding portion of the adapter 716 and a threaded interior portion of the sleeve 752. But this threading arrangement may be reversed and/or replaced by other means (e.g., friction fit, etc.)

In this exemplary embodiment, the use of the adapter 716 and sleeve 752 helps to reduce the impact to the circuit board 738 when the antenna assembly 700 is dropped, as the adapter 716 helps loads/force to the sleeve 752. In this exemplary way, the circuit board 738 can be protected from damage that might otherwise occur when the antenna assembly 700 is dropped.

In alternative embodiments, an antenna assembly may include a sheath 740, antenna coil form 744, and sleeve 752 made from a wide range of insulators/plastic materials for supporting the whole antenna structure. For example, an antenna assembly may be configured so as to be within a sheath where the interior of the antenna assembly is filled with air. In such example embodiment, the antenna's helical and linear radiators may be separated by a dielectric tubular member (e.g., straw, etc.) to prevent or at least inhibit direct electrical or galvanic contact between the helical and linear radiators. In such example, the antenna assembly may include at least one linear radiator aligned with or disposed at least partially along a longitudinal axis of at least one helical radiator. A dielectric tubular member may be disposed over the at least linear radiator. The at least one helical radiator may be external to the dielectric tubular member such that the dielectric tubular member prevents or at least inhibits direct electrical contact between the helical and linear radiators. A sheath may be disposed of the helical and linear radiators and dielectric tubular member. An interior of the sheath may be filled with air or other dielectric material. In alternative embodiments, an antenna assembly may not include any sheath.

FIGS. 52 through 62 provide analysis results measured for a prototype of the antenna assembly 700 shown in FIG. 44. These analysis results shown in FIGS. 52 through 62 are provided only for purposes of illustration and not for purposes of limitation.

More specifically, FIG. 52 is an exemplary line graph illustrating return loss in decibels (dB) versus frequency in megahertz (MHz) measured for the antenna assembly 700 in a hand held position. Generally, FIG. 52 shows that the antenna assembly 700 is operable with relatively good/acceptable return loss and bandwidths for the VHF, UHF, 7-800, and GPS bands.

FIG. 53 includes tables with measured efficiency and gain in decibels (dB) for the antenna assembly 700 for the VHF band (azimuth plane—hand held position) and for the UHF, 7-800, and GPS bands (in free space). Generally, this performance summary data shows that the antenna assembly 700 has relatively good gain/efficiency for the VHF, UHF, 7-800, and GPS bands, including good open sky efficiency of 37% for the GPS band, average total efficiency of more than 50% and near horizontal efficiency of 35% and higher.

Figure 54:
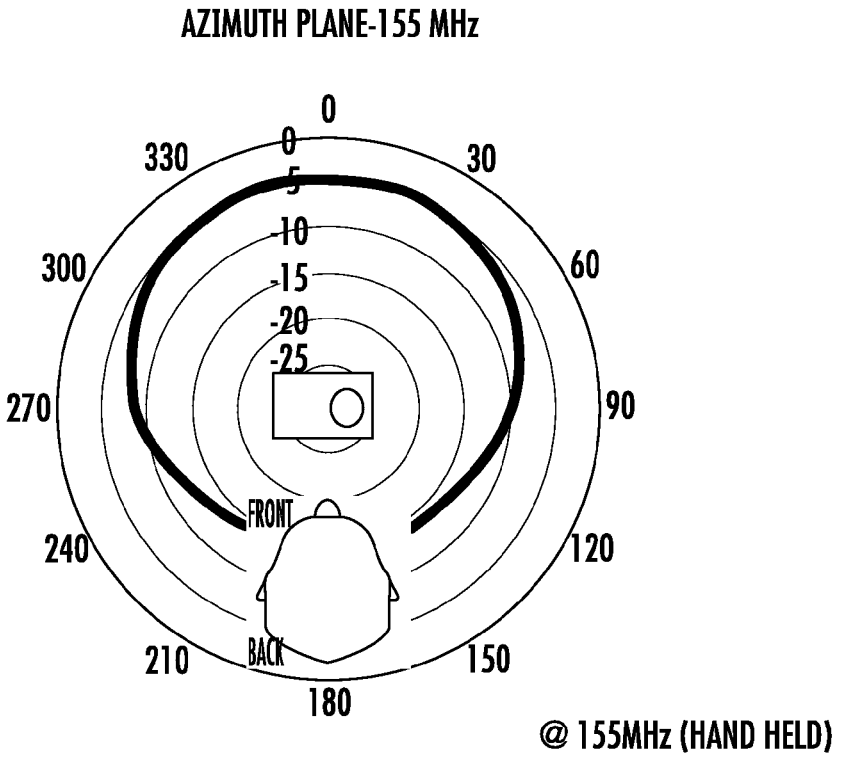
Figure 55:
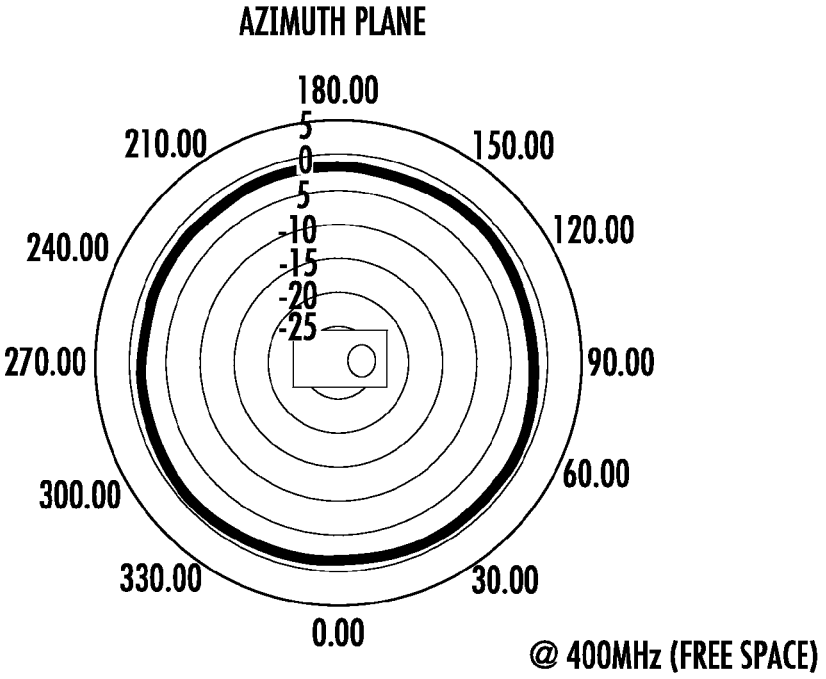
Figure 56:
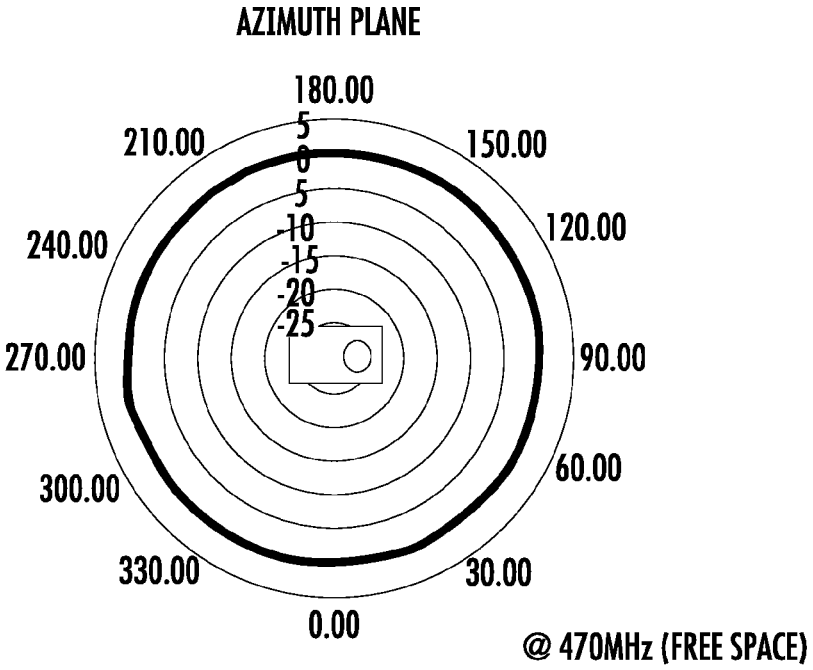
Figure 57:
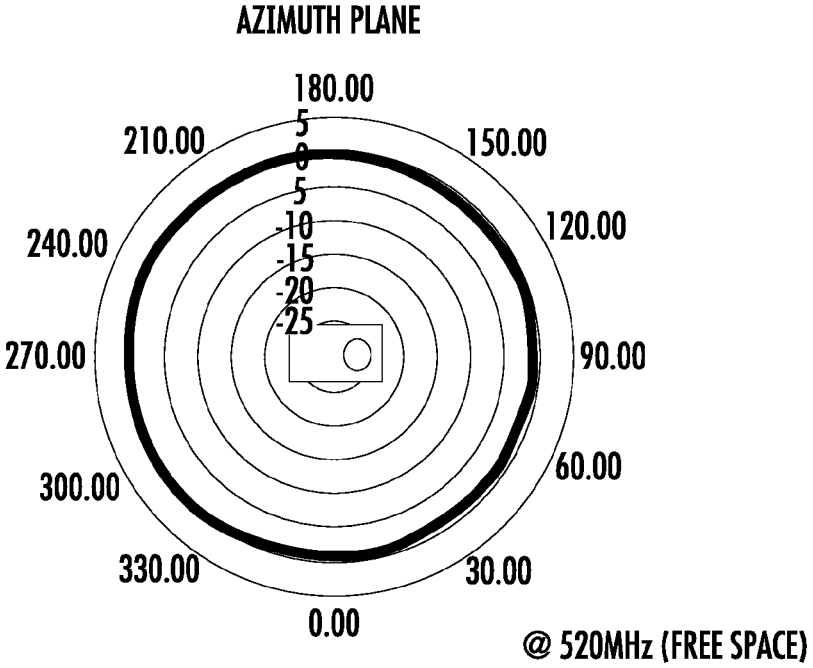
Figure 58:
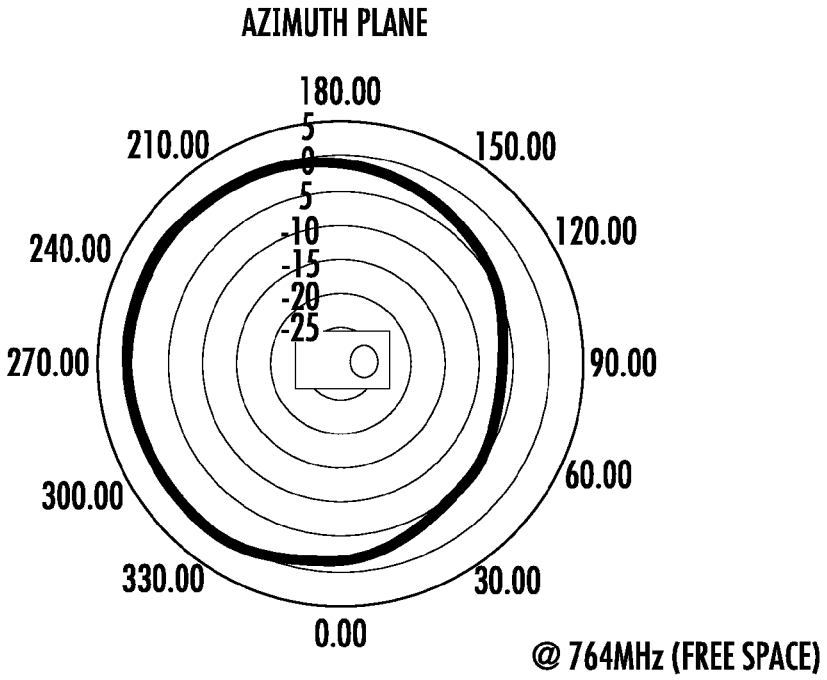

FIGS. 54 through 62 illustrate radiation patterns measured for the antenna assembly 700. The image at the center of each graph represents a device (e.g., two way radio, etc.) having the antenna assembly 700 mounted on top thereof. More specifically, FIG. 54 illustrate radiation patterns (azimuth plane) measured for the antenna assembly 700 in a hand held position at a VHF frequency of 155 MHz. FIGS. 55 through 57 illustrate radiation patterns (azimuth plane) measured for the antenna assembly 700 in free space at UHF frequencies of 400 MHz, 470 MHz, and 520 MHz. FIGS. 58 through 60 illustrate radiation patterns (azimuth plane) measured for the antenna assembly 700 in free space at frequencies of 764 MHz, 830 MHz, and 870 MHz, respectively, which are within the 7-800 MHz frequency band. FIGS. 61 and 62 illustrate radiation patterns (phi zero degree plane and phi ninety degree plane, respectively) measured for the antenna assembly 700 in free space at the GPS frequency of 1575 MHz. Generally, FIGS. 54 through 62 show the radiation patterns for the antenna assembly 700 at these various frequencies within the VHF, UHF, 7-800, and GPS bands and the good efficiency of the antenna assembly 700. Accordingly, the antenna assembly 700 has relatively broad bandwidths for the VHF, UHF, 7-800, and GPS bands and allows multiple operating bands for wireless communications devices.

In this exemplary embodiment, the antenna assembly 700 may thus be configured to achieve multiband operation for frequencies associated with or falling within the VHF band from 136 MHz to 174 MHz, the entire UHF band from 380 MHz to 527 MHz, 7-800 MHz frequency band from 764 MHz to 870 MHz), and a GPS frequency of 1575 MHz. The antenna assembly 700 may be configured to achieve this multiband operation with a voltage standing wave ratio (VSWR) less than three, relatively good gain and efficiency for wireless applications.

The various antenna assemblies (e.g., 100, 500, 600, 700, etc.) disclosed herein may be used with various wireless devices within the scope of the present disclosure. By way of example, the antenna assemblies disclosed herein may be mounted externally to the housing of a two way radio by means of the threaded portions as shown in the figures. The antenna assembly may be mounted in its own sheath or housing and have a connector (e.g., 50 ohm connector, etc.) for connecting to a connector within the housing of the two way radio, so as to depend to the device ground plane to excite. While described in connection with a two way radio, embodiments of the antenna assemblies disclosed herein should not be limited to use with only two way radios and/or to externally mounting via threaded connections as antenna assemblies disclosed herein may be used in conjunction with various electronic devices.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms (e.g., different materials may be used, etc.) and that neither should be construed to limit the scope of the disclosure. In some example embodiments, well-known processes, well-known device structures, and well-known technologies are not described in detail. In addition, advantages, and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values (e.g., frequency ranges, etc.) for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A multiband antenna assembly comprising:

at least one helical radiator having a longitudinal axis; and at least one linear radiator aligned with and/or disposed at least partially along the longitudinal axis of the at least one helical radiator;

whereby the antenna assembly is resonant in at least three frequency bands;

wherein:

the antenna assembly is resonant in an ultra high frequency (UHF) band from 380 MHz to 527 MHz, and a global positioning system (GPS) frequency band including a frequency of 1575 MHz; and the antenna assembly is also resonant in at least one of a very high frequency (VHF) band from 136 MHz to 174 MHz and/or a 7-800 MHz frequency band from 764 MHz to 870 MHz; and the antenna assembly is omnidirectional for at least one or more frequency bands, including the ultra high frequency (UHF) band from 380 MHz to 527 MHz wherein the at least one linear radiator comprises first and second linear radiators coupled by first and second dielectric spacers such that the first and second linear radiators are not galvanically coupled to each other and such that the first and second linear radiators extend through one or more coils of the at least one helical radiator without galvanically coupling to the at least one helical radiator;

wherein the at least one helical radiator includes:

a first dual pitch helical coil radiator having an upper portion and a lower portion, the lower portion having wider pitch coils than the upper portion; and a second dual pitch helical coil radiator having an upper portion and a lower portion, the lower portion having wider pitch coils than the upper portion;

wherein:

the first dual pitch helical coil radiator corresponds to the VHF band and has an electrical length of about one quarter wavelength (λ/4) for the VHF band;

the upper narrower pitch coils of the first dual pitch helical coil radiator are operable for helping to increase gain at lower frequency and for introducing another resonance at the VHF band;

the upper narrow pitch coils of the second dual pitch helical coil radiator correspond to the UHF and 7-800 MHz with its second harmonic resonance frequency;

the lower wider pitch coils of the second dual pitch helical coil radiator provide another resonance at 7-800 MHz and GPS band with its second harmonic resonance frequency;

the second dual pitch helical coil radiator parasitically couples to the first linear radiator such that the combined electrical length of the first linear radiator and second dual pitch helical coil radiator is about three quarters wavelength (3λ/4) for the 7-800 MHz frequency band; and the first linear radiator parasitically couples to the second linear radiator such that the first linear radiator has an electrical length of about one quarter wavelength (λ/4) for the UHF band.

2. The antenna assembly of claim 1, wherein the antenna assembly is resonant in at least four frequency bands including:

a very high frequency (VHF) band from 136 MHz to 174 MHz; and an ultra high frequency (UHF) band from 380 MHz to 527 MHz; and a 7-800 MHz frequency band from 764 MHz to 870 MHz; and a global positioning system (GPS) frequency band including a frequency of 1575 MHz.

3. The antenna assembly of claim 1, wherein:

the first dielectric spacer mechanically couples the first linear radiator to another portion of the antenna assembly;

the second dielectric spacer mechanically couples end portions of the first and second linear radiators together; and the antenna assembly is configured such that during operation the first and second linear radiators parasitically couple to each other and to the first and second helical radiators.

4. The antenna assembly of claim 1, wherein the antenna assembly is omnidirectional for at least one of a very high frequency (VHF) band from 136 MHz to 174 MHz and/or a 7-800 MHz frequency band from 764 MHz to 870 MHz.

5. A multiband antenna assembly comprising:

at least one helical radiator having a longitudinal axis; and at least one linear radiator aligned with and/or disposed at least partially along the longitudinal axis of the at least one helical radiator;

wherein:

the at least one helical radiator comprises a dual pitch helical coil radiator that includes an upper portion and a lower portion, the lower portion having wider pitch coils than the upper portion; and the at least one linear radiator includes a first conductor and a second conductor along an end portion thereof, the first and second conductors extending through one or more coils of the dual pitch helical coil radiator;

whereby the antenna assembly is resonant in at least three frequency bands, including a very high frequency (VHF) band from 136 MHz to 174 MHz, an ultra high frequency (UHF) band from 380 MHz to 527 MHz, and a global positioning system (GPS) frequency band including a frequency of 1575 MHz; and wherein the antenna assembly is configured such that:

the dual pitch helical coil radiator has a total electrical length of about one quarter wavelength (λ/4) for the VHF band;

the lower, wider pitch portion of the dual pitch helical coil radiator has an electrical length of about one quarter wavelength (λ/4) for the UHF band;

the first and second conductors have a combined electrical length of about one quarter wavelength (λ/4) for the UHF band; and the second conductor has an electrical length of about one quarter wavelength (λ/4) for the GPS band.

6. The antenna assembly of claim 5, wherein the first conductor comprises an electrically conducting wire, and wherein the second conductor comprises an electrically conducting element along an end portion of the electrically conducting wire.

7. The antenna assembly of claim 5, wherein:

the first conductor comprises a center core of a coaxial cable, the second conductor comprises a braid soldered at an end of the coaxial cable, and an insulator of the coaxial cable inhibits direct contact between the first and second conductors; or the first conductor comprises an electrically conductive wire or cable, the second conductor comprises a metal tube crimped or soldered at an end portion thereof, and an insulator jacket is between the metal tube and electrically conductive wire or cable; or the second conductor comprises a single wire or spring.

8. The antenna assembly of claim 5, wherein the first and second conductors are galvanically coupled such that the electrical connection between the first and second conductors allows the antenna assembly to be operable simultaneously in at least two frequency bands.

9. The antenna assembly of claim 5, further comprising a coil form disposed over the at least one linear radiator, wherein at least a portion of the at least one helical radiator is wound about an exterior surface of the coil form such that the at least one helical radiator is supported by the coil form without making direct galvanic contact with the at least one linear radiator.

10. The antenna assembly of claim 5, further comprising:

a bottom helical radiating element resonant within a 7-800 MHz frequency band from 764 MHz to 870 MHz; and the at least one linear radiator extends through one or more coils of the bottom helical radiating element;

whereby the antenna assembly is configured such that the bottom helical radiating element parasitically couples to the dual pitch helical coil radiator—and the at least one linear radiator, to thereby broaden the bandwidth of the 7-800 MHz frequency band; and whereby the antenna assembly is resonant in at least four frequency bands including:

the very high frequency (VHF) band from 136 MHz to 174 MHz; and the ultra high frequency (UHF) band from 380 MHz to 527 MHz; and the 7-800 MHz frequency band from 764 MHz to 870 MHz; and the global positioning system (GPS) frequency band including a frequency of 1575 MHz.

11. The antenna assembly of claim 5, wherein:

the wider pitch coils are more responsive and resonant within the UHF band;

the upper narrower pitch coils are operable for introducing another resonance within the VHF band;

the dual pitch helical coil radiator is resonant at a third harmonic within the GPS band;

the first and second conductors are galvanically coupled such that the electrical connection between the first and second conductors allows the antenna assembly to be operable simultaneously for the UHF and GPS bands; and the antenna assembly is omnidirectional for at least the UHF and VHF bands.

12. The antenna assembly of claim 5, comprising:

a circuit board;

a matching network on the circuit board;

wherein the antenna assembly terminates with a connector for connecting the antenna assembly to a device such that the antenna assembly depends to a ground plane of the device to excite; and wherein the matching network on the circuit board is between the connector and the helical and linear radiators.

13. The antenna assembly of claim 12, further comprising:

a sheath disposed over the circuit board, the matching network, and the helical and linear radiators, such that the sheath, the circuit board, the matching network, and the helical and linear radiators are external to a housing of the device when the antenna assembly is connected to the device by the connector; and/or a coil form disposed over the at least one linear radiator, wherein at least a portion of the at least one helical radiator is wound about an exterior surface of the coil form such that the at least one helical radiator is supported by the coil form without making direct galvanic contact with the at least one linear radiator.

14. A portable wireless device comprising a housing and the antenna assembly of claim 13 connected to the portable wireless device by the connector such that the circuit board, the matching network, and the helical and linear radiators are external to the housing of the portable wireless device.

15. A multiband antenna assembly comprising:

at least one helical radiator having a longitudinal axis; and at least one linear radiator aligned with and/or disposed at least partially along the longitudinal axis of the at least one helical radiator;

wherein:

the at least one helical radiator includes a top helical radiator and a bottom helical radiator spaced apart from the top helical radiator; and the at least one linear radiator is between the top and bottom helical radiators, the linear radiator including a first conductor and a second conductor along an end portion thereof, the first and second conductors extending through one or more coils of at least one of the bottom and top helical radiators;

whereby the antenna assembly is resonant in at least three frequency bands, including an ultra high frequency (UHF) band from 380 MHz to 527 MHz, a 7-800 MHz frequency band from 764 MHz to 870 MHz, and a global positioning system (GPS) frequency band including a frequency of 1575 MHz; and wherein the antenna assembly is configured such that:

the antenna assembly has a total electrical length of about one half wavelength ($\lambda/2$) for the UHF band;

the first and second conductors of the at least one linear radiator have a combined electrical length of about one quarter wavelength ($\lambda/4$) for the UHF band;

the bottom helical radiator and the first conductor of the at least one linear radiator each has an electrical length of about one quarter wavelength ($\lambda/4$) for the 7-800 MHz frequency band; and the bottom helical radiator has an electrical length of about one half wavelength ($\lambda/2$) for the GPS band.

16. The antenna assembly of claim 15, wherein:

a loading gap between the first and second conductors is operable for changing the frequency ratio for the UHF band and the 7-800 MHz frequency band and/or helps fine tune the frequency ratio between the UHF band and the 7-800 MHz frequency band; and the bottom helical radiating element couples to the gap, which shifts the resonance of the 7-800 MHz frequency band to a lower frequency while the UHF band resonance is maintained, such that the UHF and GPS bands resonate at the same time.

17. The antenna assembly of claim 15, wherein:

the first and second conductors are galvanically coupled such that the electrical connection between the first and second conductors allows the antenna assembly to be operable simultaneously at the UHF band and 7-800 MHz frequency band; and the antenna assembly is omnidirectional for at least the UHF band and the 7-800 MHz frequency band.

* * * * *